US011382417B2

(12) United States Patent
Choi

(10) Patent No.: US 11,382,417 B2
(45) **Date of Patent: *Jul. 12, 2022**

(54) MULTI-FOLDABLE PICNIC TABLE

(71) Applicant: Inno-Sports Co., Ltd., Xiamen (CN)

(72) Inventor: Kwan Jun Choi, Xiamen (CN)

(73) Assignee: Inno-Sports Co., Ltd., Xiamen (CN)

( * ) Notice: Subject to any disclaimer, the term of this patent is extended or adjusted under 35 U.S.C. 154(b) by 0 days.

This patent is subject to a terminal disclaimer.

(21) Appl. No.: 17/069,458

(22) Filed: Oct. 13, 2020

(65) Prior Publication Data

US 2021/0274929 A1 Sep. 9, 2021

(30) Foreign Application Priority Data

| | | |
|---|---|---|
| Mar. 5, 2020 | (CN) | 202020261508.8 |
| Mar. 5, 2020 | (CN) | 202020261533.6 |
| Apr. 8, 2020 | (CN) | 202020502707.3 |
| Apr. 9, 2020 | (CN) | 202020513759.0 |

(51) Int. Cl.
*A47B 3/14* (2006.01)
*A47B 3/00* (2006.01)

(52) U.S. Cl.
CPC ..... *A47B 3/14* (2013.01); *A47B 3/002* (2013.01)

(58) Field of Classification Search
CPC ... A47B 3/0912; A47B 3/14; A47B 2003/145; A47B 2003/0835; A47C 11/00
USPC ..... 297/158.4
See application file for complete search history.

(56) References Cited

U.S. PATENT DOCUMENTS

| | | | | |
|---|---|---|---|---|
| 2,752,987 A | | 7/1956 | Smithers | |
| 2,875,007 A | | 2/1959 | Fox | |
| 3,027,209 A | | 3/1962 | Nielsen | |
| 3,276,815 A | * | 10/1966 | Cardy | A47B 83/02 297/158.4 |
| 3,410,232 A | | 11/1968 | Bills | |
| 3,574,393 A | * | 4/1971 | Hughes | A47B 3/14 297/139 |
| 4,330,151 A | | 5/1982 | Healey | |
| 4,974,871 A | | 12/1990 | Mao | |
| 5,414,895 A | | 5/1995 | Kazmark, Jr. | |
| 5,499,426 A | | 3/1996 | Hsieh | |

(Continued)

FOREIGN PATENT DOCUMENTS

| | | |
|---|---|---|
| CN | 208863696 U | 5/2019 |
| CN | 209284468 U | 8/2019 |
| FR | 2807632 | 10/2001 |

*Primary Examiner* — Jose V Chen
(74) *Attorney, Agent, or Firm* — Morgan, Lewis & Bockius LLP

(57) ABSTRACT

A picnic table includes a table panel, one or more bench panels, and first and second supporting assemblies. Each supporting assembly includes a table support and one or more bench supports. The table support is connected to the table panel and rotatable with respect to the table panel in a first direction. Each bench support is connected to a corresponding bench panel and rotatable with respect to the corresponding bench panel in the first direction. Each bench support is also connected to the table support and rotatable with respect to the table support in a second direction that is different than the first direction. As a result, each supporting assembly is foldable to the table and bench panels, and each bench panel is foldable to the table panel. When folded, the picnic table is compact and portable.

22 Claims, 44 Drawing Sheets

(56) References Cited

U.S. PATENT DOCUMENTS

| | | | | |
|---|---|---|---|---|
| 5,921,623 | A * | 7/1999 | Nye | A47B 3/14 297/158.4 |
| 6,047,442 | A | 4/2000 | Workman | |
| 6,186,590 | B1 | 2/2001 | Tseng | |
| 6,247,203 | B1 | 6/2001 | Kuo | |
| 6,347,831 | B1 * | 2/2002 | Nye | A47B 3/14 297/118 |
| 6,572,203 | B1 | 6/2003 | Cheng | |
| 6,644,734 | B1 * | 11/2003 | Tseng | A47B 3/14 297/158.4 |
| 6,843,183 | B2 * | 1/2005 | Strong | A47B 9/14 108/147.19 |
| 6,883,864 | B2 | 4/2005 | Gregory | |
| 7,410,194 | B2 | 8/2008 | Chen | |
| 7,735,915 | B2 | 6/2010 | Nye | |
| 8,474,098 | B1 | 7/2013 | Yang | |
| 9,738,295 | B1 | 8/2017 | Horowitz | |
| 10,159,334 | B1 * | 12/2018 | Wang | A47B 3/02 |
| 10,206,496 | B1 * | 2/2019 | Miller | A47B 85/04 |
| 10,470,561 | B2 | 11/2019 | Clegg et al. | |
| D895,345 | S * | 9/2020 | Leng | D7/337 |
| 10,806,247 | B1 | 10/2020 | Chen | |
| 10,806,248 | B1 | 10/2020 | Chen | |
| 11,026,505 | B2 | 6/2021 | Leng | |
| 2004/0070235 | A1 * | 4/2004 | Gregory | A47B 3/14 297/158.4 |
| 2004/0195869 | A1 * | 10/2004 | Zhurong | A47B 3/14 297/158.4 |
| 2004/0227382 | A1 * | 11/2004 | Lin | A47B 3/14 297/158.4 |
| 2006/0181114 | A1 * | 8/2006 | Nye | A47B 3/14 297/158.3 |
| 2008/0018142 | A1 * | 1/2008 | Yul | A47C 7/70 297/158.4 |
| 2012/0175919 | A1 | 7/2012 | Kane | |
| 2017/0340100 | A1 | 11/2017 | Tsai | |
| 2021/0007474 | A1 | 1/2021 | Nye | |
| 2021/0106132 | A1 * | 4/2021 | Chen | A47B 37/04 |
| 2021/0112967 | A1 * | 4/2021 | Leng | A47B 3/14 |
| 2021/0112968 | A1 * | 4/2021 | Ponomar | A47B 3/02 |
| 2021/0169214 | A1 * | 6/2021 | Choi | A47B 3/087 |
| 2021/0177135 | A1 * | 6/2021 | Leng | A47B 3/14 |
| 2021/0274929 | A1 | 9/2021 | Choi | |
| 2021/0274930 | A1 * | 9/2021 | Choi | A47B 3/14 |

* cited by examiner

MULTI-FOLDABLE PICNIC TABLE

CROSS-REFERENCE TO RELATED APPLICATIONS

The present application claims priority to Chinese Utility Model Applications CN 202020261533.6 filed Mar. 5, 2020, CN 202020261508.8 filed Mar. 5, 2020, CN 202020502707.3 filed Apr. 8, 2020 and CN 202020513759.0 filed Apr. 9, 2020. The disclosure of each application is incorporated herein for all purposes by reference in its entirety.

FIELD OF THE INVENTION

The present invention generally relates to tables and, in particular, to multi-foldable picnic tables.

BACKGROUND

Picnicking and camping become more and more popular these days. However, existing picnic tables are usually too bulky or heavy for people to carry around. While some existing tables can be carried around, they require dissembling and reassembling, and separate folding and unfolding of several parts of the tables. In addition, most exiting picnic tables are not adjustable in height, and do not fully meet the needs of different people.

Given the current state of the art, there remains a need for foldable, portable and/or adjustable picnic tables that address the abovementioned issues.

The information disclosed in this Background section is provided for an understanding of the general background of the invention and is not an acknowledgement or suggestion that this information forms part of the prior art already known to a person skilled in the art.

SUMMARY OF THE INVENTION

The present disclosure provides supporting assemblies, supporting frames and picnic tables that are multi-foldable for convenient storage and transportation and/or are adjustable in height to meet the needs of different people.

In various exemplary embodiments, the present disclosure provides a picnic table including a table panel, one or more bench panels, and first and second supporting assemblies. Each of the first and second supporting assemblies includes a table support and one or more bench supports. The table support is connected to the table panel and rotatable with respect to the table panel in a first direction. Each bench support in the one or more bench supports is connected to a corresponding bench panel in the one or more bench panels and rotatable with respect to the corresponding bench panel in the first direction. Each bench support in the one or more bench supports is also connected to the table support and rotatable with respect to the table support in a second direction that is different than the first direction. As such, each of the first and second supporting assemblies is foldable to the table and bench panels, and each of the one or more bench panels is foldable to the table panel.

In some exemplary embodiments, the picnic table further includes a table frame and one or more bench frames. The table frame is disposed at a lower side of the table panel, and the table support is pivotally connected with the table frame. Each of the one or more bench frames is disposed at a lower side of a corresponding bench panel in the one or more bench panels, and each bench support is pivotally connected with a bench frame in the one or more bench frames.

In some exemplary embodiments, corresponding to the first or second supporting assembly, the picnic table further includes a table link having a first end portion pivotally connected with the table frame and a second end portion pivotally connected with the table support of the first or second supporting assembly. When unfolded, the table link helps stabilize the first or second supporting assembly.

In some exemplary embodiments, corresponding to each bench support of the first or second supporting assembly, the picnic table further includes a bench link having a first end portion pivotally connected with the bench frame and a second end portion pivotally connected with an upper end portion of the bench support. The bench link allows the bench and table supports of the first or second supporting assembly to rotate together along the first direction when the bench and table supports of the first or second supporting assembly have different lengths.

In an exemplary embodiment, the second end portion of the bench link is pivotally connected with the upper end portion of the bench support through a connecting piece.

In an exemplary embodiment, when each of the one or more bench panels is folded onto the table panel, the lower side of each bench panel faces the lower side of the table panel. When folded, at least a portion of the first and second supporting assemblies are sandwiched between the table panel and the one or more bench panels.

In another exemplary embodiment, when each of the one or more bench panels is folded onto the table panel, an upper side of each bench panel faces an upper side of the table panel.

In some exemplary embodiments, the table support includes one or more adjustable supports each having an adjustable length. When unfolded, adjusting collectively the lengths of the one or more adjustable supports of the table supports of the first and second supporting assemblies changes a height of the table panel with respect to the one or more bench panels.

In some exemplary embodiments, corresponding to at least one bench panel, each bench support includes an adjustable support having an adjustable length for adjusting a height of the at least one bench panel when unfolded, or for assisting in folding or unfolding of the first or second supporting assembly, or for both.

In many exemplary embodiments, each of the first and second supporting assemblies further includes one or more connectors. Each of the one or more connectors pivotally connects a corresponding bench support in the one or more bench supports with the table support such that the corresponding bench support is rotatable with respect to the table support in the second direction.

In some exemplary embodiments, the table support includes a first supporting bar and each of the one or more bench supports includes a second supporting bar. The second supporting bar is aligned with the first supporting bar in the first direction when unfolded. Each of the one or more connectors pivotally connects the second supporting support of the corresponding bench support with the first supporting bar of the table support such that the second supporting bar of the corresponding bench support is rotatable with respect to the first supporting bar of the table support in the second direction.

In an exemplary embodiment, the first supporting bar of the table support and the second supporting bar of each of the one or more bench supports collectively form a base of the first or second supporting assembly.

In some exemplary embodiments, each of the one or more connectors includes at least one connecting piece, a first fastener and a second fastener. The first fastener pivotally connects an end portion of the first supporting bar with the at least one connecting piece. The second fastener pivotally connects an end portion of the second supporting bar with the at least one connecting piece.

In an exemplary embodiment, the end portion of the first or second supporting bar includes a coupler fixedly coupled with the first or second supporting bar.

In some exemplary embodiments, the at least one connecting piece includes a first connecting piece and a second connecting piece opposing to each other. The first and second connecting pieces form a channel to receive the end portion of the first supporting bar and the end portion of the second supporting bar.

In an exemplary embodiment, each of the one or more connectors further includes at least one third connecting piece fixedly connected or integrally formed with the first and second connecting pieces.

In an exemplary embodiment, the end portion of the first supporting bar includes a first end surface and the end portion of the second supporting bar includes a second end surface. Each of the first and second end surfaces includes a substantially flat portion and a curved portion. The substantially flat portions of the first and second end surfaces abut each other when unfolded. The curved portions of the first and second end surfaces allow the first and second supporting bars to rotate with respect to the first and second connecting pieces.

In some exemplary embodiments, the end portion of one of the first and second supporting bars includes a protrusion, and the end portion of the other of the first and second supporting bars includes a groove to receive the protrusion when unfolded.

In an exemplary embodiment, the protrusion includes a knob at a side thereof and the groove includes a recess to receive the knob and a curved or sloped surface adjacent to the recess to guide the knob into the recess.

In another exemplary embodiment, the protrusion includes a knob at each of two opposing sides of the protrusion, and the groove includes a recess at each of two opposing sides of the groove to receive the knob and a curved or sloped surface adjacent to the recess at each of the two opposing sides of the groove to guide the knob into the recess.

In some exemplary embodiments, the end portion of the first supporting bar includes a first curved side surface and the end portion of the second supporting bar includes a second curved side surface. Each of the one or more connectors includes first and second pins. The first pin is disposed at the at least one connecting piece and operably coupled with the first curved side surface to help guide rotation of the first supporting bar with respect to the at least one connecting piece. The second pin is disposed at the at least one connecting piece and operably coupled with the second curved side surface to help guide rotation of the second supporting bar with respect to the at least one connecting piece.

In some exemplary embodiments, each of the first and second curved side surfaces includes first and second indentations. The first indentation is configured to accommodate crosswise at least a portion of the first or second pin when the picnic table is unfolded to help stabilize the table and bench supports. The second indentation is configured to accommodate crosswise at least a portion of the first or second pin when the picnic table is folded.

In an exemplary embodiment, each of the first and second curved side surfaces further includes a convex segment between the first and second indentations.

In some exemplary embodiments, each of the one or more connectors includes first, second and third couplers. The first coupler is connected with an end portion of one of the first and second supporting bars. The second coupler connected with an end portion of the other one of the first and second supporting bars. The first and second couplers are pivotally connected with each other to allow the first and second supporting bars to rotate with respect to each other along the second direction. The third coupler is pivotally connected with the first coupler and removably connected with the second coupler.

In some exemplary embodiments, the second coupler includes a protrusion at a side thereof. The third coupler includes first and second coupling pieces. The first coupling piece of the third coupler is pivotally connected with the first coupler at a first position. The second coupling piece of the third coupler is pivotally connected with the first coupling piece at a second position and removably connected with the protrusion of the second coupler at a third position.

In an exemplary embodiment, when unfolded, the first position is located between the second and third positions along a length direction of the first supporting bar and is offset from a line defined by the second and third positions.

In an exemplary embodiment, the second coupling piece includes a hook or buckle.

In an exemplary embodiment, the first coupler includes one or more first ribs facing the second coupler when unfolded, and the second coupler includes one or more second ribs facing the first coupler when unfolded. The first and second ribs are zigzagged with respect to each other and operably coupled with each other when unfolded to help stabilize the table and bench supports.

In various exemplary embodiments, the present disclosure provides a supporting assembly for a picnic table having a table panel and one or more bench panels. The supporting assembly includes a table support, one or more bench supports, and one or more connectors. The table support is configured to be connected to the table panel and rotatable with respect to the table panel in a first direction. Each of the one or more bench supports is configured to be connected to a corresponding bench panel in the one or more bench panels and rotatable with respect to the corresponding bench panel in the first direction. Each of the one or more connectors is configured to pivotally connect a corresponding bench support in the one or more bench supports with the table support such that the corresponding bench support is rotatable with respect to the table support in a second direction that is different than the first direction. As such, the table and bench supports are allowed to fold to the table and bench panels, and each of the one or more bench panels is allowed to fold to the table panel. The table support, bench support and connector can be any one of the table supports, bench supports and connectors disclosed herein.

In various exemplary embodiments, the present disclosure provides a supporting frame for a picnic table having a table panel and one or more bench panels. The supporting frame includes one or more supporting assemblies disclosed herein.

The supporting assemblies, supporting frames and picnic tables of the present disclosure have other features and advantages that will be apparent from, or are set forth in more detail in, the accompanying drawings, which are incorporated herein, and the following Detailed Description, which together serve to explain certain principles of exemplary embodiments of the present disclosure.

BRIEF DESCRIPTION OF THE DRAWINGS

The accompanying drawings, which are incorporated into and constitute a part of this specification, illustrate one or more exemplary embodiments of the present disclosure and, together with the Detailed Description, serve to explain the principles and implementations of exemplary embodiments of the invention.

Figure 1A:
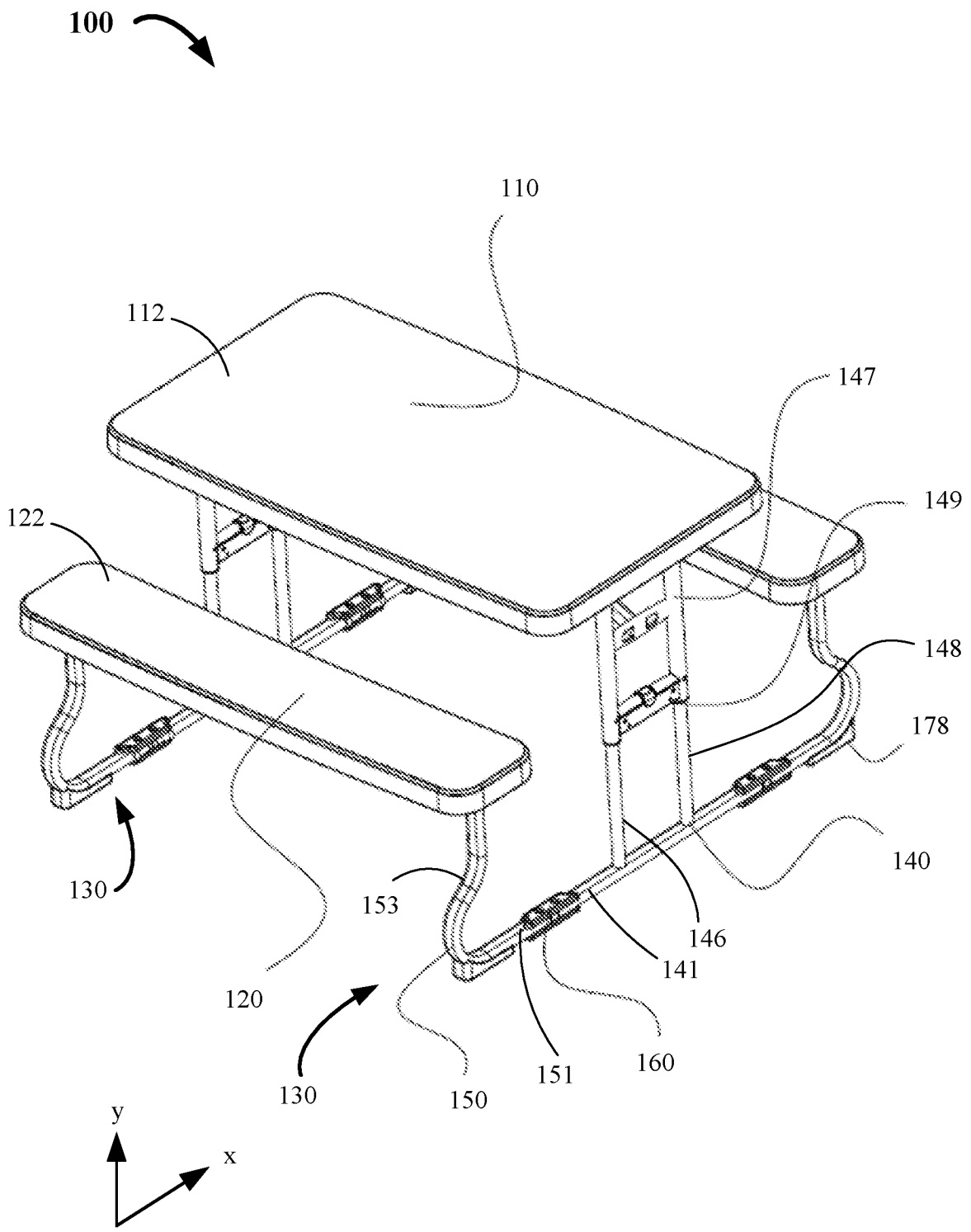
FIG. 1A is a top perspective view illustrating an exemplary picnic table in an unfolded state in accordance with exemplary embodiments of the present disclosure.

As will be apparent to those of skill in the art, the components illustrated in the figures described above are combinable in any useful number and combination. The figures are intended to be illustrative in nature and are not limiting.

DETAILED DESCRIPTION

Reference will now be made in detail to implementation of exemplary embodiments of the present disclosure as illustrated in the accompanying drawings. The same reference indicators will be used throughout the drawings and the following detailed description to refer to the same or like parts. Those of ordinary skill in the art will understand that the following detailed description is illustrative only and is not intended to be in any way limiting. Other embodiments of the present disclosure will readily suggest themselves to such skilled persons having benefit of this disclosure.

In the interest of clarity, not all of the routine features of the implementations described herein are shown and described. It will be appreciated that, in the development of any such actual implementation, numerous implementation-specific decisions are made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Many modifications and variations of the exemplary embodiments set forth in this disclosure can be made without departing from the spirit and scope of the exemplary embodiments, as will be apparent to those skilled in the art. The specific exemplary embodiments described herein are offered by way of example only, and the disclosure is to be limited only by the terms of the appended claims, along with the full scope of equivalents to which such claims are entitled.

Embodiments of the present disclosure are described in the context of picnic tables. A picnic table generally includes a table panel, one or more bench panels and a supporting frame to support the table and bench panels. A supporting frame generally includes one or more supporting assemblies, each having a table support rotatably coupled to the table panel and one or more bench supports rotatably coupled to the one or more bench panels. Of each supporting assembly, each bench support is rotatably coupled to the table support. The rotatable connection allows each supporting assembly to fold to the table and bench panels and allow each bench panel to fold to the table panel. As such, when folded, each bench panel is laid on the table panel, either face-to-face or back-to-back with the table panel. In some cases, at least a portion of the supporting assembly is sandwiched between the table and bench panels. Thus, when folded, the picnic table is compact with a generally layered block-like shape, making it easy and convenient for storage and transportation.

In some exemplary embodiments, the table support is adjustable in length. As such, the height of the table panel can be adjusted, by adjusting the length of the table support, to meet the needs of various end users. In some exemplary embodiments, each bench support corresponding to a table panel is adjustable in length. As such, the height of the bench panel can be adjusted, by adjusting the length of the bench support, to meet the needs of various end users. In addition, in some cases, the adjustable table or bench support allows the supporting assembly to fold to the table and bench panels.

The table and bench panels of the picnic tables disclosed herein can be of various shapes including but not limited to a square shape, a round shape or a rectangular shape, and can be made of various materials including but not limited to metals, plastics and woods. In some exemplary embodiments, the table panel, the bench panel or both are made of plastics by injection molding, blow molding or any other suitable processes. The supporting frame of the present disclosure can be made of various materials including but not limited to metals (e.g., iron, steel, and aluminum) and plastics.

Figure 1B:
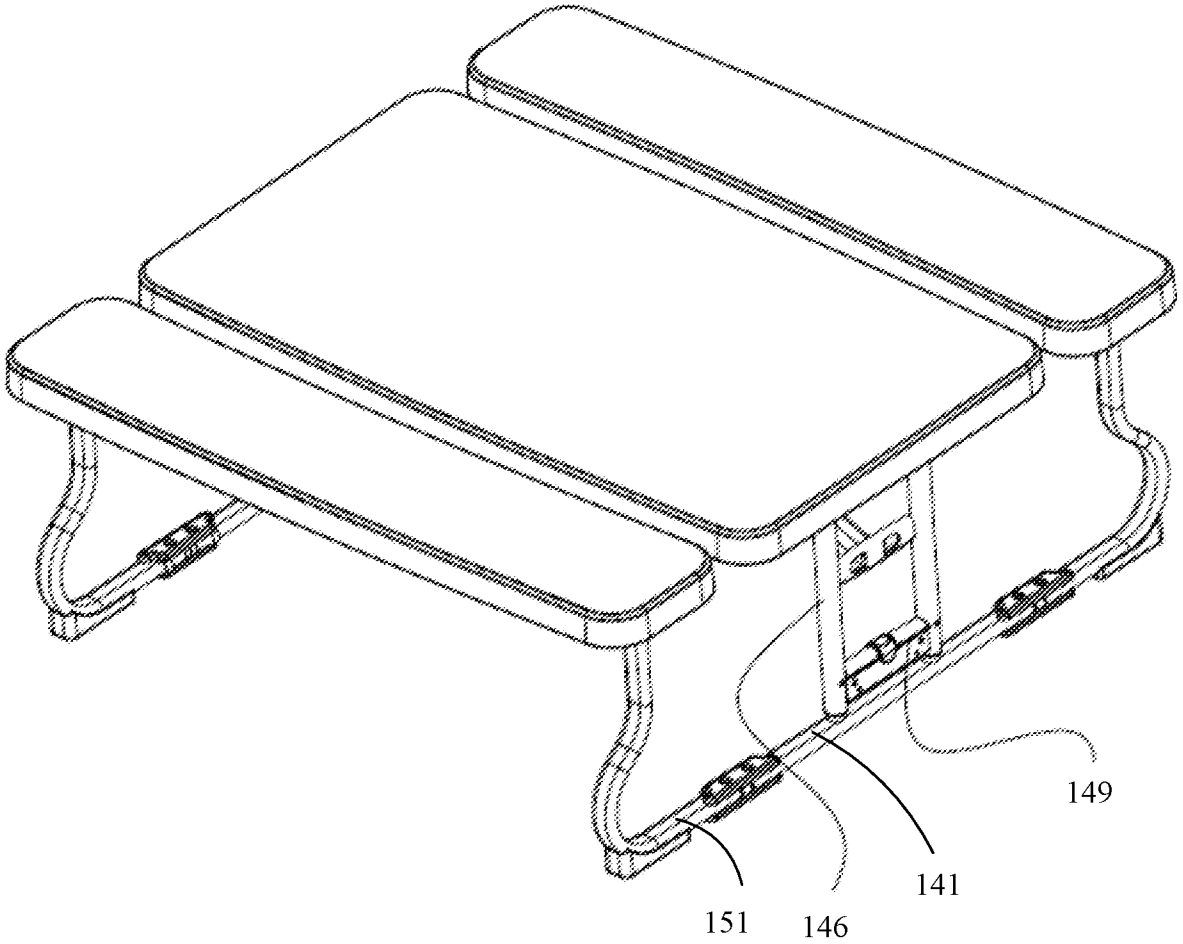
FIG. 1B is a top perspective view illustrating the exemplary picnic table of FIG. 1A with the table panel at a different height in accordance with exemplary embodiments of the present disclosure.
Figure 1C:
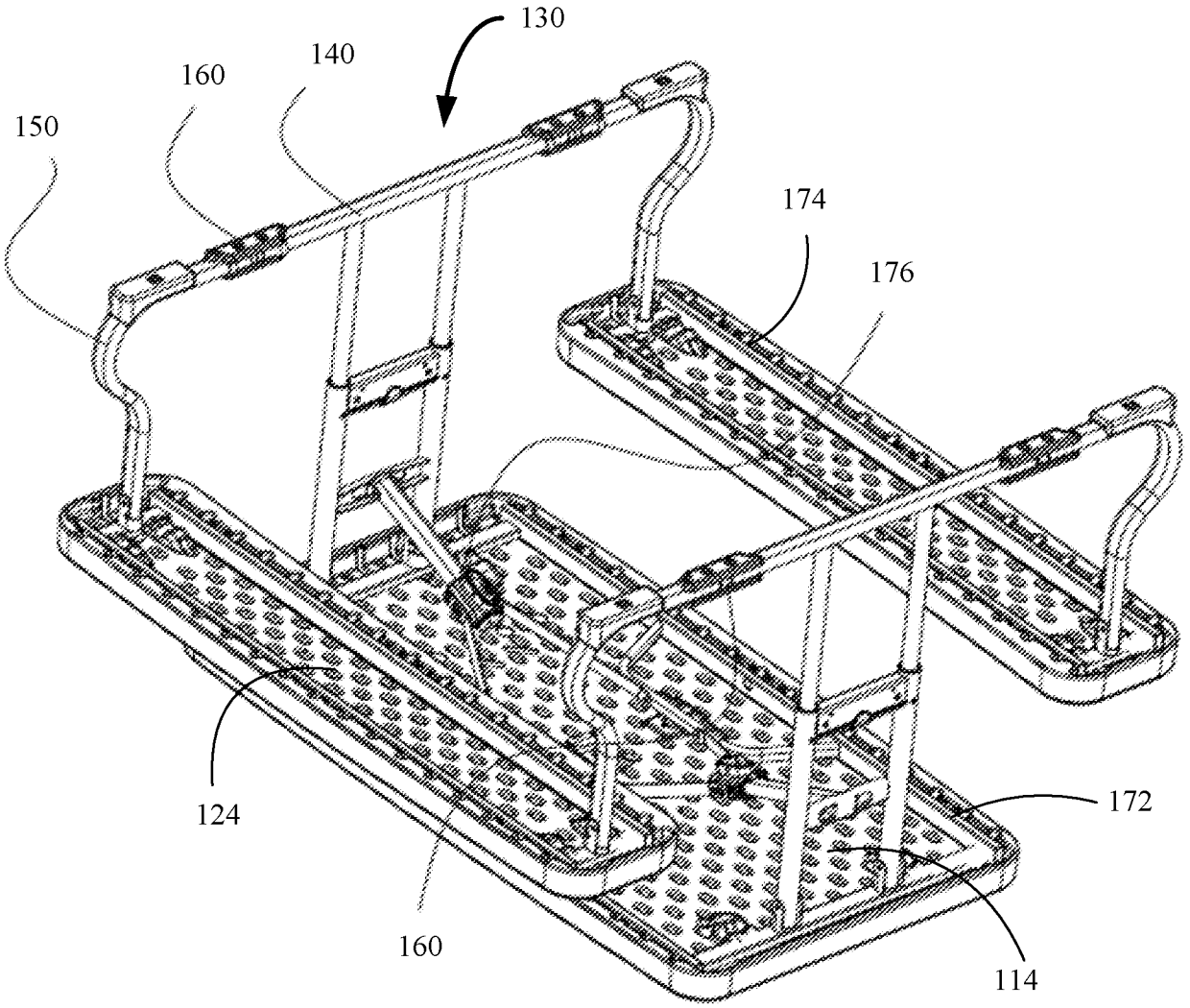
FIG. 1C is a bottom perspective view illustrating the exemplary picnic table of FIG. 1A.

Referring now to FIGS. 1A-1C, there is depicted exemplary picnic table 100 in accordance with some embodiments of the present disclosure. As shown, picnic table 100 includes a table panel such as table panel 110, and one or more bench panels such as bench panel 120. By way of example, FIGS. 1A-1C illustrate two bench panels. Table panel 110 includes an upper side such as upper side 112 and a lower side such as lower side 114. Bench panel 120 includes an upper side such as upper side 122 and a lower side such as lower side 124.

Picnic table 100 also includes one or more supporting assemblies such as supporting assembly 130 to support the table and bench panels. By way of example, FIGS. 1A-1C illustrate two supporting assemblies, one disposed at a first side and one at a second side of the picnic table when in use. The supporting assemblies can be the same as or different from each other.

In some exemplary embodiments, supporting assembly 130 includes a table support such as table support 140 to support the table panel and one or more bench supports such as bench support 150 to support the one or more bench panels. For instance, in the illustrated embodiment, supporting assembly 130 includes two bench supports 150, each supporting a corresponding bench panel 120. The supporting assembly of the present disclosure can be made of various materials including but not limited to metals (e.g., iron, steel, and aluminum) and plastics.

In some exemplary embodiments, picnic table 100 includes a table frame such as table frame 172 and one or more bench frames such as bench frame 174. Table frame 172 is disposed at a lower side of table panel 110 and configured to rotatably connect the table support of each supporting assembly 130 with the table panel. Each bench frame 174 is disposed at a lower side of a corresponding bench panel and configured to rotatably connect a respective bench support of each supporting assembly 130 with the corresponding bench panel. The table and bench frames, together with the one or more supporting assemblies and additional or optional components, are collectively referred to herein as a supporting frame.

In some exemplary embodiments, picnic table 100 includes one or more table links to assist rotation of the one or more supporting assemblies and/or to support and stabilize the one or more supporting assemblies when unfolded. For instance, in an exemplary embodiment, corresponding to each supporting assembly 130, picnic table 100 includes a table link such as table link 176. Table link 176 has a first end portion pivotally connected with the table frame and a second end portion pivotally connected with the table support of the first or second supporting assembly. When unfolded, the table link helps hold and stabilize the supporting assembly.

Of each supporting assembly 130, in some exemplary embodiments, table support 140 is configured to be an adjustable assembly or to include an adjustable assembly for adjusting the length of the table support and thus the height of the table panel. An adjustable assembly generally includes one, two, three or more than three adjustable supports. For instance, as an example, FIG. 1A illustrates table support (or adjustable assembly) 140 having two adjustable supports 146 that are spaced apart and substantially parallel to each other. Each adjustable support 146 includes an inner bar such as inner bar 148 and an outer tubular bar such as outer tubular bar 147. The inner bar can be tubular or non-tubular. The inner and outer bars are telescopically coupled with each other.

In some exemplary embodiments, each adjustable support 146 includes a locking/unlocking mechanism configured to control relative movement of the inner and outer bars of the respective adjustable support. Examples of adjustable supports are disclosed in U.S. patent application Ser. No. 15/400,861, Ser. No. 15/931,925 and Ser. No. 17/000,661, the disclosure of each application is incorporated herein for all purposes by reference in its entirety. In some exemplary embodiments, table support 140 includes an adjustment mechanism such as adjustment 149 coupled with the one or more adjustable supports and configured to control relative movement of the inner and outer bars of each of the one or more adjustable supports. Examples of adjustment mechanisms are disclosed in U.S. patent application Ser. Nos. 17/003,047 and Ser. No. 17/038,369, the disclosure of each application is incorporated herein for all purposes by reference in its entirety.

When unfolded, one can change the height of the table panel by adjusting collectively the lengths of table supports 140 of the supporting assemblies. In some exemplary embodiments, the height of the table panel is adjustable between a first position at which the table panel is positioned higher than the one or more bench panels and a second position at which the table panel is positioned at a level substantially the same as the one or more bench panels. In an exemplary embodiment, there exists at least one intermediate position between the first and second positions. When the table panel is aligned with the one or more bench panels, the supporting assembly can be folded onto the table and bench panels, thereby making the picnic table compact and convenient for storage and transportation.

In some exemplary embodiments, table support 140 is rotatable with respect to table panel 110 along a first direction (e.g., the x-direction in FIG. 1A or the lateral direction of the table panel). Similarly, bench support 150 is rotatable with respect to bench panel 120 along the first direction. Although rotatable along the same direction, it should be noted that the rotation axes of the table and bench panels can be coincided with each other or offset from each other.

Of each supporting assembly 130, in some exemplary embodiments, the table and bench panels are connected with each other and rotatable with respect to each other along a second direction (e.g., the y-direction in FIG. 1A) that is different than the first direction. In an exemplary embodiment, the second direction is substantially perpendicular to the first direction. In some exemplary embodiments, supporting assembly 130 includes one or more connectors such as connector 160, each for pivotally connecting one bench support 150 with table support 140 such that the bench support is rotatable with respect to the table support in the second direction.

Figure 1D:
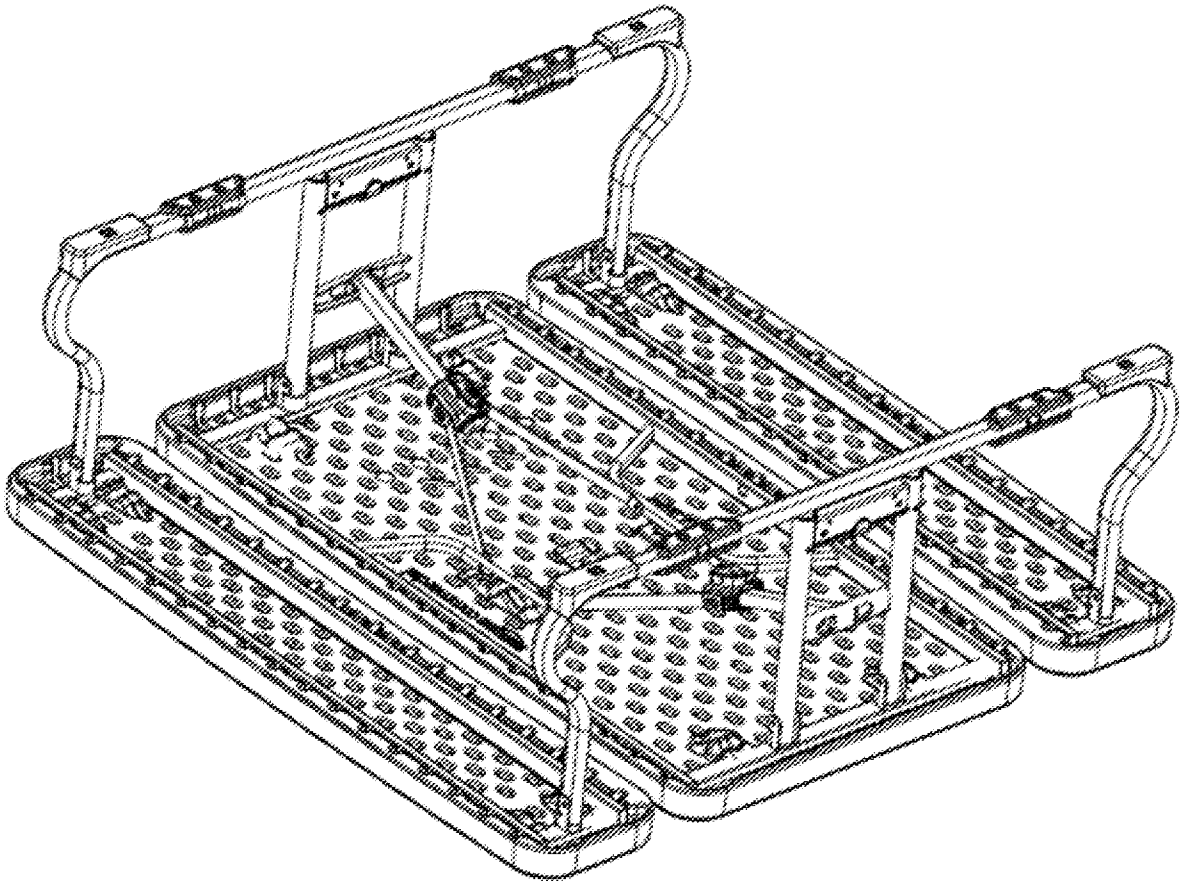
FIG. 1D is a bottom perspective view illustrating the exemplary picnic table of FIG. 1A with the table panel at a different height in accordance with exemplary embodiments of the present disclosure.
Figure 1E:
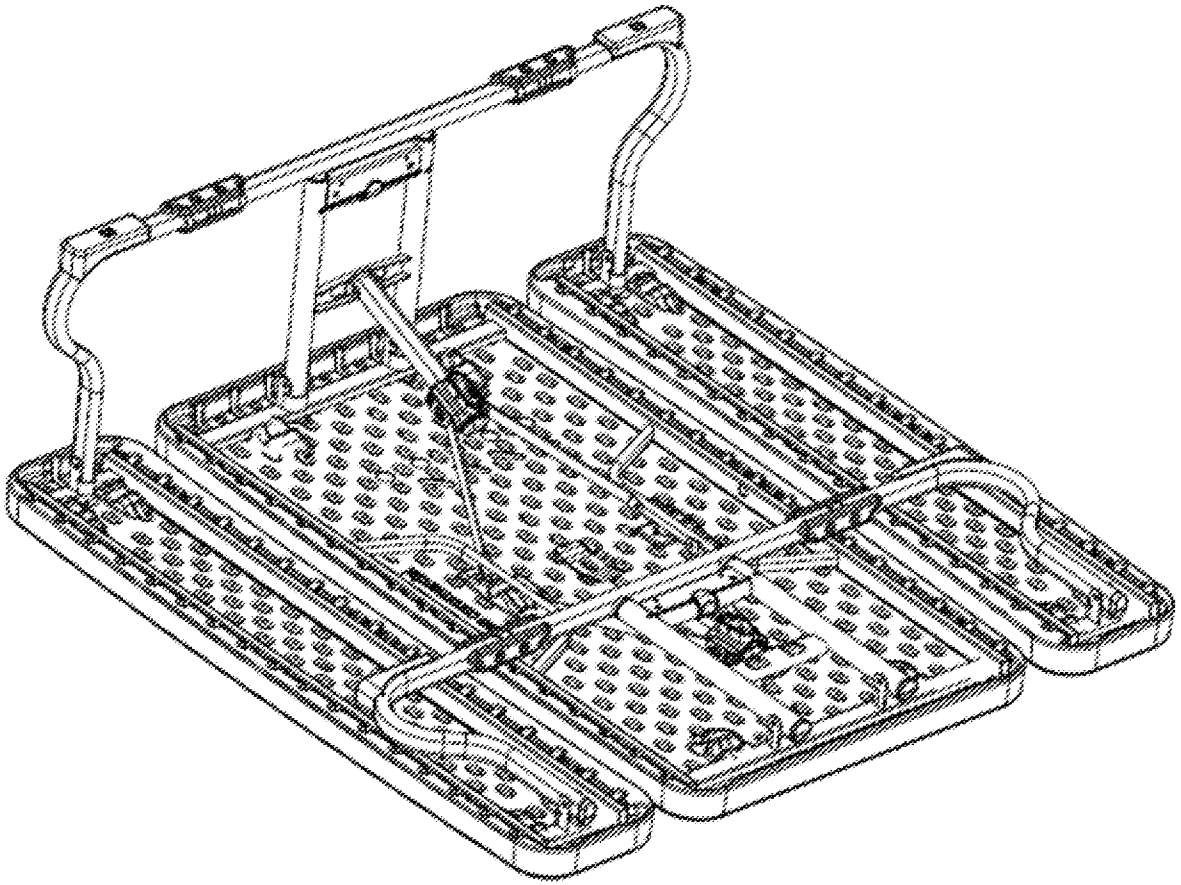
FIG. 1E is a bottom perspective view illustrating the exemplary picnic table of FIG. 1A in a first intermediate state in accordance with exemplary embodiments of the present disclosure.
Figure 1F:
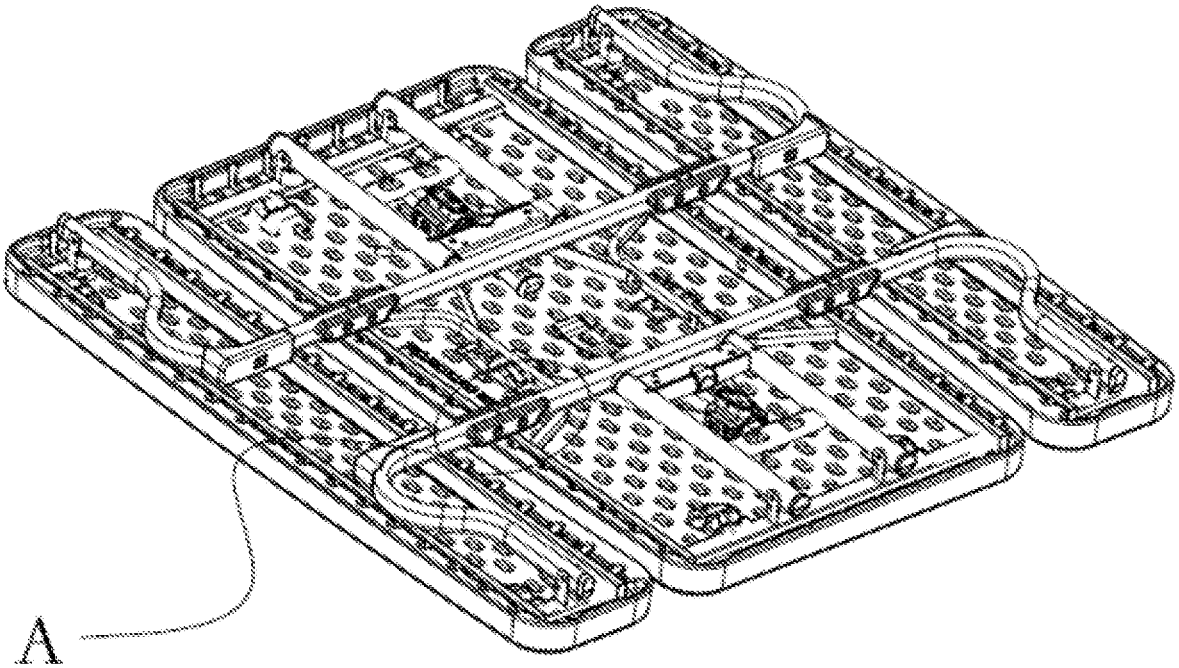
FIG. 1F is a bottom perspective view illustrating the exemplary picnic table of FIG. 1A in a second intermediate state in accordance with exemplary embodiments of the present disclosure.
Figure 1G:
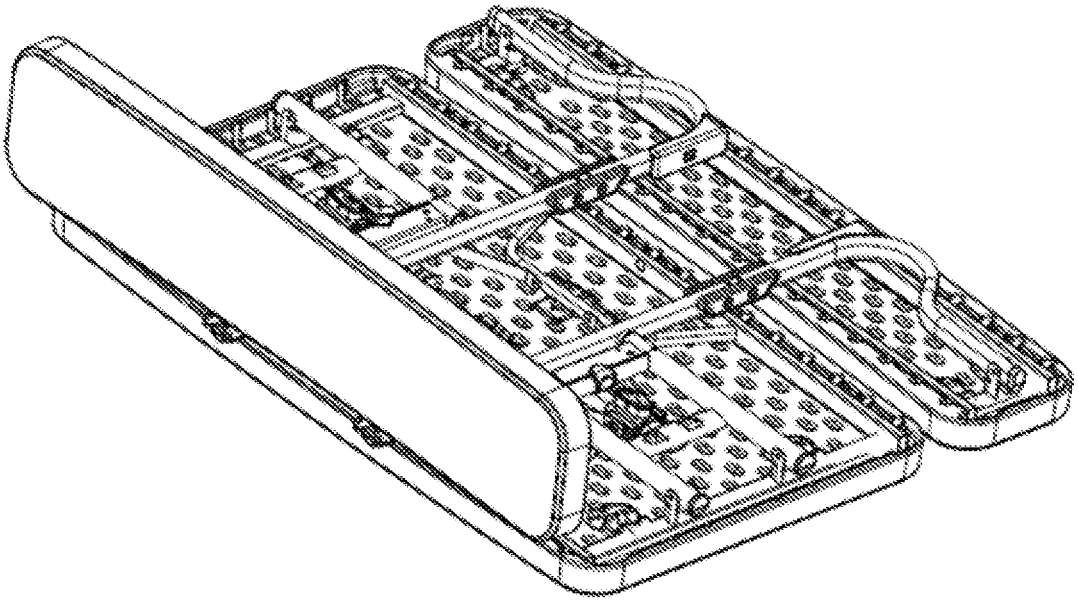
FIG. 1G is a bottom perspective view illustrating the exemplary picnic table of FIG. 1A in a third intermediate state in accordance with exemplary embodiments of the present disclosure.
Figure 1H:
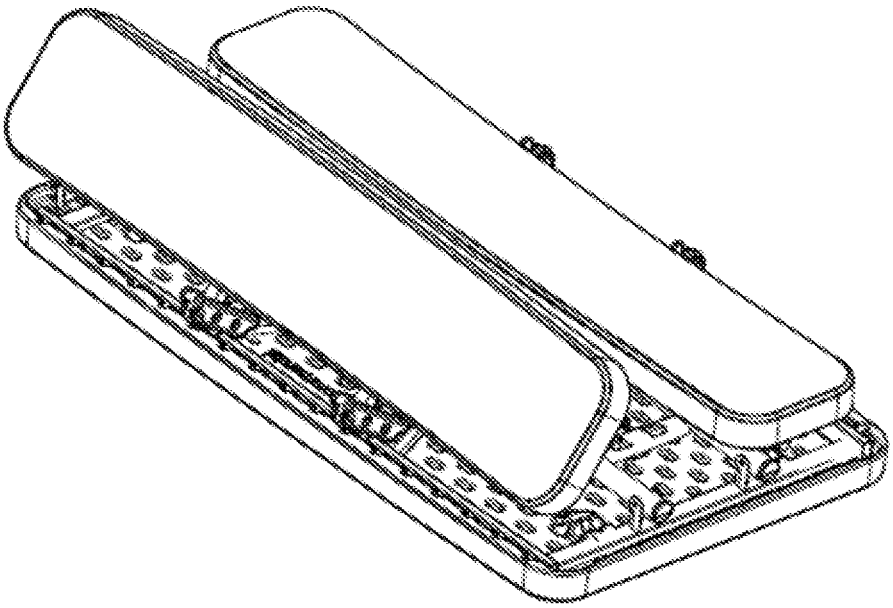
FIG. 1H is a bottom perspective view illustrating the exemplary picnic table of FIG. 1A in a fourth intermediate state in accordance with exemplary embodiments of the present disclosure.
Figure 1I:
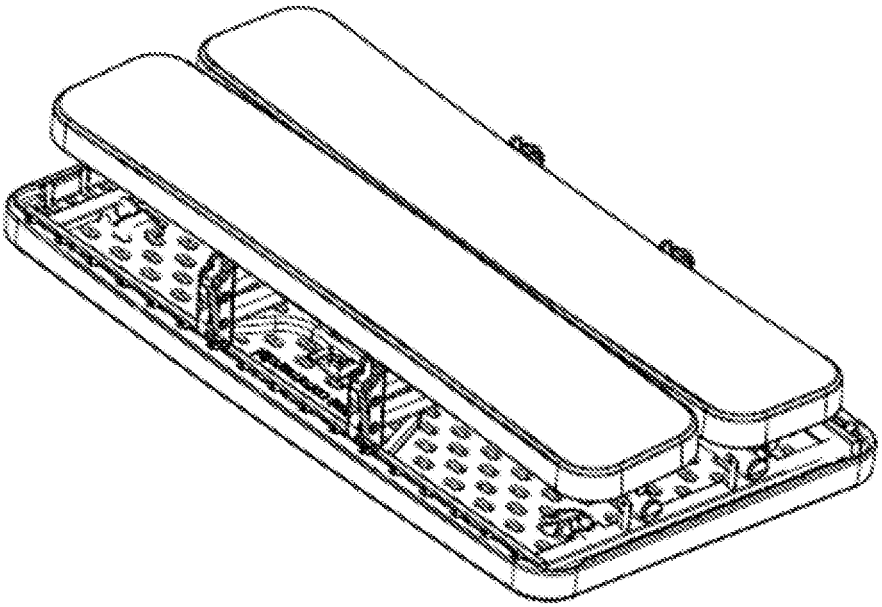
FIG. 1I is a bottom perspective view illustrating the exemplary picnic table of FIG. 1A in a folded state in accordance with exemplary embodiments of the present disclosure.
Figure 1J:
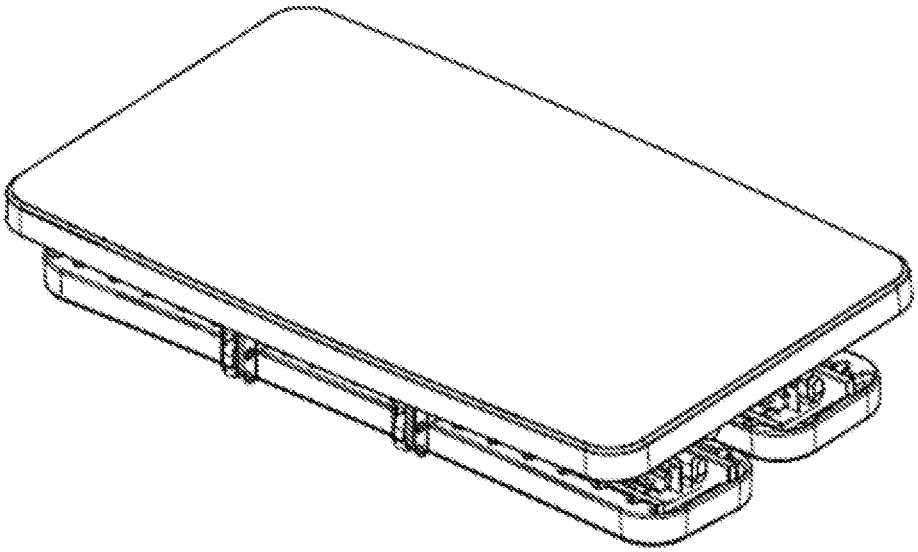
FIG. 1J is a top perspective view illustrating the exemplary picnic table of FIG. 1A in a folded state in accordance with exemplary embodiments of the present disclosure.

Referring to FIGS. 1C-1J, there is depicted an exemplary process to fold picnic table 100 in accordance with some embodiments of the present disclosure. First, the table support is adjusted to level the table and bench panels as illustrated in FIG. 1D. Then each supporting assembly is rotated and folded onto the leveled table and bench panels as illustrated in FIGS. 1E and 1F. After that, each bench panel is rotated and folded onto the table panel as illustrated in FIGS. 1G and 1H. The folded picnic table is illustrated in FIGS. 1I and 1J, of which FIG. 1I is a bottom perspective view and FIG. 1J is a top perspective view. The supporting assemblies (at least a portion of them) are sandwiched between the table and bench panels. While rotation illustrated in FIGS. 1G-1H results in the lower sides of the table and bench panels facing each other (e.g., back-to-back), it should be noted that a similar structure can be constructed such that when folded the upper sides of the table and bench panels face each other (e.g., face-to-face). In either case, the picnic table is folded into a generally layered block-like structure. As such, when folded, it is compact, and thus easy and convenient for storage and transportation. Reversing the process unfolds the picnic table.

Referring to FIGS. 1A-1C, in some exemplary embodiments, table support 140 includes a first supporting bar such as first supporting bar 141 and bench support 150 includes a second supporting bar such as second supporting bar 151. First supporting bar 141 and second supporting bar 151 are aligned with each other in the first direction when unfolded (e.g., when bench panel 120 is unfolded from table panel 110, or when the entire picnic table is unfolded). Connector 160 pivotally connects the second supporting support of the bench support with the first supporting bar of the table support such that the second supporting bar is rotatable with respect to the first supporting bar of the table support in the second direction.

In some exemplary embodiments, first supporting bar 141 of the table support and second supporting bar 151 collectively form a base of the first or second supporting assembly. In some exemplary embodiments, one or more pads such as pad 178 are provided at the base. Pad 178 is configured to provide better contact with the ground, thereby helping to stabilize the picnic table when in use.

In some exemplary embodiments where the table support includes one or more adjustable supports, each adjustable support has a lower end portion fixedly connected or integrally formed with the first supporting bar. As such, when each of the first and second supporting assemblies is unfolded, adjusting collectively the lengths of the one or more adjustable supports of the table supports changes a height of the table panel with respect to the one or more bench panels.

In some exemplary embodiments, bench support 150 further includes a bench leg such as bench leg 153. The bench leg has a lower end portion fixedly connected or integrally formed with second supporting bar 151. In an exemplary embodiment, the bench leg is arched in the first direction (e.g., arched outwardly). In an exemplary embodiment, the second supporting bar is a portion of a bench leg.

Figure 2:
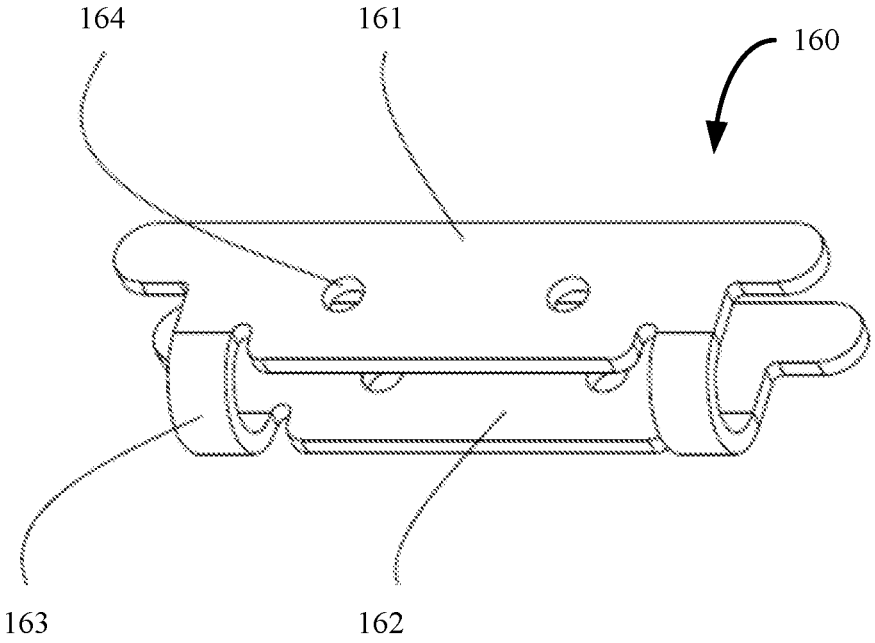
FIG. 2 is a perspective view illustrating an exemplary connector in accordance with exemplary embodiments of the present disclosure.
Figure 3A:
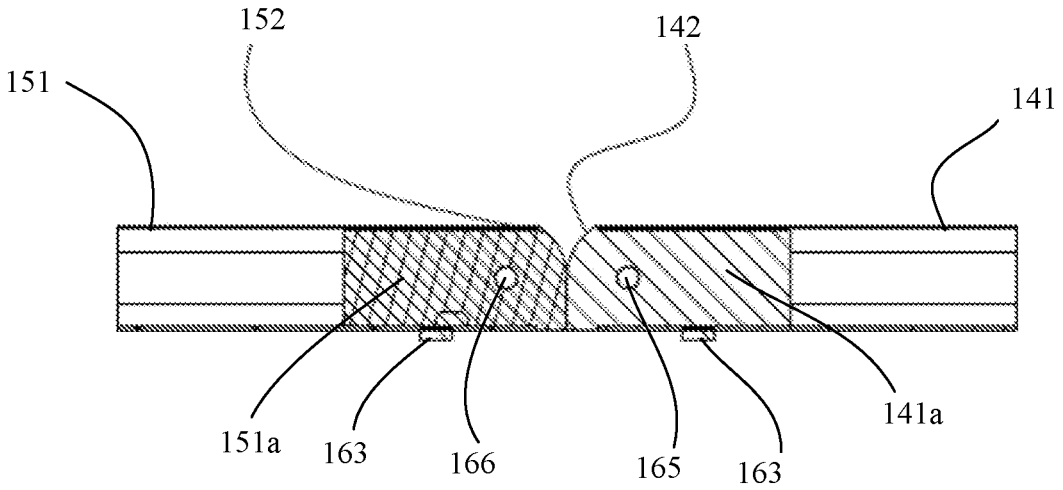
FIG. 3A is a schematic view illustrating a connection in an exemplary supporting assembly in an unfolded state (e.g., oval A in FIG. 1F) in accordance with exemplary embodiments of the present disclosure.
Figure 3B:
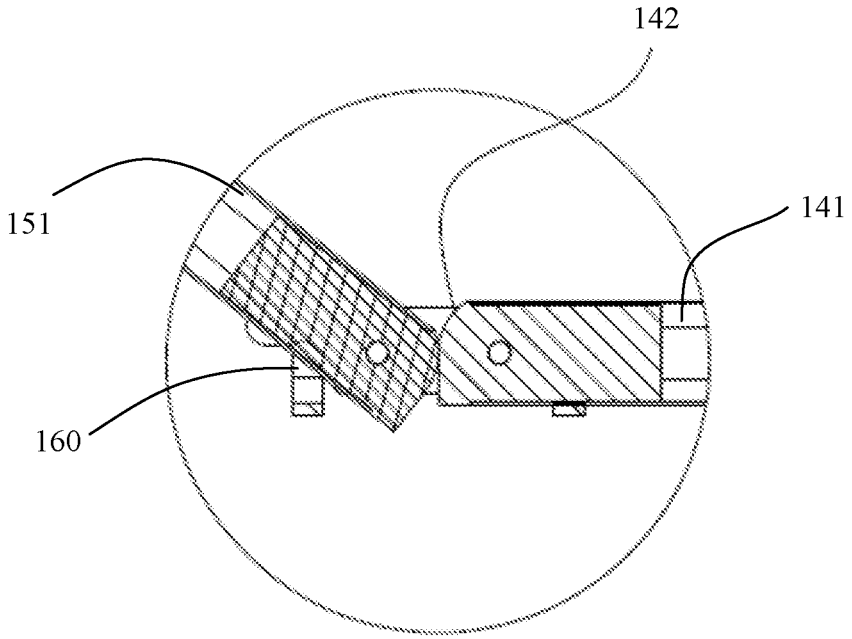
FIG. 3B is a schematic view illustrating the connection of FIG. 3A in a first intermediate state in accordance with exemplary embodiments of the present disclosure.
Figure 3D:
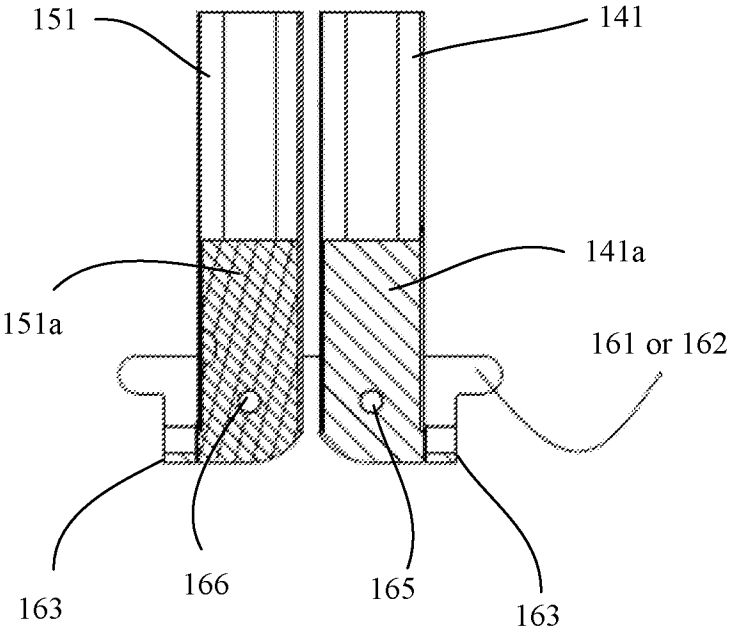
FIG. 3D is a schematic view illustrating the connection of FIG. 3A in a folded state in accordance with exemplary embodiments of the present disclosure.
Figure 3C:
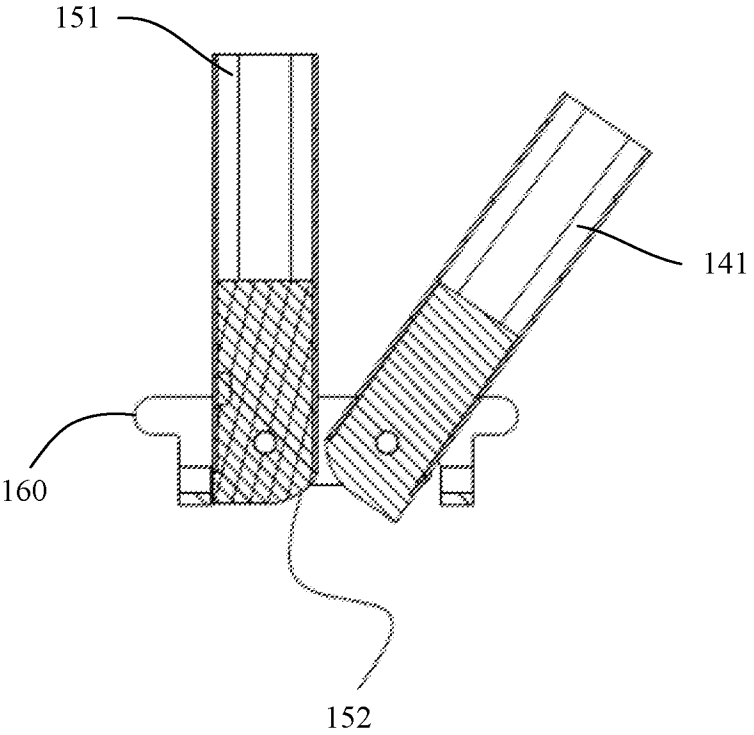
FIG. 3C is a schematic view illustrating the connection of FIG. 3A in a second intermediate state in accordance with exemplary embodiments of the present disclosure.

Referring to FIGS. 2 and 3A-3D, there are depicted connector 160 and the use of the connector to connect the second supporting support of the bench support with the first supporting bar of the table support in accordance with some exemplary embodiments of the present disclosure. Of these figures, FIG. 3A illustrates the connection at an unfolded state (e.g., the bench support is unfolded with respect to the table support while the entire picnic table may or may not be unfolded), FIGS. 3B and 3C illustrate the connection at two intermediate states, and FIG. 3D illustrates the connection at a folded state (e.g., the bench support is folded onto the table support).

In some exemplary embodiments, connector 160 includes at least one connecting piece, a first fastener pivotally connecting an end portion of the first supporting bar with the at least one connecting piece, and a second fastener pivotally connecting an end portion of the second supporting bar with the at least one connecting piece. For instance, in the illustrated embodiment, connector 160 including first connecting piece 161, second connecting piece 162, first fastener 165 and second fastener 166. In an exemplary embodiment, the first and second connecting pieces are disposed opposing to each other to form a channel to receive the end portion of the first supporting bar and the end portion of the second supporting bar. First fastener 165 pivotally connects end portion 141*a* of first supporting bar 141 of the table support with the first and second connecting pieces. Second fastener 166 pivotally connects end portion 151*a* of second supporting bar 151 of the bench support with the first and second connecting pieces. In an exemplary embodiment, the first or second fastener is coupled with the first and second connecting pieces through one or more holes such as hole 164 formed at the first and second connecting pieces.

First supporting bar 141 of the table support or second supporting bar 151 of the bench support can be a single unitary piece or made of multiple bar segments. In an exemplary embodiment, the end portion of first supporting bar 141 of the table support or second supporting bar 151 of the bench support includes a coupler connected or formed with the first or second supporting bar. The end portion 141*a* of first supporting bar 141 and the end portion 151*a* of second supporting bar 151 can be disposed generally symmetric or asymmetric with respect to each other. In the illustrated embodiment, the end portions of the first and second supporting bars are generally symmetric to each other, with the two pivoting points spaced apart in the first direction.

In some exemplary embodiments, connector 160 further includes at least one third connecting piece fixedly connected or integrally formed with the first and second connecting pieces. For instance, FIG. 2 illustrates two third connecting pieces 163, each having an end fixedly connected or integrally formed with first connecting piece 161 and another end fixedly connected or integrally formed with second connecting piece 162. Third connecting piece 163 enhances the strength of the connector. In some cases, third connecting piece 163 serves as a stopper to help preventing first supporting bar 141 of the table support (and thus the table panel) or second supporting bar 151 of the bench support (and thus the bench panel) from rotating beyond its unfolded state as illustrated in FIG. 3A and from rotating beyond its folded state as illustrated in FIG. 3D.

In some exemplary embodiments, to assist folding and unfolding of first supporting bar 141 of the table support (and thus the table panel) or second supporting bar 151 of the bench support (and thus the bench panel), the end portion of the first or second supporting bar includes an end surface that is at least partially curved. For instance, in an exemplary embodiment, end portion 141*a* of the first supporting bar includes a first end surface such as first end surface 142, and end portion 151*a* of the second supporting bar includes a second end surface such as second end surface 152. Each of the first and second end surfaces includes a substantially flat portion and a curved portion. The flat portions of the first and second end surfaces, as illustrated in FIG. 3A, abut each other when unfolded and thus help to stabilize the unfolded bench and table supports. The curved portions of the first and second end surfaces, as illustrated in FIGS. 3B and 3C, make it easy to rotate the first and second supporting bars with respect to each other.

Figure 4A:
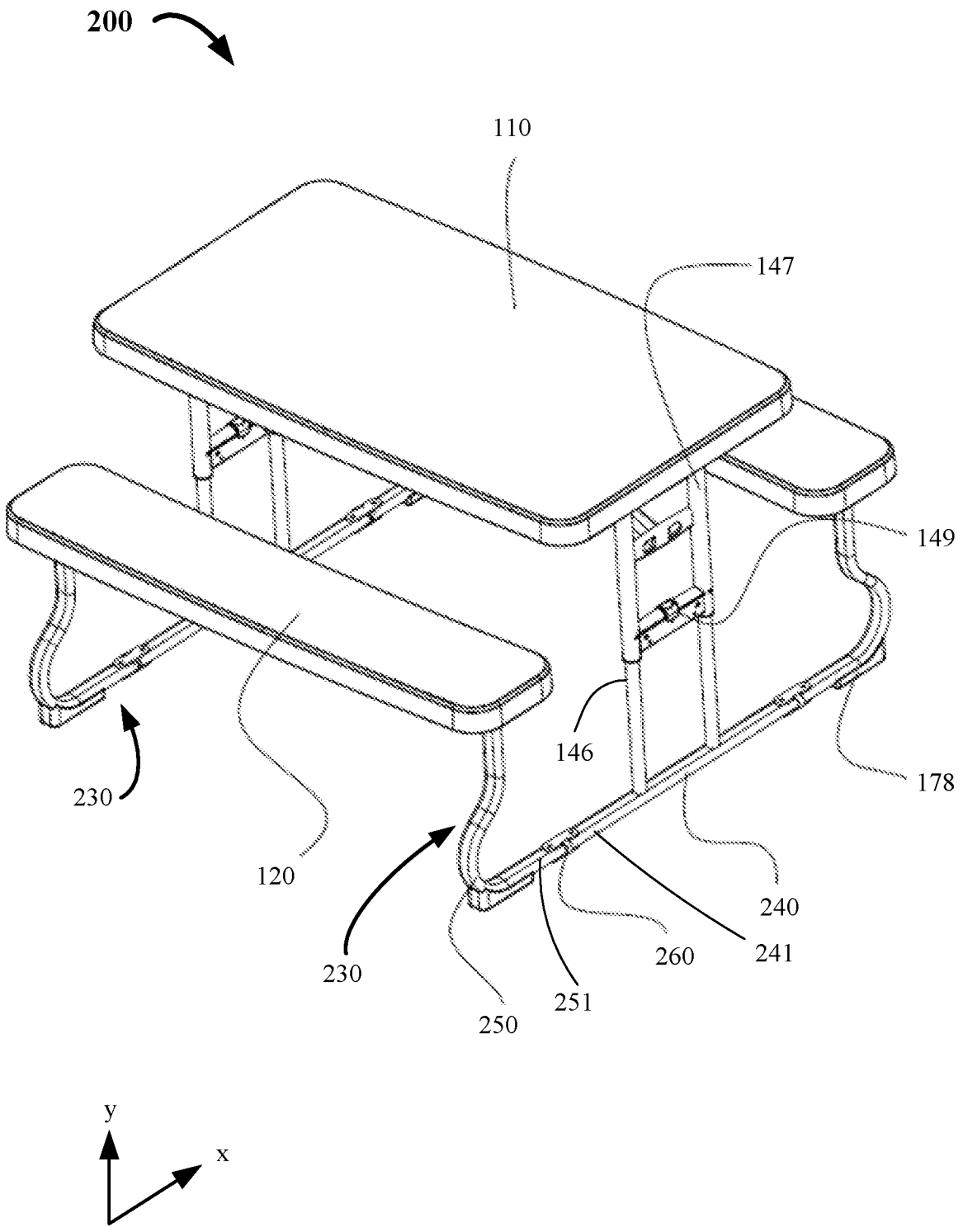
FIG. 4A is a top perspective view illustrating an exemplary picnic table in an unfolded state in accordance with exemplary embodiments of the present disclosure.
Figure 4B:
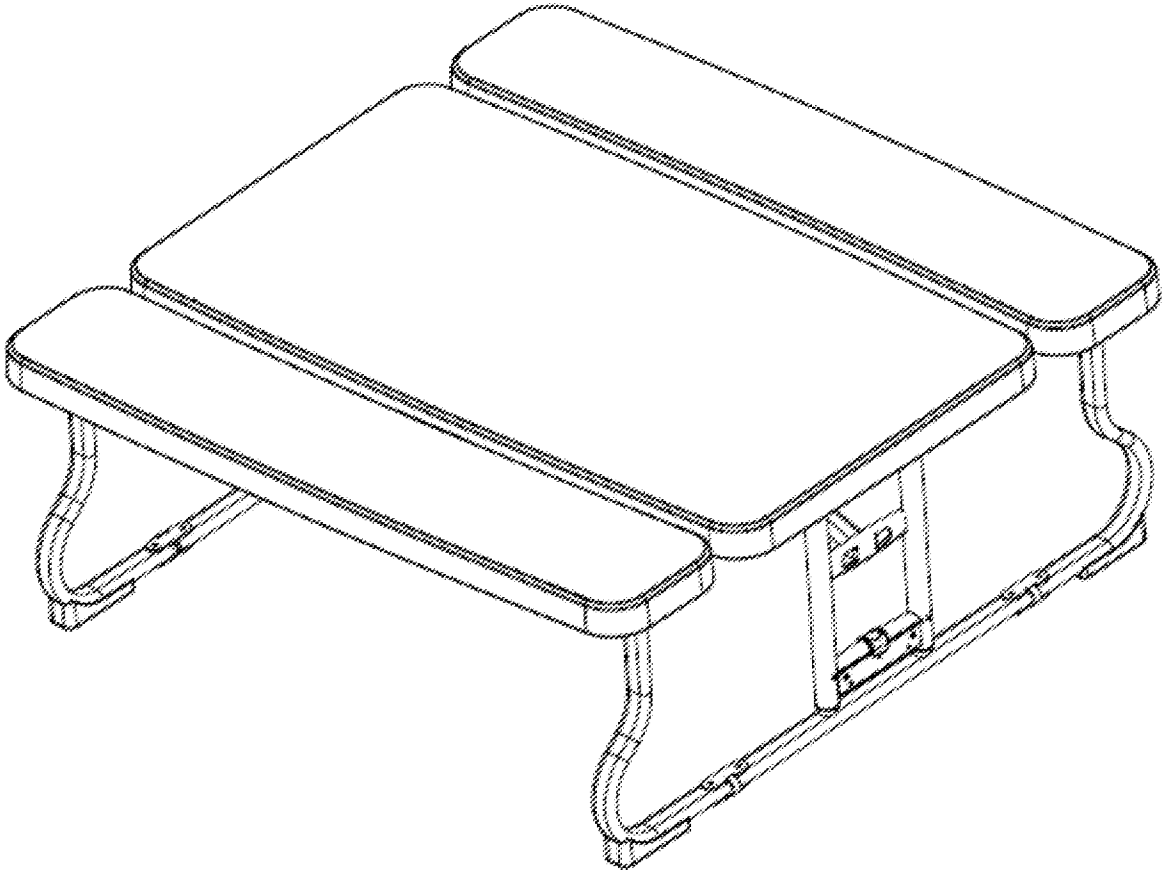
FIG. 4B is a top perspective view illustrating the exemplary picnic table of FIG. 4A with the table panel at a different height in accordance with exemplary embodiments of the present disclosure.
Figure 4C:
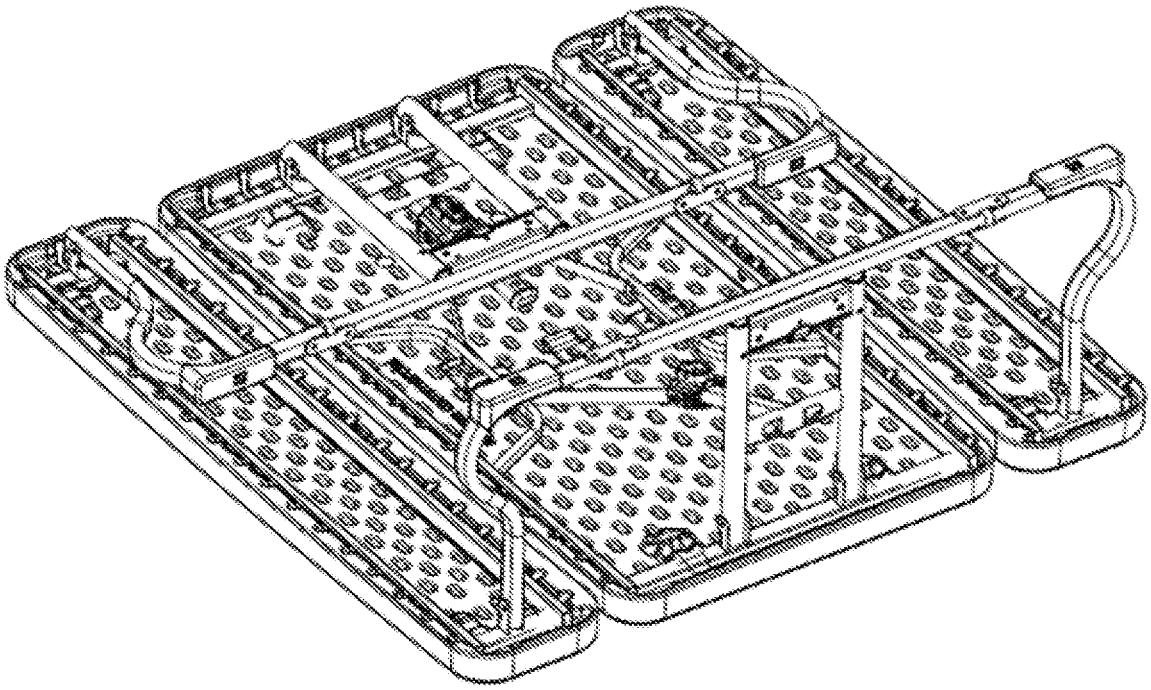
FIG. 4C is a bottom perspective view illustrating the exemplary picnic table of FIG. 4A in a first intermediate state in accordance with exemplary embodiments of the present disclosure.
Figure 4D:
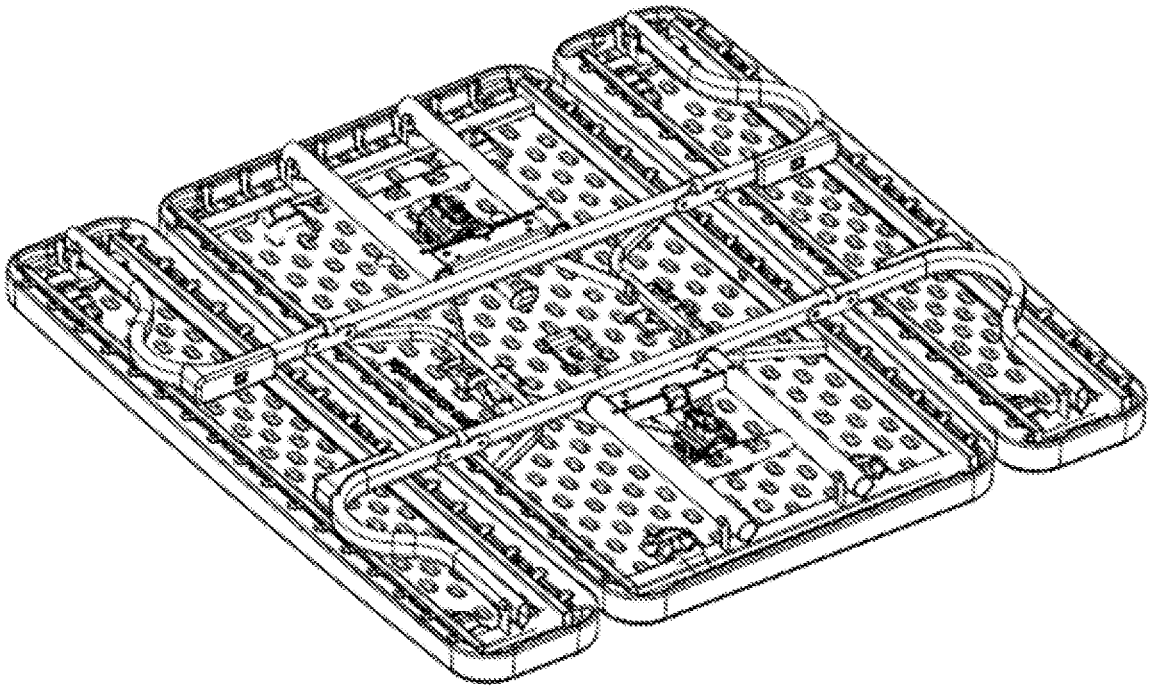
FIG. 4D is a bottom perspective view illustrating the exemplary picnic table of FIG. 4A in a second intermediate state in accordance with exemplary embodiments of the present disclosure.
Figure 4E:
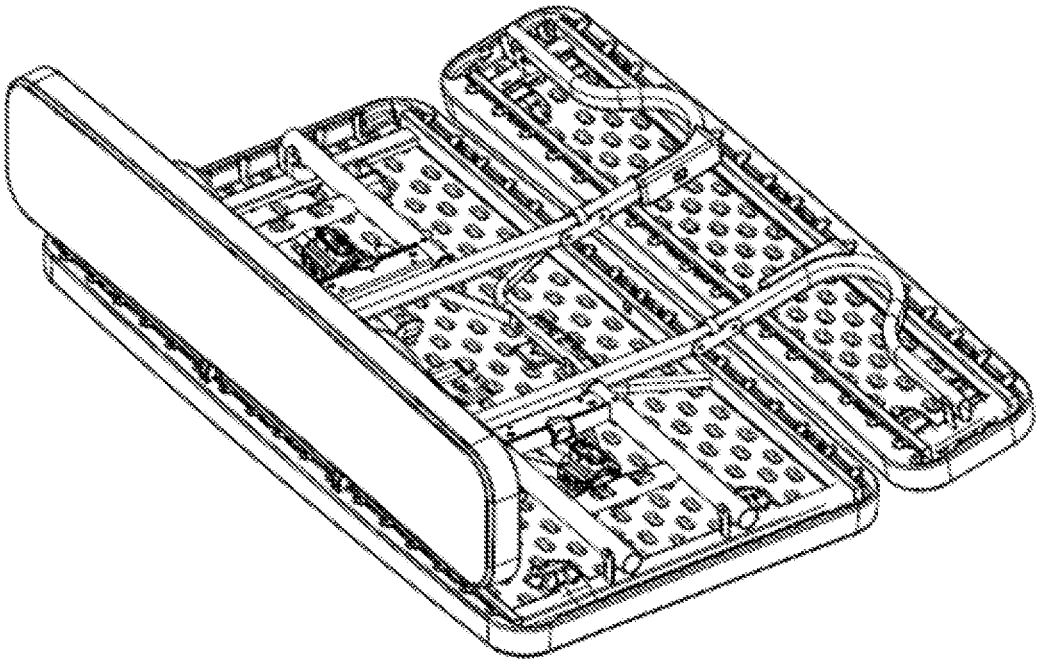
FIG. 4E is a bottom perspective view illustrating the exemplary picnic table of FIG. 4A in a third intermediate state in accordance with exemplary embodiments of the present disclosure.
Figure 4F:
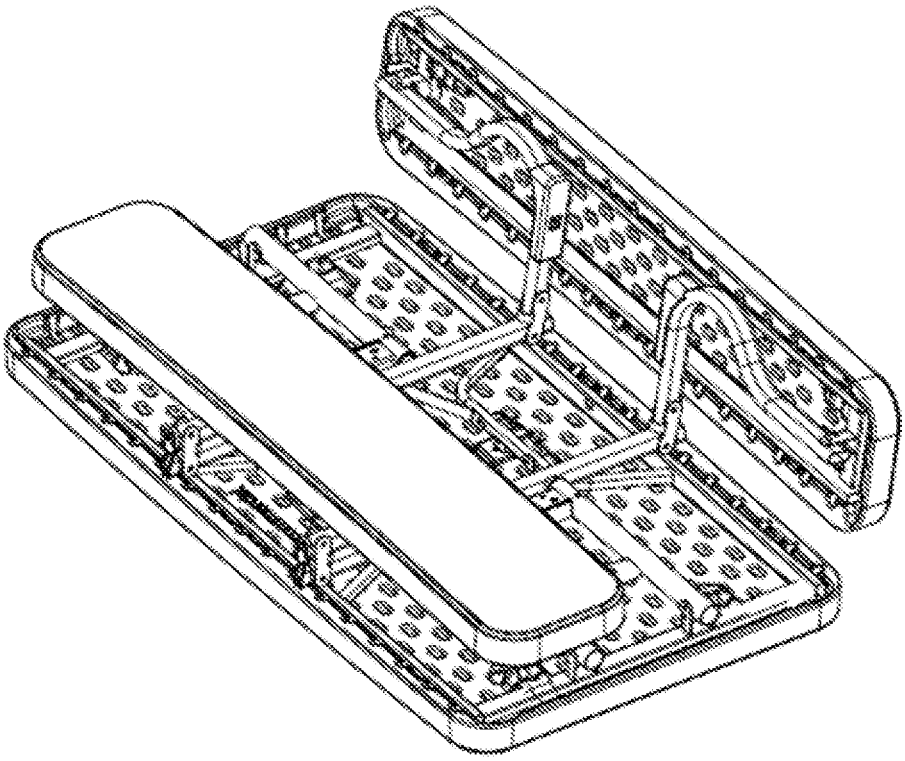
FIG. 4F is a bottom perspective view illustrating the exemplary picnic table of FIG. 4A in a fourth intermediate state in accordance with exemplary embodiments of the present disclosure.

Referring now to FIGS. 4A-4B, there is depicted exemplary picnic table 200 in accordance with some embodiments of the present disclosure. Picnic table 200 is similar to picnic table 100. For instance, picnic table 200 includes a table panel such as table panel 110, one or more bench panels such as bench panel 120, and one or more supporting assemblies such as supporting assembly 230 to support the table and bench panels. Supporting assembly 230 includes a table support such as table support 240 to support the table panel and one or more bench supports such as bench support 250 to support the one or more bench panels. Like table support 140, in some exemplary embodiments, table support 240 is configured to be an adjustable assembly or to include an adjustable assembly for adjusting the length of the table support and thus the height of the table panel.

In some exemplary embodiments, table support 240 is rotatable with respect to table panel 110 along a first direction (e.g., the x-direction in FIG. 4A or the lateral direction of the table panel). Similarly, bench support 250 is rotatable with respect to bench panel 120 along the first direction. Like supporting assembly 130, in some exemplary embodiments, the table and bench panels of supporting assembly 230 are connected with each other and rotatable with respect to each other along a second direction (e.g., the y-direction in FIG. 4A) that is different than the first direction. In an exemplary embodiment, the second direction is substantially perpendicular to the first direction. In some exemplary embodiments, supporting assembly 230 includes one or more connectors such as connector 260, each for pivotally connecting one bench support 250 with table support 240 such that the bench support is rotatable with respect to the table support in the second direction. As such, like picnic table 100, picnic table 200 is foldable multiple times. FIGS. 4A-4H depict an exemplary process for folding and unfolding picnic table 200. The process is substantially the same as folding and unfolding of picnic table 100, and thus the detailed description of which is omitted to avoid redundancy.

Similar to table support 140, in some exemplary embodiments, table support 240 includes a first supporting bar such as first supporting bar 241 and bench support 250 includes a second supporting bar such as second supporting bar 251. First supporting bar 241 and second supporting bar 251 are aligned with each other in the first direction when unfolded (e.g., when bench panel 120 is unfolded from table panel 110, or when the picnic table is unfolded). Connector 260 pivotally connects the second supporting support of the bench support with the first supporting bar of the table support such that the second supporting bar is rotatable with respect to the first supporting bar of the table support in the second direction.

Figure 4G:
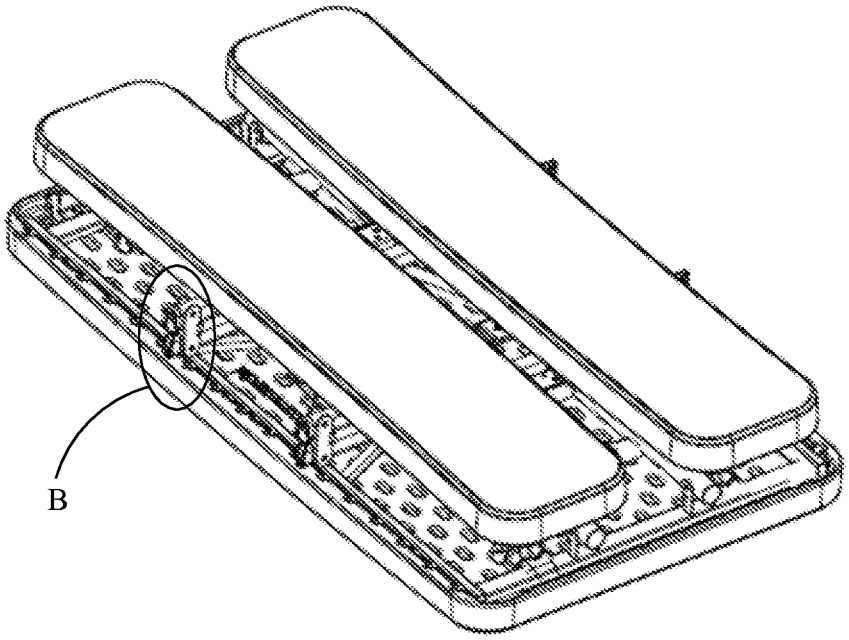
FIG. 4G is a bottom perspective view illustrating the exemplary picnic table of FIG. 4A in a folded state in accordance with exemplary embodiments of the present disclosure.
Figure 4H:
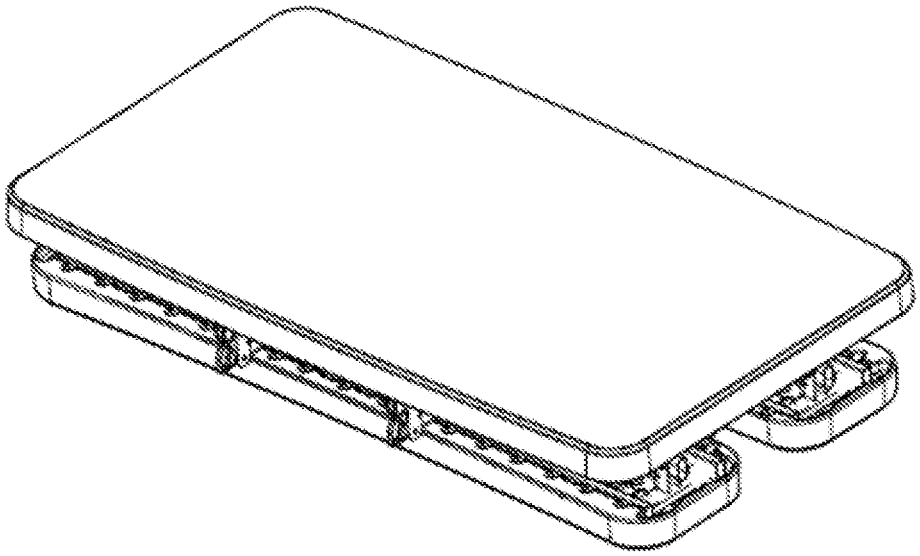
FIG. 4H is a top perspective view illustrating the exemplary picnic table of FIG. 4A in a folded state in accordance with exemplary embodiments of the present disclosure.
Figure 5B:
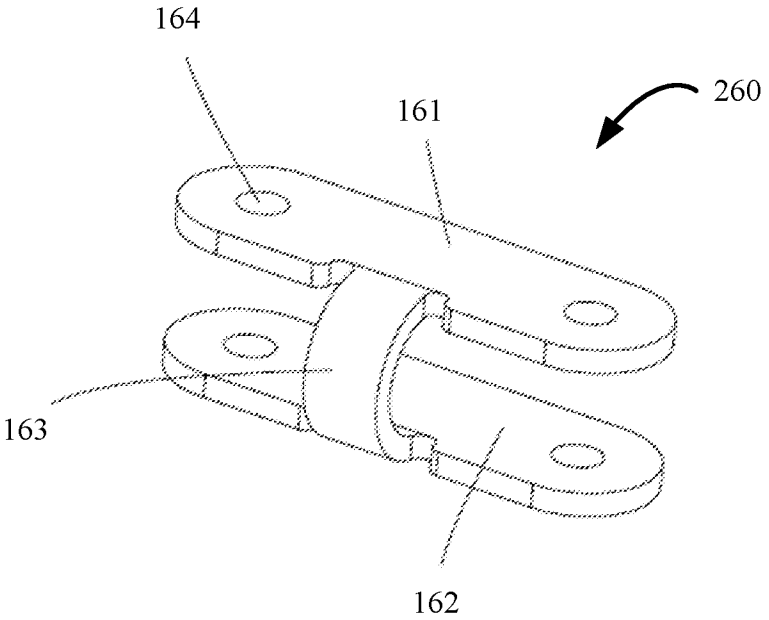
FIG. 5B is a perspective view illustrating an exemplary connector in accordance with exemplary embodiments of the present disclosure.
Figure 5A:
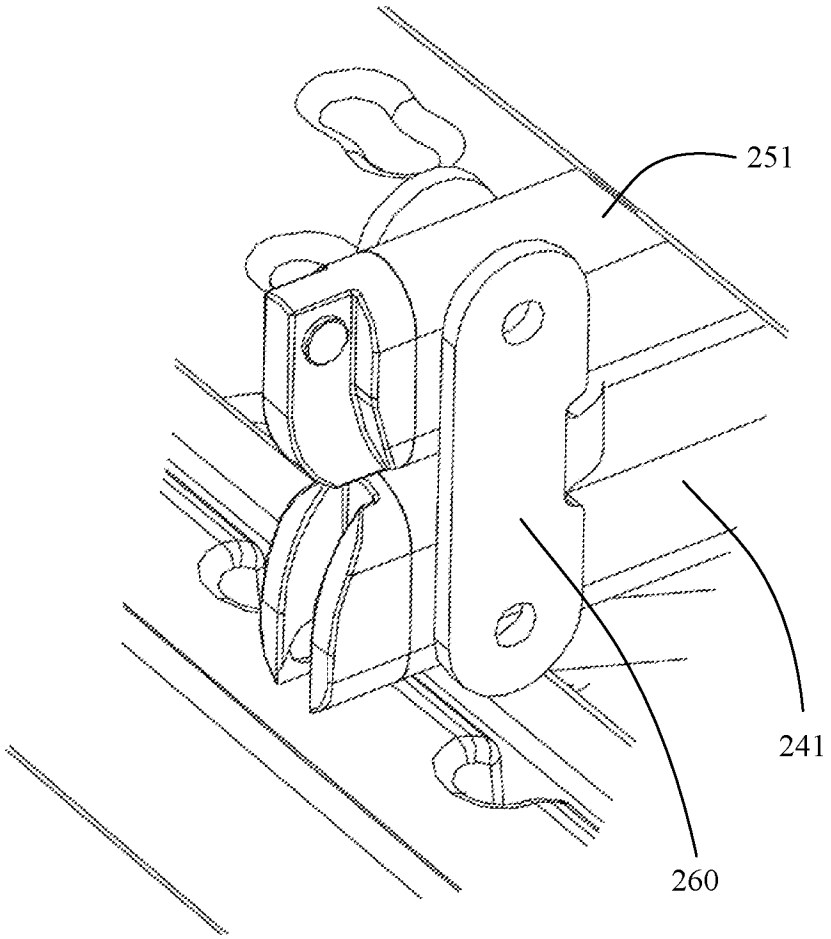
FIG. 5A is an enlarged view taken along oval B of FIG. 4G.
Figure 5D:
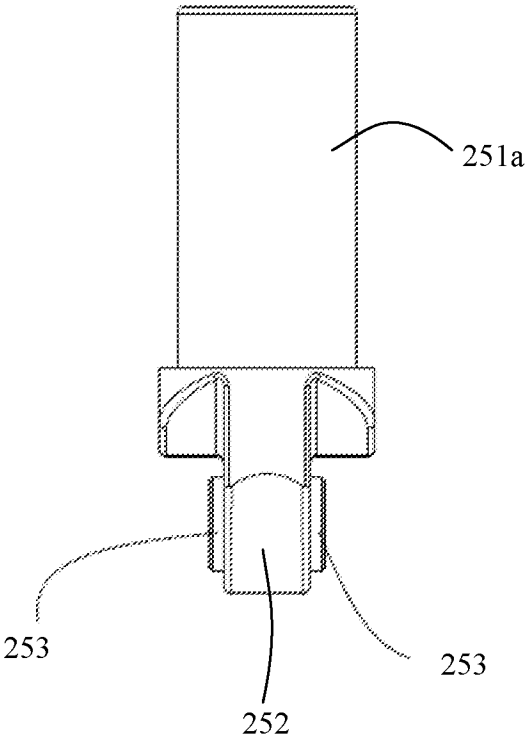
FIG. 5D is a side view illustrating the exemplary component of FIG. 5C.
Figure 5C:
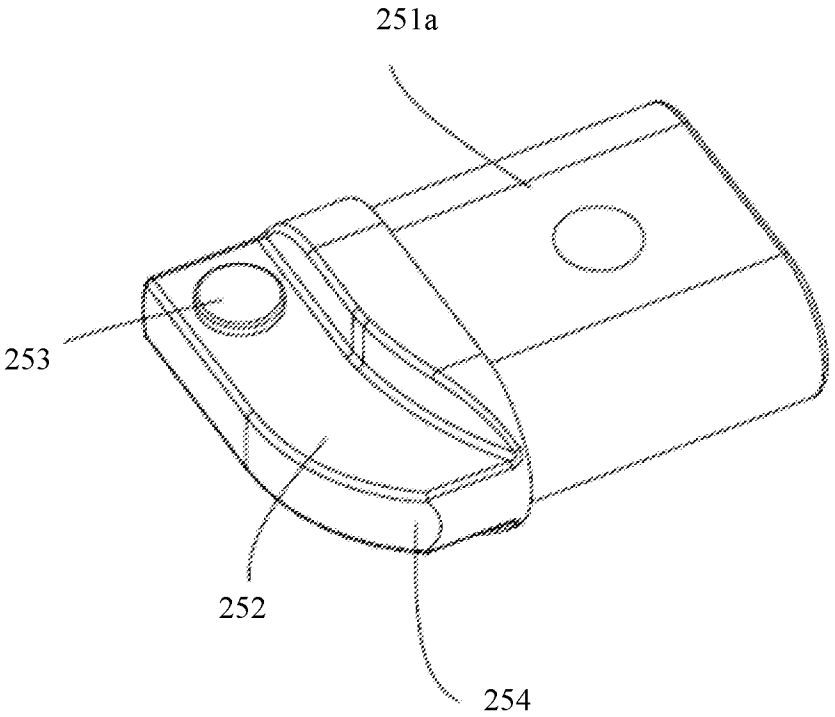
FIG. 5C is a perspective view illustrating an exemplary component of an exemplary supporting assembly in accordance with exemplary embodiments of the present disclosure.
Figure 5E:
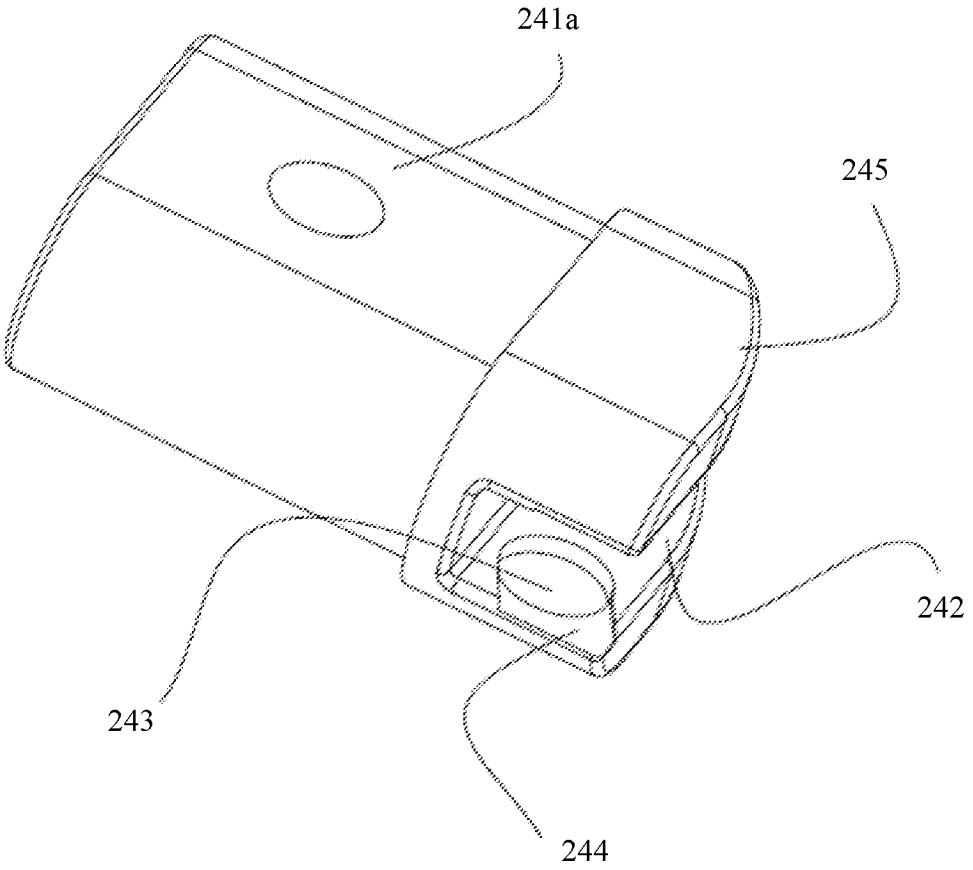
FIG. 5E is a perspective view illustrating another exemplary component of an exemplary supporting assembly in accordance with exemplary embodiments of the present disclosure.
Figure 5G:
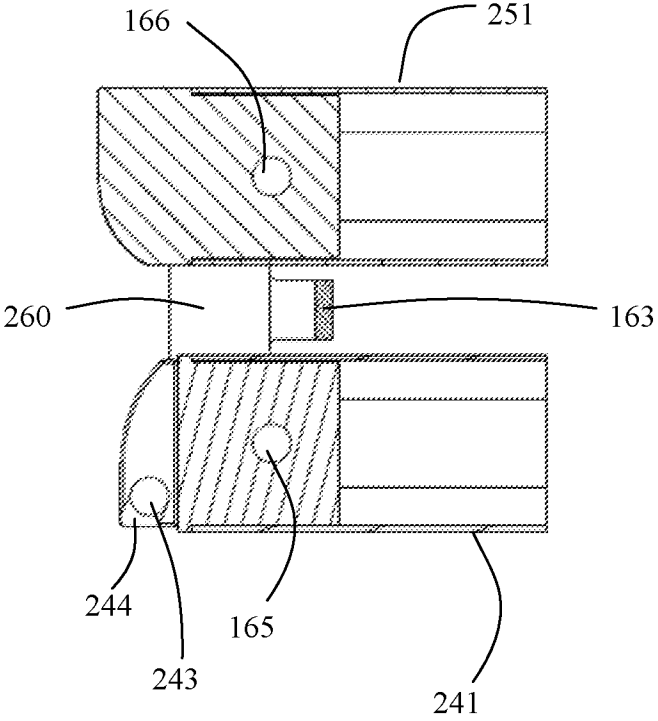
FIG. 5G is a schematic view illustrating the connection of FIG. 3A in a folded state in accordance with exemplary embodiments of the present disclosure.
Figure 5F:
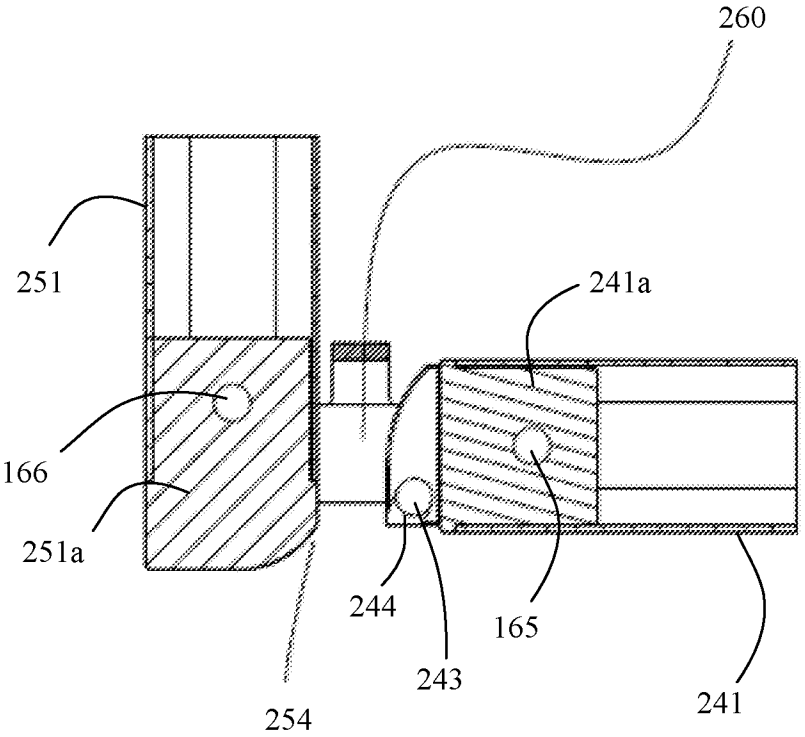
FIG. 5F is a schematic view illustrating a connection in an exemplary supporting assembly in an intermediate state in accordance with exemplary embodiments of the present disclosure.

Referring to FIGS. 5A-5G, there are depicted connector 260 and the use of the connector to connect the second supporting support of the bench support with the first supporting bar of the table support in accordance with some exemplary embodiments of the present disclosure. Of these figures, FIG. 5A, an enlarged view taken along oval B of FIG. 4G, illustrates perspectively the connection at a folded state (e.g., the bench support is folded onto the table support), FIG. 5F illustrates schematically the connection at an intermediate state, and FIG. 5G illustrates schematically the connection at the folded state.

Similar to connector 160, in some exemplary embodiments, connector 260 includes at least one connecting piece, a first fastener pivotally connecting an end portion of the first supporting bar with the at least one connecting piece, and a second fastener pivotally connecting an end portion of the second supporting bar with the at least one connecting piece. For instance, in the illustrated embodiment, connector 260 including first connecting piece 161, second connecting piece 162, first fastener 165 and second fastener 166. In an exemplary embodiment, the first and second connecting pieces are disposed opposing to each other to form a channel to receive the end portion of the first supporting bar and the end portion of the second supporting bar. In some exemplary embodiments, connector 260 further includes at least one third connecting piece fixedly connected or integrally formed with the first and second connecting pieces. For instance, FIG. 5B illustrates one third connecting piece 163 having an end fixedly connected or integrally formed with first connecting piece 161 and another end fixedly connected or integrally formed with second connecting piece 162.

First fastener 165 pivotally connects end portion 241*a* of first supporting bar 241 of the table support with the first and second connecting pieces. Second fastener 166 pivotally connects end portion 251*a* of second supporting bar 251 of the bench support with the first and second connecting pieces. First supporting bar 241 of the table support or second supporting bar 251 of the bench support can be a single unitary piece or made of multiple bar segments. In an exemplary embodiment, the end portion of first supporting bar 241 of the table support or second supporting bar 251 of the bench support includes a coupler connected or formed with the first or second supporting bar. The end portion 241*a* of first supporting bar 241 and the end portion 251*a* of second supporting bar 251 can be disposed generally symmetric or asymmetric with respect to each other.

In some exemplary embodiments, to help stabilize the table and/or bench supports when unfolded, the end portion of one of the first and second supporting bars includes a protrusion, and the end portion of the other of the first and second supporting bars includes a groove to receive the protrusion when unfolded. For instance, in the illustrated embodiment, end portion 251*a* of second supporting bar 251 includes a protrusion such as protrusion 252 and end portion 241*a* of first supporting bar 241 includes a groove such as groove 242. When unfolded (e.g., when the first and second supporting bars are aligned with each other), protrusion 252 is inserted into groove 242, thereby help stabilize the table and/or bench supports when unfolded. It should be noted that this is a non-limiting example. A protrusion can be formed at end portion 241*a* of first supporting bar 241 and a groove can be formed at end portion 251*a* of second supporting bar 251.

In some exemplary embodiments, to further help stabilize the table and/or bench supports when unfolded, the protrusion is formed with one or more knobs on one or more sides of the protrusion, and the groove is formed with one or more recesses to receive the one or more knobs. For instance, in an exemplary embodiment, protrusion 252 includes a knob such as knob 253 at a side of the protrusion and groove 242 includes a recess such as recess 243 on a side of the groove to receive the knob when unfolded. In another exemplary embodiment, protrusion 252 includes a knob such as knob 253 at each side of the protrusion and groove 242 includes a recess such as recess 243 at each side of the groove to receive the knobs when unfolded. The knob and recess can have any suitable configurations including but not limited to circular, oval, and polygonal shapes. In some exemplary embodiments, the groove includes a curved or sloped surface such as surface 244 adjacent to the recess for guiding the knob into the recess.

In some exemplary embodiments, to assist folding and unfolding of first supporting bar 241 of the table support (and thus the table panel) or second supporting bar 251 of the bench support (and thus the bench panel), the end portion of the first or second supporting bar includes an end surface that is at least partially curved. For instance, in an exemplary embodiment, end portion 241*a* of the first supporting bar includes a first end surface such as first end surface 245 formed at groove 242, and end portion 251*a* of the second supporting bar includes a second end surface such as second end surface 254 formed at protrusion 252. At least a portion of first end surface 245 and second end surface 254 is curved. The curved portions of the first and second end surfaces make it easy to rotate the first and second supporting bars with respect to each other.

Figure 6A:
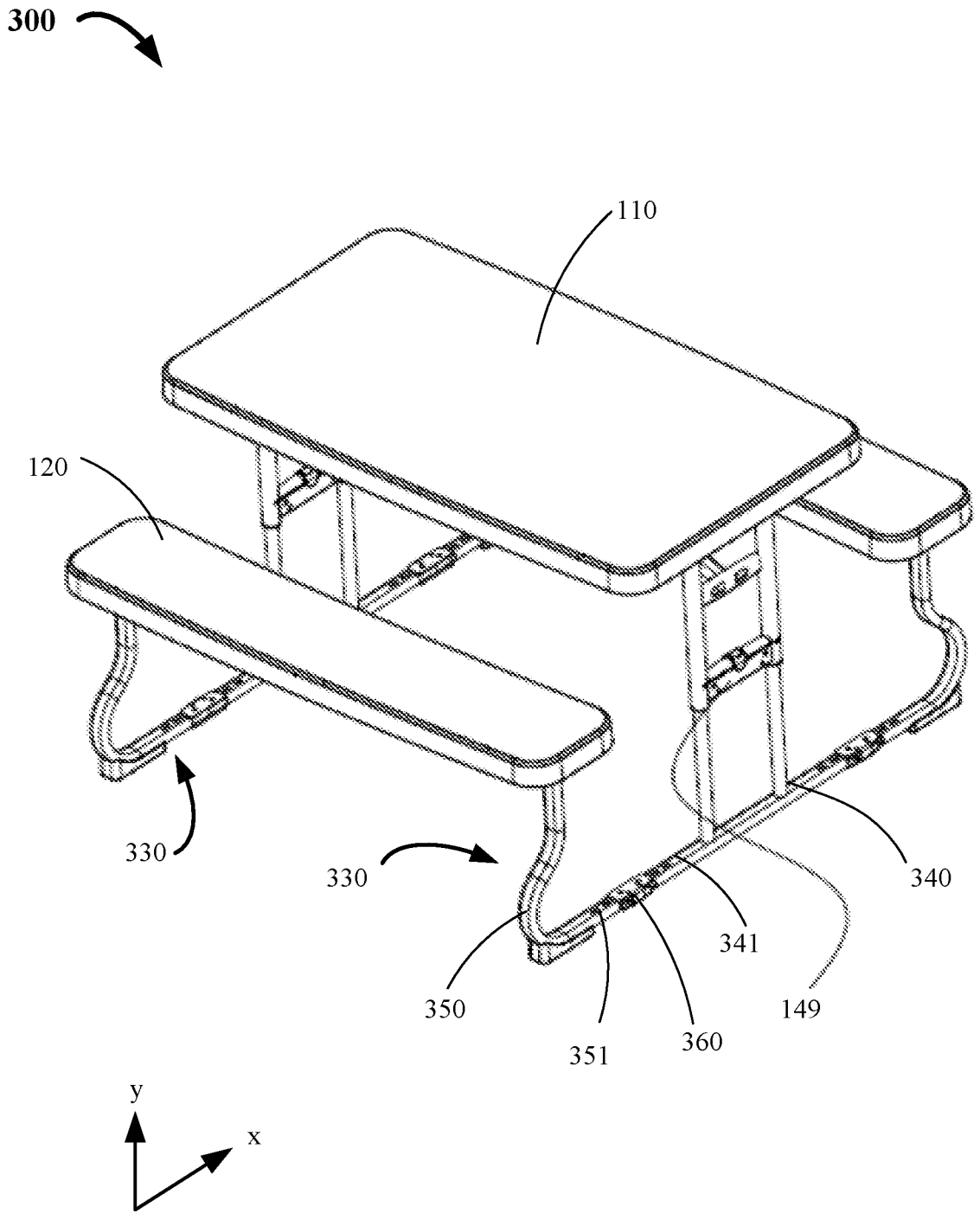
FIG. 6A is a top perspective view illustrating an exemplary picnic table in an unfolded state in accordance with exemplary embodiments of the present disclosure.
Figure 6B:
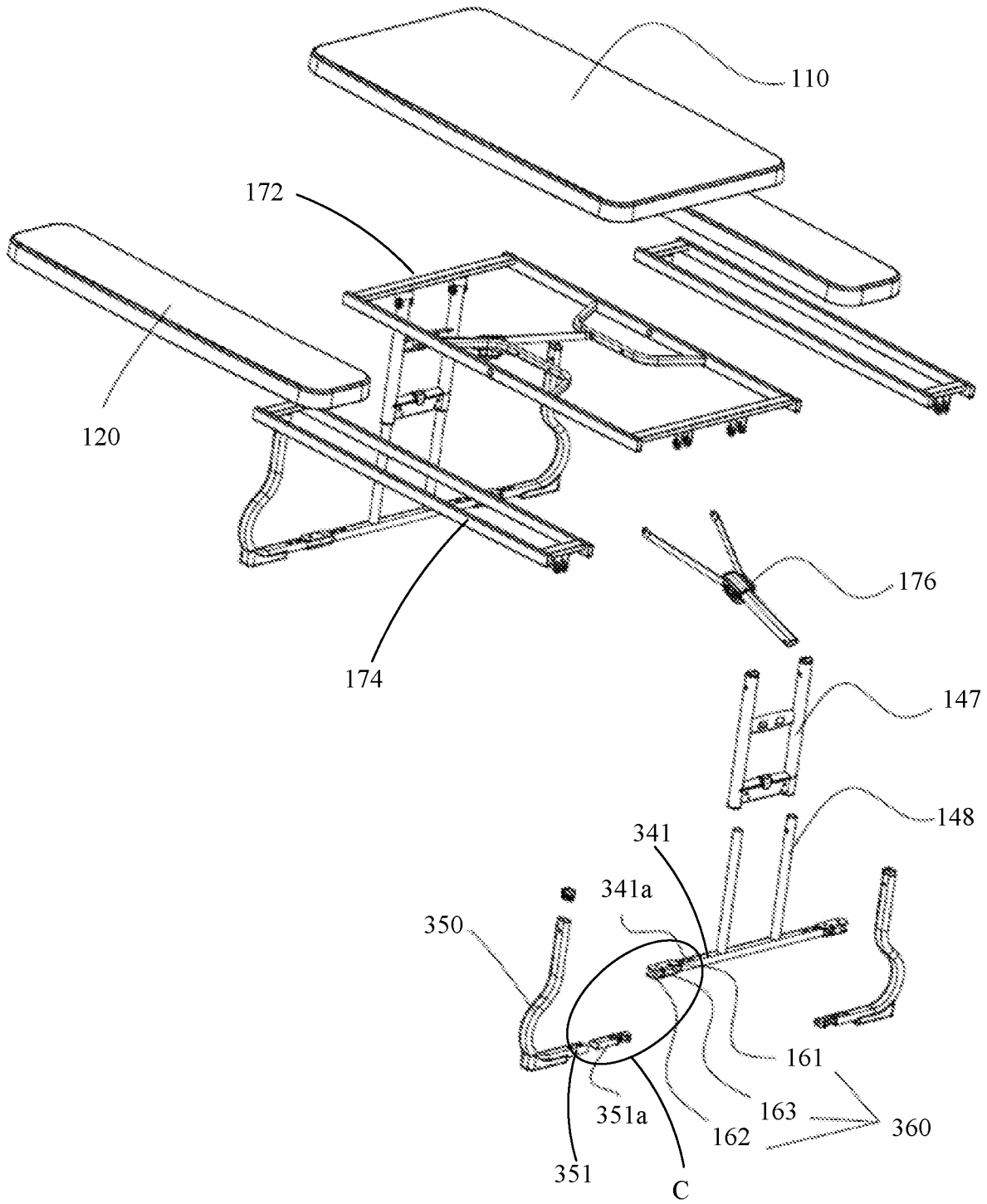
FIG. 6B is a partially disassembled perspective view illustrating the exemplary picnic table of FIG. 6A in accordance with exemplary embodiments of the present disclosure.
Figure 6C:
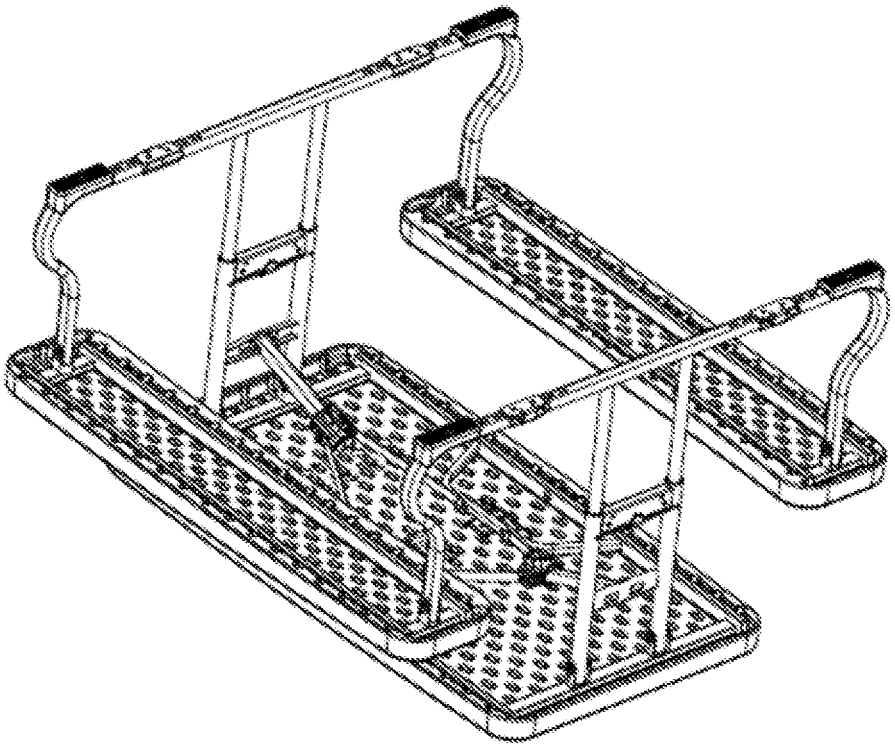
FIG. 6C is a bottom perspective view illustrating the exemplary picnic table of FIG. 6A.
Figure 6D:
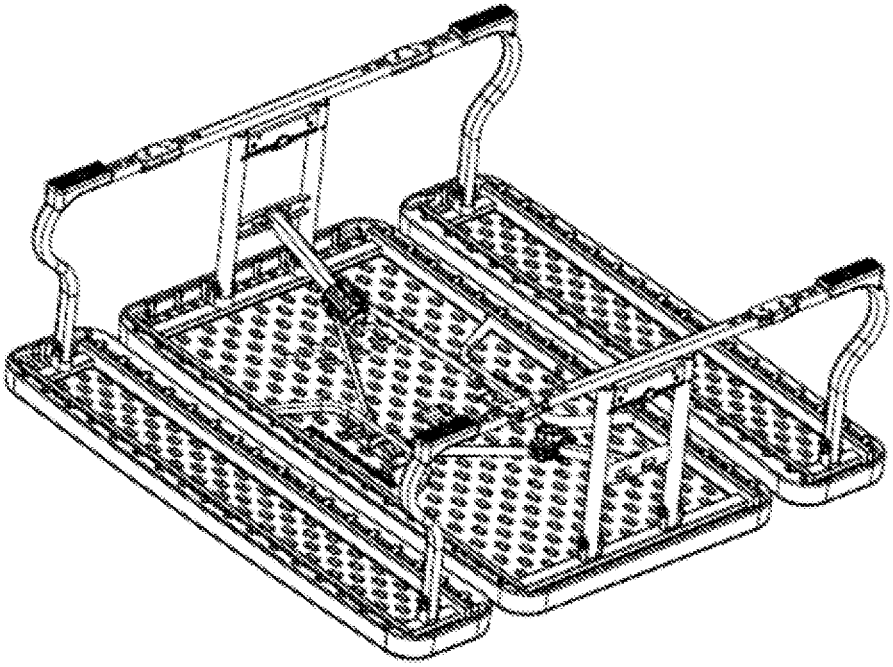
FIG. 6D is a bottom perspective view illustrating the exemplary picnic table of FIG. 6A with the table panel at a different height in accordance with exemplary embodiments of the present disclosure.
Figure 6E:
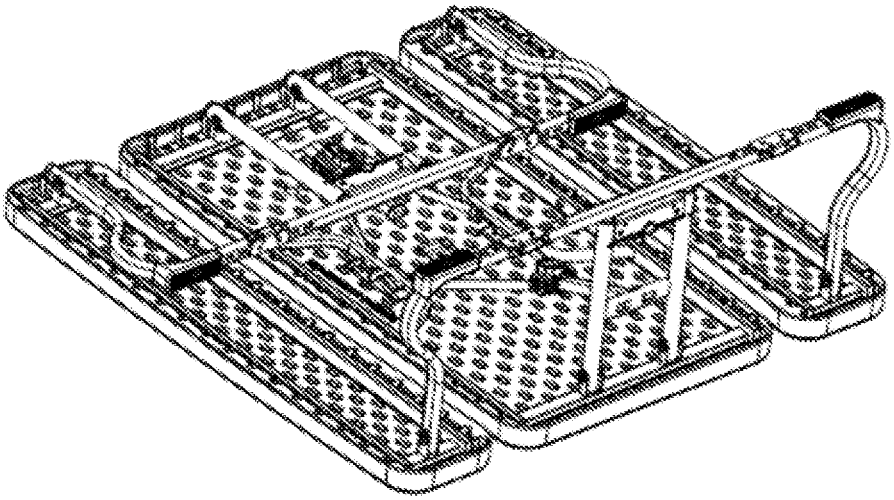
FIG. 6E is a bottom perspective view illustrating the exemplary picnic table of FIG. 6A in a first intermediate state in accordance with exemplary embodiments of the present disclosure.
Figure 6F:
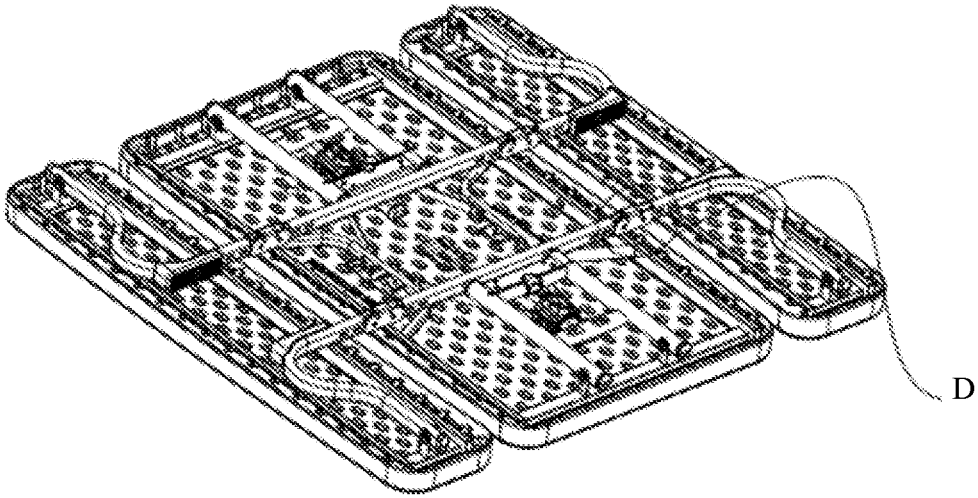
FIG. 6F is a bottom perspective view illustrating the exemplary picnic table of FIG. 6A in a second intermediate state in accordance with exemplary embodiments of the present disclosure.
Figure 6G:
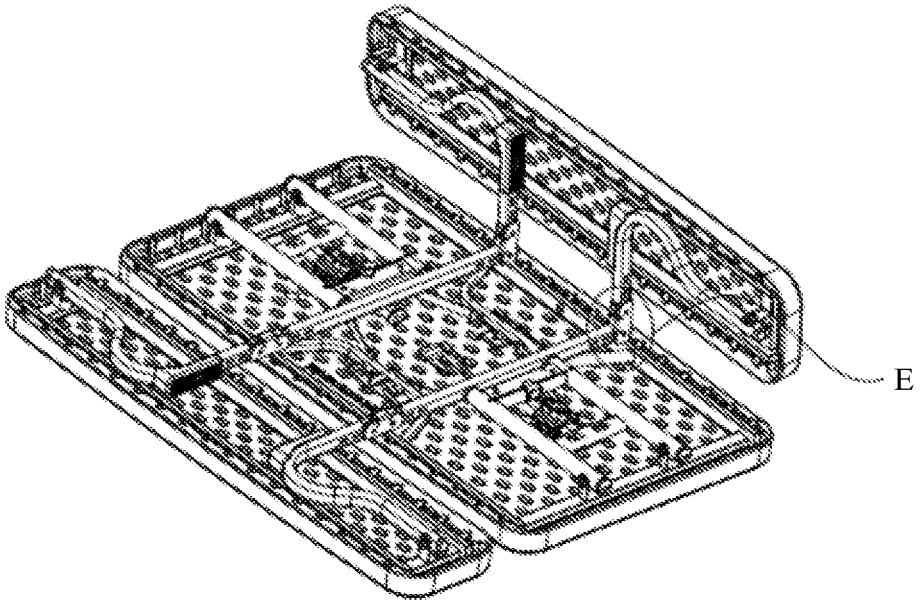
FIG. 6G is a bottom perspective view illustrating the exemplary picnic table of FIG. 6A in a third intermediate state in accordance with exemplary embodiments of the present disclosure.
Figure 6H:
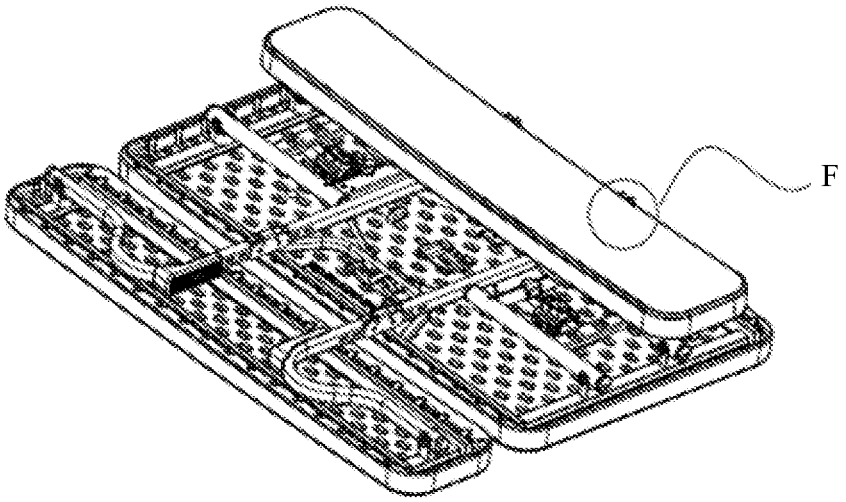
FIG. 6H is a bottom perspective view illustrating the exemplary picnic table of FIG. 6A in a fourth intermediate state in accordance with exemplary embodiments of the present disclosure.
Figure 6I:
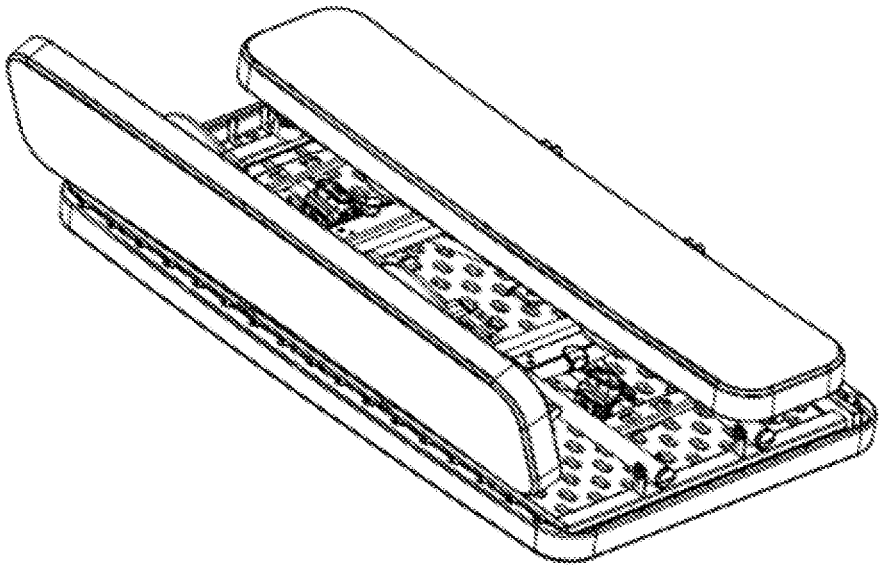
FIG. 6I is a bottom perspective view illustrating the exemplary picnic table of FIG. 6A in a fifth intermediate state in accordance with exemplary embodiments of the present disclosure.
Figure 6J:
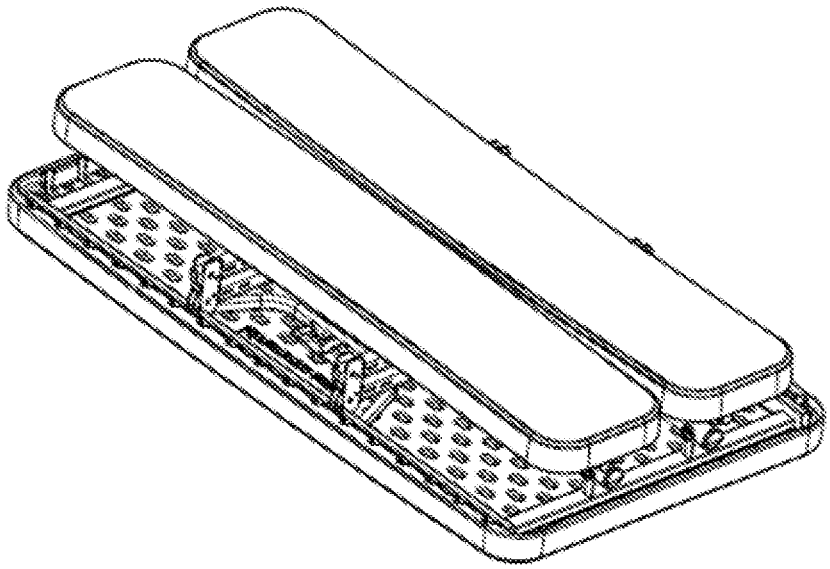
FIG. 6J is a bottom perspective view illustrating the exemplary picnic table of FIG. 6A in a folded state in accordance with exemplary embodiments of the present disclosure.

Referring now to FIGS. 6A-6B, there is depicted exemplary picnic table 300 in accordance with some embodiments of the present disclosure. Picnic table 300 is similar to picnic table 100. For instance, picnic table 300 includes a table panel such as table panel 110, one or more bench panels such as bench panel 120, and one or more supporting assemblies such as supporting assembly 330 to support the table and bench panels. Supporting assembly 330 includes a table support such as table support 340 to support the table panel and one or more bench supports such as bench support 350 to support the one or more bench panels. Like table support 140, in some exemplary embodiments, table support 340 is configured to be an adjustable assembly or to include an adjustable assembly for adjusting the length of the table support and thus the height of the table panel.

In some exemplary embodiments, table support 340 is rotatable with respect to table panel 110 along a first direction (e.g., the x-direction in FIG. 6A or the lateral direction of the table panel). Similarly, bench support 350 is rotatable with respect to bench panel 120 along the first direction. Like supporting assembly 130, in some exemplary embodiments, the table and bench panels of supporting assembly 330 are connected with each other and rotatable with respect to each other along a second direction (e.g., the y-direction in FIG. 6A) that is different than the first direction. In an exemplary embodiment, the second direction is substantially perpendicular to the first direction. In some exemplary embodiments, supporting assembly 330 includes one or more connectors such as connector 360, each for pivotally connecting one bench support 350 with table support 340 such that the bench support is rotatable with respect to the table support in the second direction. As such, like picnic table 100, picnic table 300 is foldable multiple times. FIGS. 6C-6J depict an exemplary process for folding and unfolding picnic table 300. The process is substantially the same as folding and unfolding of picnic table 100, and thus the detailed description of which is omitted to avoid redundancy.

Similar to table support 140, in some exemplary embodiments, table support 340 includes a first supporting bar such as first supporting bar 341 and bench support 350 includes a second supporting bar such as second supporting bar 351. First supporting bar 341 and second supporting bar 351 are aligned with each other in the first direction when unfolded (e.g., when bench panel 120 is unfolded from table panel 110, or when the picnic table is unfolded). Connector 360 pivotally connects the second supporting support of the bench support with the first supporting bar of the table support such that the second supporting bar is rotatable with respect to the first supporting bar of the table support in the second direction.

Figure 7:
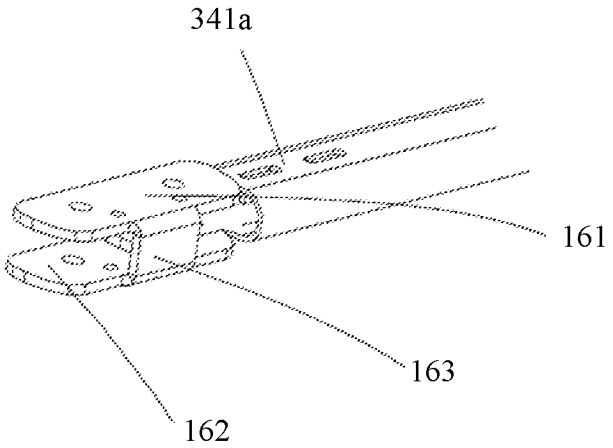
FIG. 7 is an enlarged view taken along oval C of FIG. 6B.
Figure 7:
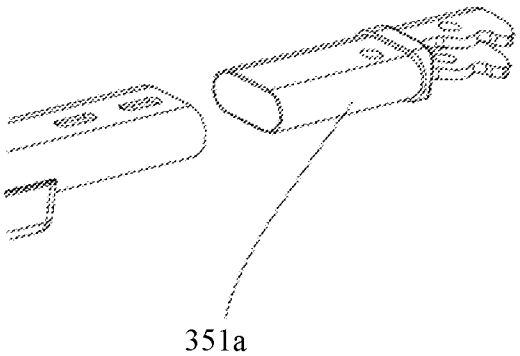
Figure 8A:
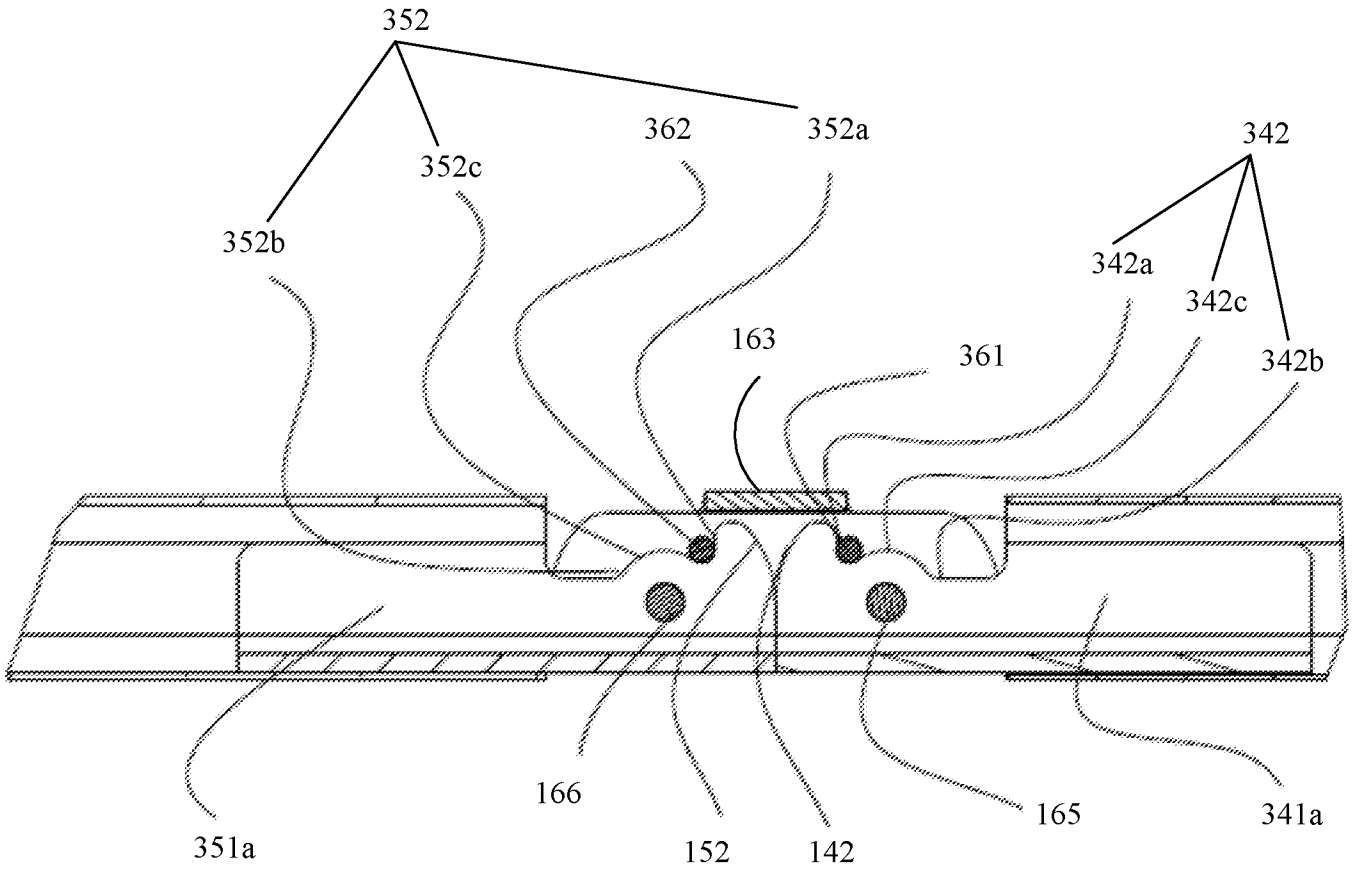
FIG. 8A is a schematic view illustrating a connection in an exemplary supporting assembly at oval D of FIG. 6F in accordance with exemplary embodiments of the present disclosure.
Figure 8B:
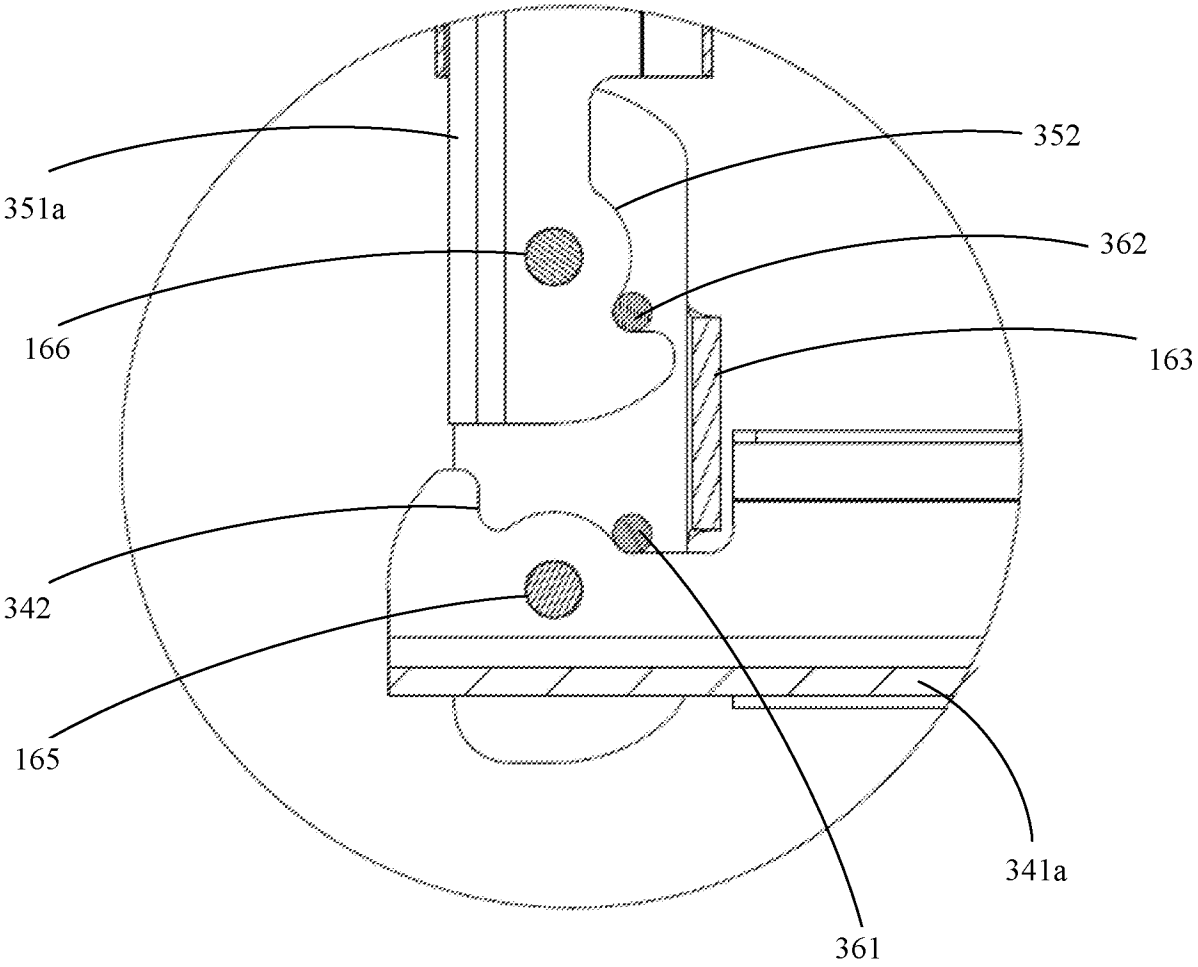
FIG. 8B is a schematic view illustrating a connection in an exemplary supporting assembly at oval E of FIG. 6G in accordance with exemplary embodiments of the present disclosure.
Figure 8C:
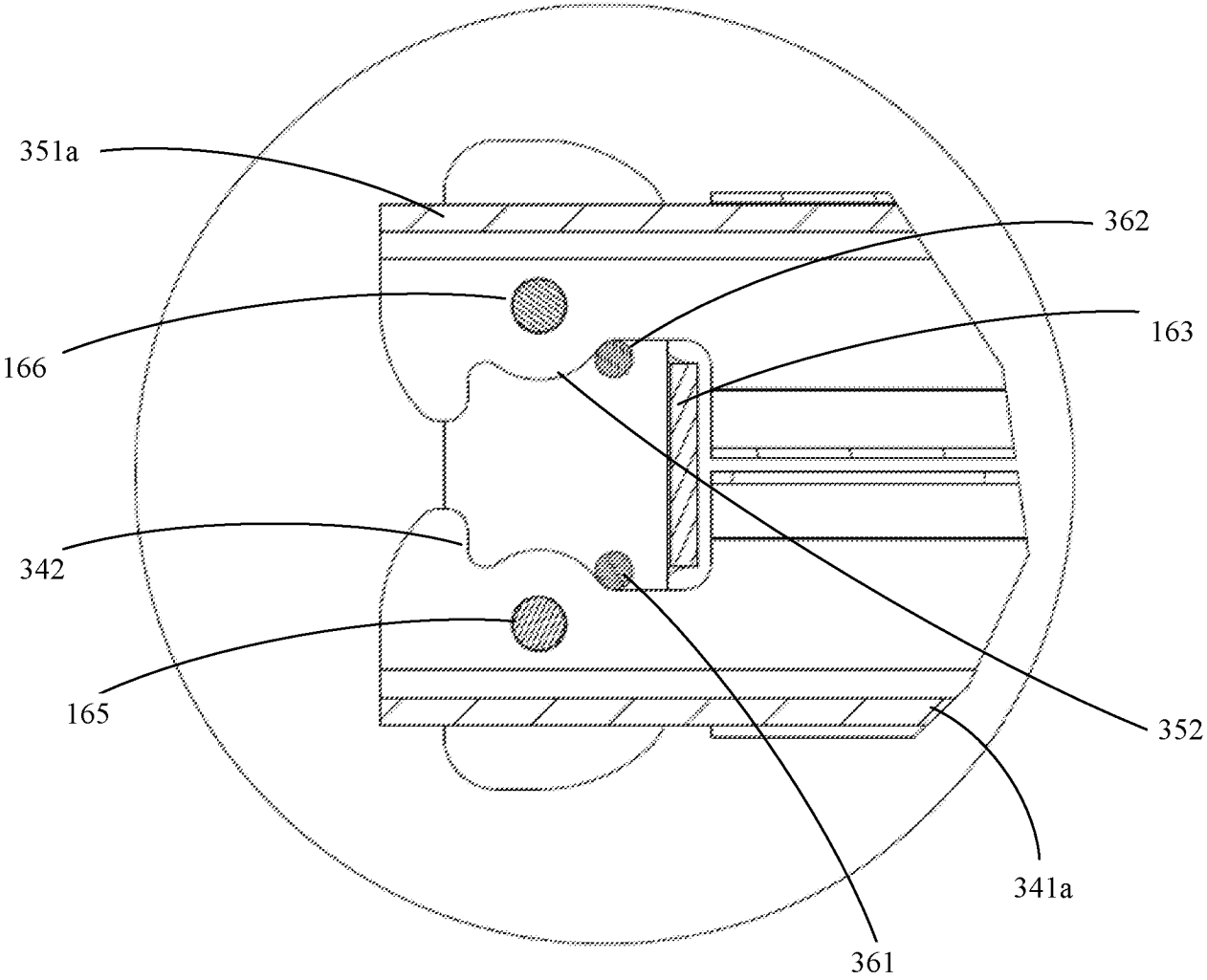
FIG. 8C is a schematic view illustrating a connection in an exemplary supporting assembly at oval F of FIG. 6H in accordance with exemplary embodiments of the present disclosure.

Referring to FIGS. 7 and 8A-8C, there are depicted connector 360 and the use of the connector to connect the second supporting support of the bench support with the first supporting bar of the table support in accordance with some exemplary embodiments of the present disclosure. Of these figures, FIG. 7, an enlarged view taken along oval C of FIG. 6B, illustrates perspectively the connection at an unfolded state (e.g., the first and second supporting bars are aligned with each other), FIG. 8A illustrates schematically the connection at the unfolded state, FIG. 8B illustrates schematically the connection at an intermediate state, and FIG. 8C illustrates schematically the connection at a folded state.

Similar to connector 160, in some exemplary embodiments, connector 360 includes at least one connecting piece, a first fastener pivotally connecting an end portion of the first supporting bar with the at least one connecting piece, and a second fastener pivotally connecting an end portion of the second supporting bar with the at least one connecting piece. For instance, in the illustrated embodiment, connector 360 including first connecting piece 161, second connecting piece 162, first fastener 165 and second fastener 166. In an exemplary embodiment, the first and second connecting pieces are disposed opposing to each other to form a channel to receive the end portion of the first supporting bar and the end portion of the second supporting bar. In some exemplary embodiments, connector 360 further includes at least one third connecting piece fixedly connected or integrally formed with the first and second connecting pieces. For instance, FIG. 7 illustrates one third connecting piece 163 having an end fixedly connected or integrally formed with first connecting piece 161 and another end fixedly connected or integrally formed with second connecting piece 162.

First fastener 165 pivotally connects end portion 341*a* of first supporting bar 341 of the table support with the first and second connecting pieces. Second fastener 166 pivotally connects end portion 351*a* of second supporting bar 351 of the bench support with the first and second connecting pieces. First supporting bar 341 of the table support or second supporting bar 351 of the bench support can be a single unitary piece or made of multiple bar segments. In an exemplary embodiment, the end portion of first supporting bar 341 of the table support or second supporting bar 351 of the bench support includes a coupler connected or formed with the first or second supporting bar. The end portion 341*a* of first supporting bar 341 and the end portion 351*a* of second supporting bar 351 can be disposed generally symmetric or asymmetric with respect to each other.

In some exemplary embodiments, to assist folding and unfolding of first supporting bar 341 of the table support (and thus the table panel) or second supporting bar 351 of the bench support (and thus the bench panel), the end portion of the first or second supporting bar includes a curved side surface and the connector includes a pin operably coupled with the curved side surface to guide the rotation of the first or second supporting bar. For instance, in an exemplary embodiment, end portion 341*a* of the first supporting bar includes a first curved side surface such as first curved side surface 342, and end portion 351*a* of the second supporting bar includes a second curved side surface such as second curved side surface 352. Connector 360 includes a first pin such as first pin 361 and a second pin such as second pin 362. First pin 361 and second pin 362 are disposed at (e.g., fixed coupled or integrally formed with) the first and/or second connecting pieces of connector 360. First pin 361 is operably coupled with first curved side surface 342 to help guide rotation of the first supporting bar with respect to the first and/or second connecting pieces of connector 360. Second pin 362 is operably coupled with second curved side surface 352 to help guide rotation of the second supporting bar with respect to the at least one connecting piece.

In some exemplary embodiments, to help stabilize the table and/or bench supports, the first curved side surface of the first supporting bar or the second curved side surface of the second supporting bar includes one or more indentations. For instance, in some exemplary embodiments, first curved side surface 342 includes a first indentation such as first indentation 342*a* and a second indentation such as second indentation 342*b*. First indentation 342*a* is configured to accommodate crosswise at least a portion of first pin 361 when the picnic table is unfolded and second indentation 342*b* is configured to accommodate crosswise at least a portion of first pin 361 when the picnic table is folded. Similarly, in some exemplary embodiments, second curved side surface 352 includes a first indentation such as first indentation 352*a* and a second indentation such as second indentation 352*b*. First indentation 352*a* is configured to accommodate crosswise at least a portion of second pin 362 when the picnic table is unfolded and second indentation 352*b* is configured to accommodate crosswise at least a portion of second pin 362 when the picnic table is folded.

In some exemplary embodiments, a convex segment such as convex segment 342*c* is formed between first indentation 342*a* and second indentation 342*b* to further assist rotation of first supporting bar 341 of the table support. In an exemplary embodiment, convex segment 342*c* has a circular profile. Similar, in some exemplary embodiments, a convex segment such as convex segment 352*c* is formed between first indentation 352*a* and second indentation 352*b* to further assist rotation of second supporting bar 351 of the bench support. In an exemplary embodiment, convex segment 352*c* has a circular profile.

While the first and second pins in the illustrated embodiments are substantially the same as and symmetric to each other, it should be noted that this is a non-limiting example. The first and second pins can be configured in any suitable shapes, sizes and disposed at any suitable positions. Similarly, while the first and second curved side surfaces in the illustrated embodiments are substantially the same as and symmetric to each other, it should be noted that this is a non-limiting example. The first and second curved side surfaces can be of any suitable configurations (e.g., shapes, sizes) and disposed at any suitable positions.

Figure 9A:
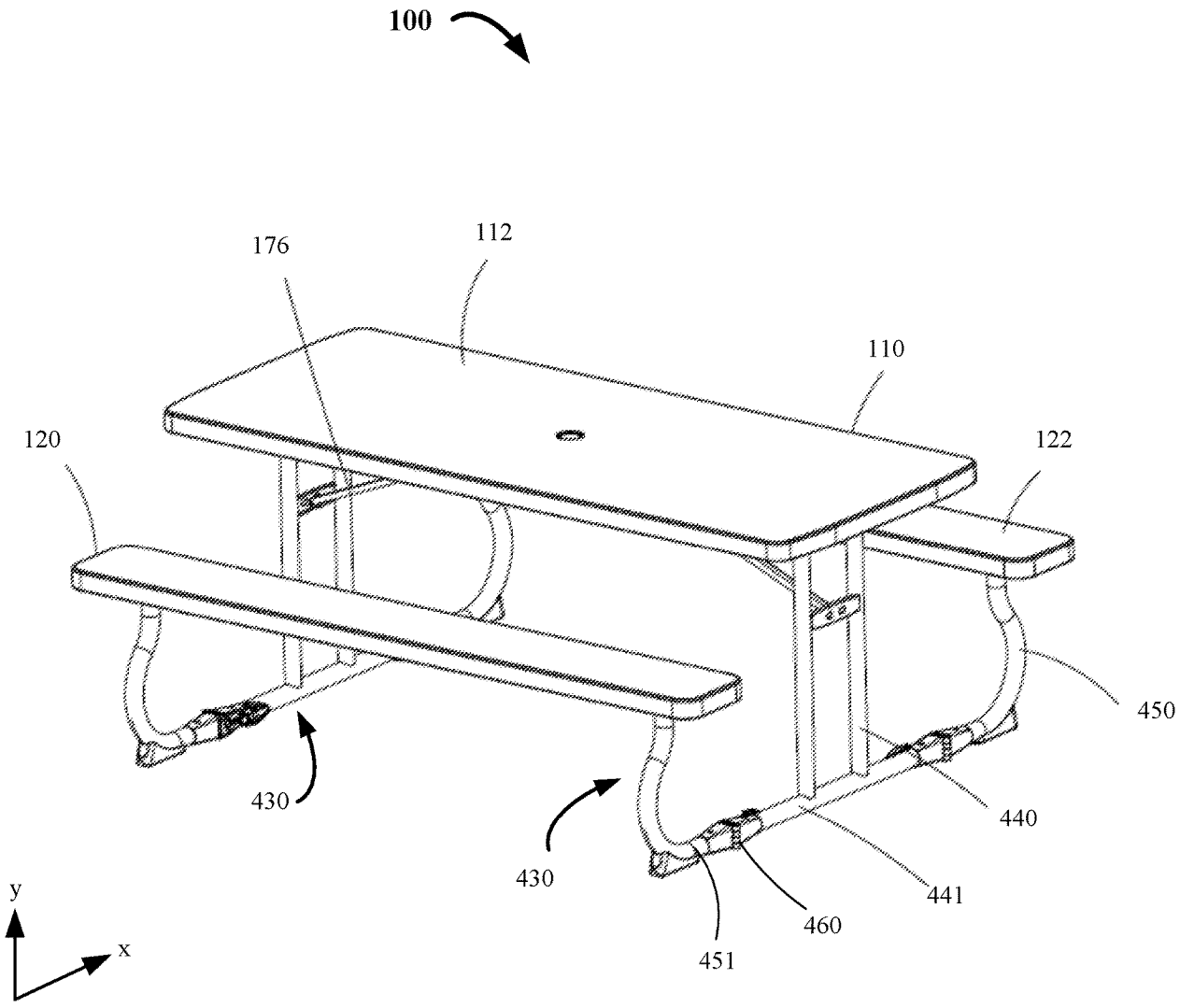
FIG. 9A is a top perspective view illustrating an exemplary picnic table in an unfolded state in accordance with exemplary embodiments of the present disclosure.
Figure 9B:
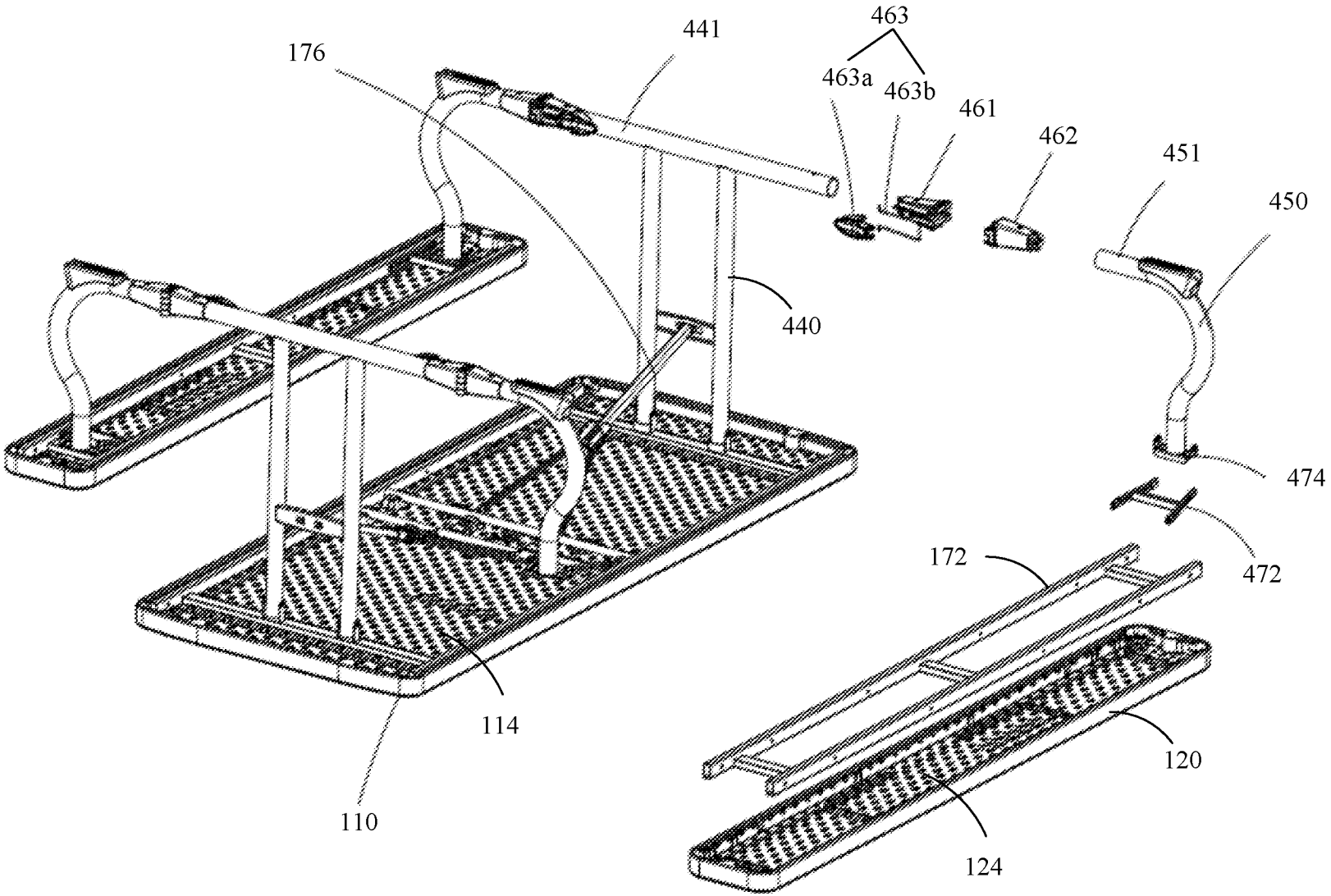
FIG. 9B is a partially disassembled perspective view illustrating the exemplary picnic table of FIG. 9A in accordance with exemplary embodiments of the present disclosure.

Referring now to FIGS. 9A-9B, there is depicted exemplary picnic table 400 in accordance with some embodiments of the present disclosure. Picnic table 400 is similar to picnic table 100. For instance, picnic table 400 includes a table panel such as table panel 110, one or more bench panels such as bench panel 120, and one or more supporting assemblies such as supporting assembly 430 to support the table and bench panels. Supporting assembly 430 includes a table support such as table support 440 to support the table panel and one or more bench supports such as bench support 450 to support the one or more bench panels.

In some exemplary embodiments, table support 440 is rotatable with respect to table panel 110 along a first direction (e.g., the x-direction in FIG. 9A or the lateral direction of the table panel). Similarly, bench support 450 is rotatable with respect to bench panel 120 along the first direction. For instance, referring to FIGS. 9B and 9D, in some exemplary embodiments, bench support 450 is connected to bench panel 120 through a bench link such as bench link 472. Bench link 472 has a first end portion pivotally connected with bench frame 174 and a second end portion pivotally connected with an upper end portion of the bench support. In an exemplary embodiment, bench link 472 is connected with the bench support through additional or optional connecting piece such as connecting piece 474 disposed at the upper end portion of the bench support. With bench link 472, the bench and table supports of the first or second supporting assembly can rotate together along the first direction even when they are at different lengths or heights.

Like supporting assembly 130, in some exemplary embodiments, the table and bench panels of supporting assembly 430 are connected with each other and rotatable with respect to each other along a second direction (e.g., the y-direction in FIG. 9A) that is different than the first direction. In an exemplary embodiment, the second direction is substantially perpendicular to the first direction. For instance, in some exemplary embodiments, supporting assembly 430 includes one or more connectors such as connector 460, each for pivotally connecting one bench support 450 with table support 440 such that the bench support is rotatable with respect to the table support in the second direction. As such, like picnic table 100, picnic table 400 is foldable multiple times.

Figure 9C:
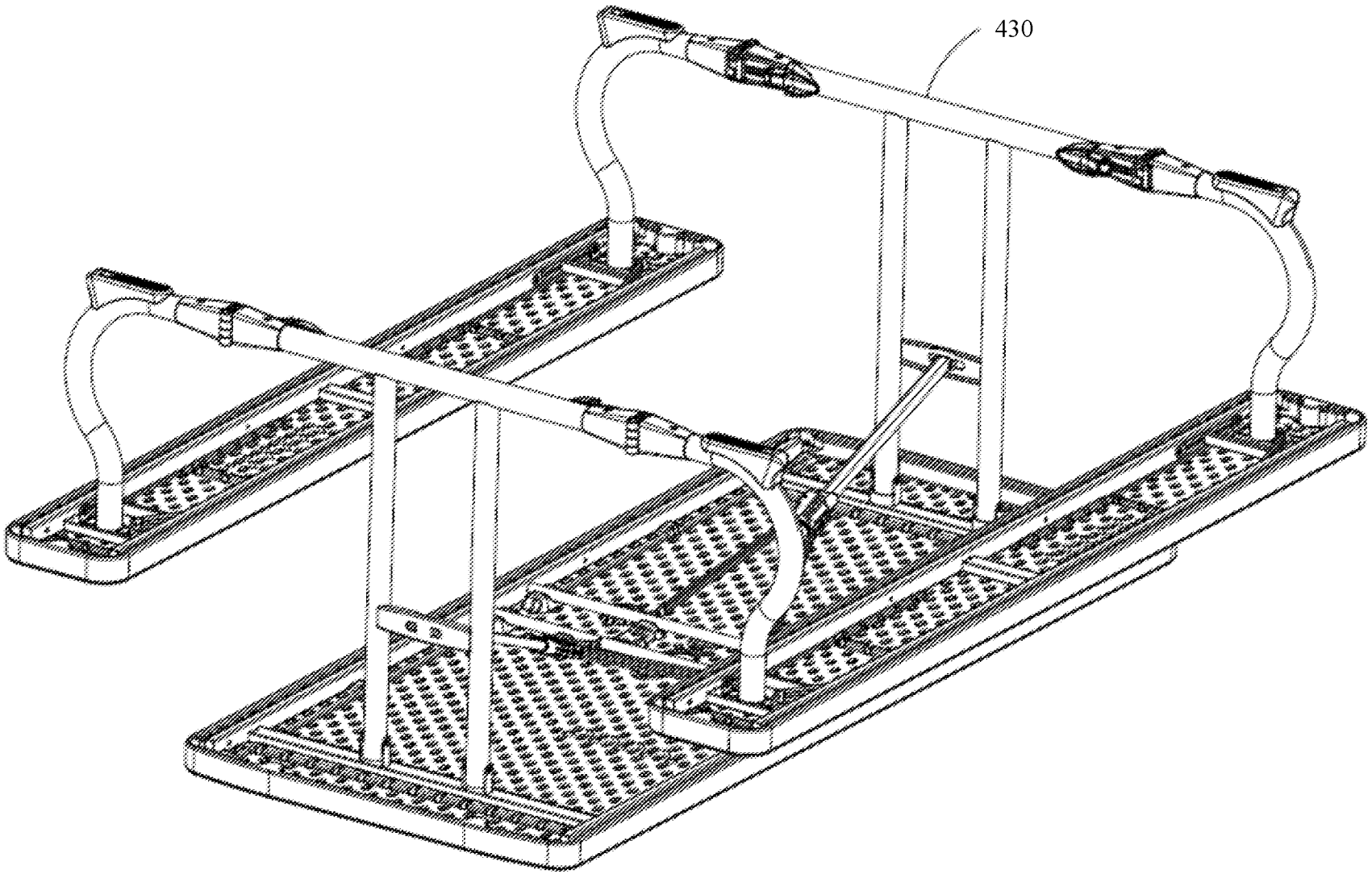
FIG. 9C is a bottom perspective view illustrating the exemplary picnic table of FIG. 9A.
Figure 9D:
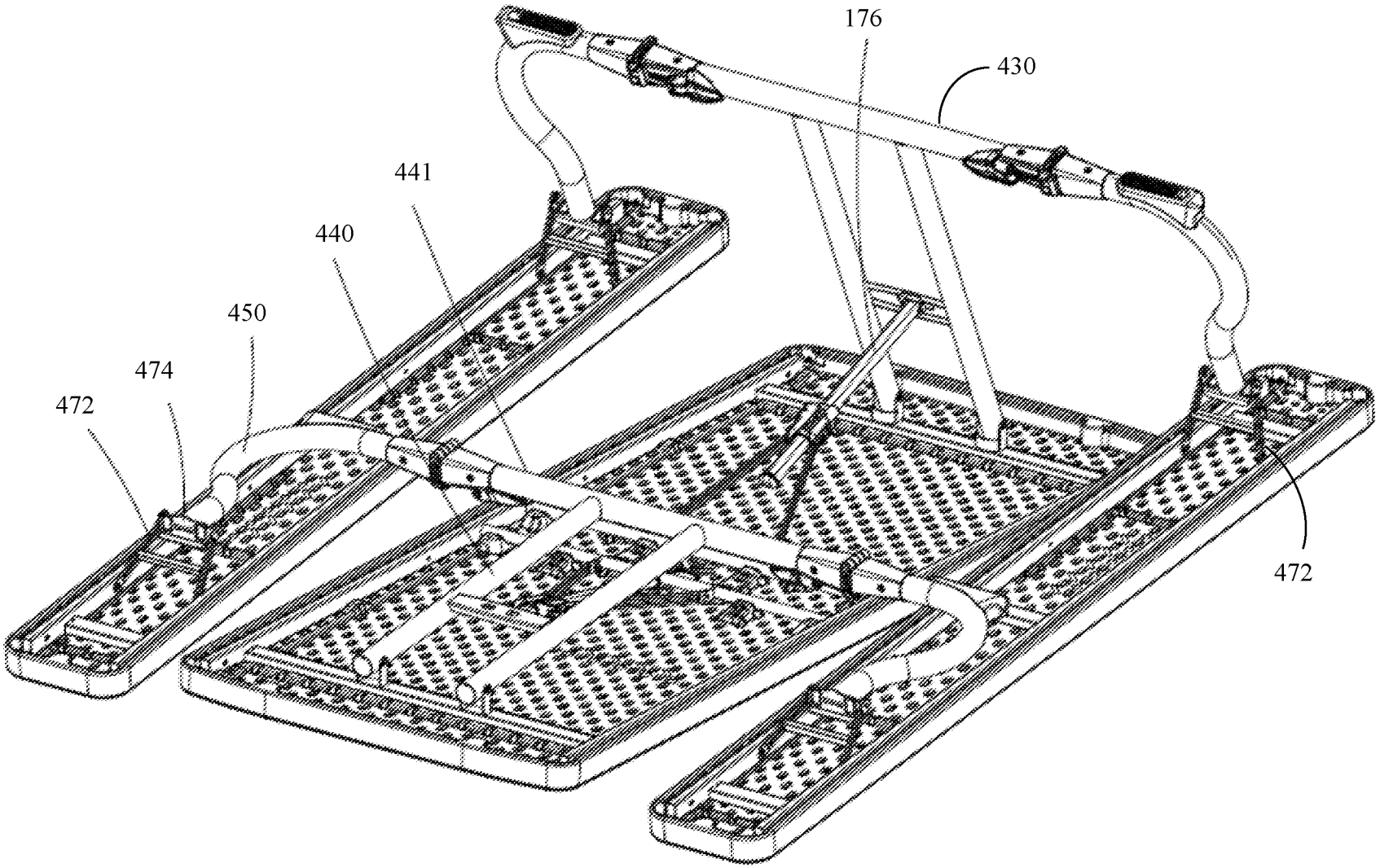
FIG. 9D is a bottom perspective view illustrating the exemplary picnic table of FIG. 9A in a first intermediate state in accordance with exemplary embodiments of the present disclosure.
Figure 9E:
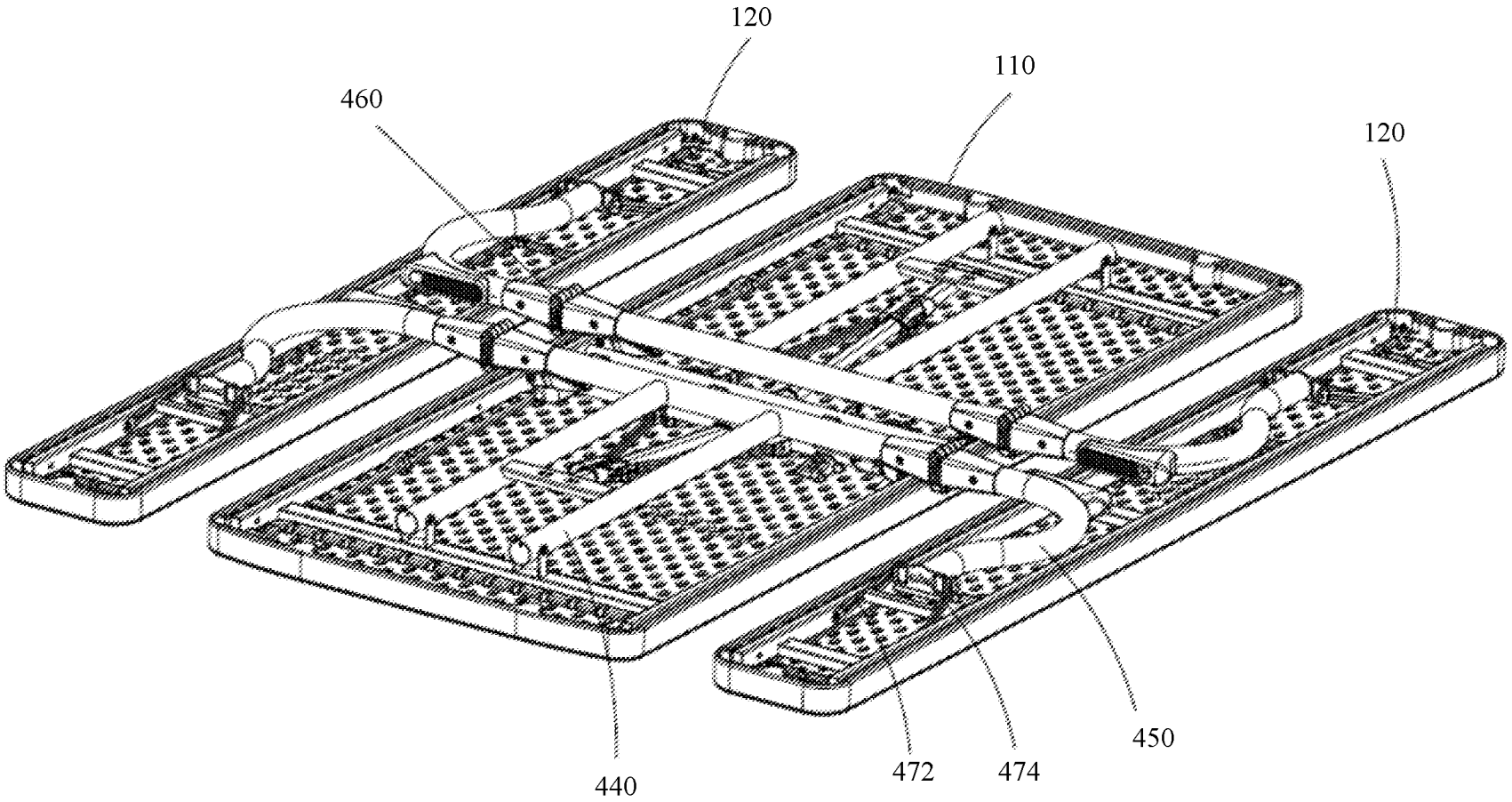
FIG. 9E is a bottom perspective view illustrating the exemplary picnic table of FIG. 9A in a second intermediate state in accordance with exemplary embodiments of the present disclosure.
Figure 9F:
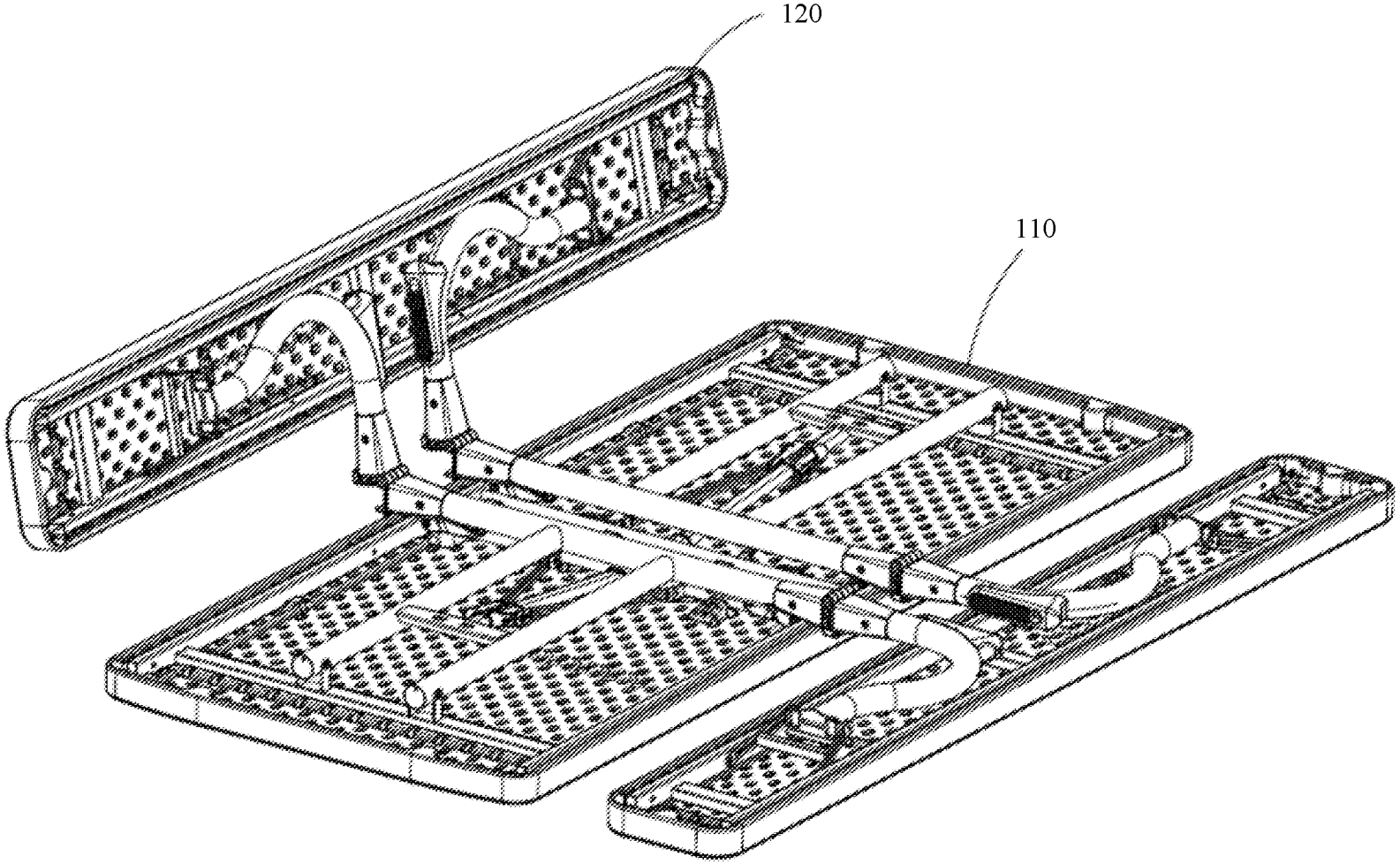
FIG. 9F is a bottom perspective view illustrating the exemplary picnic table of FIG. 9A in a third intermediate state in accordance with exemplary embodiments of the present disclosure.
Figure 9G:
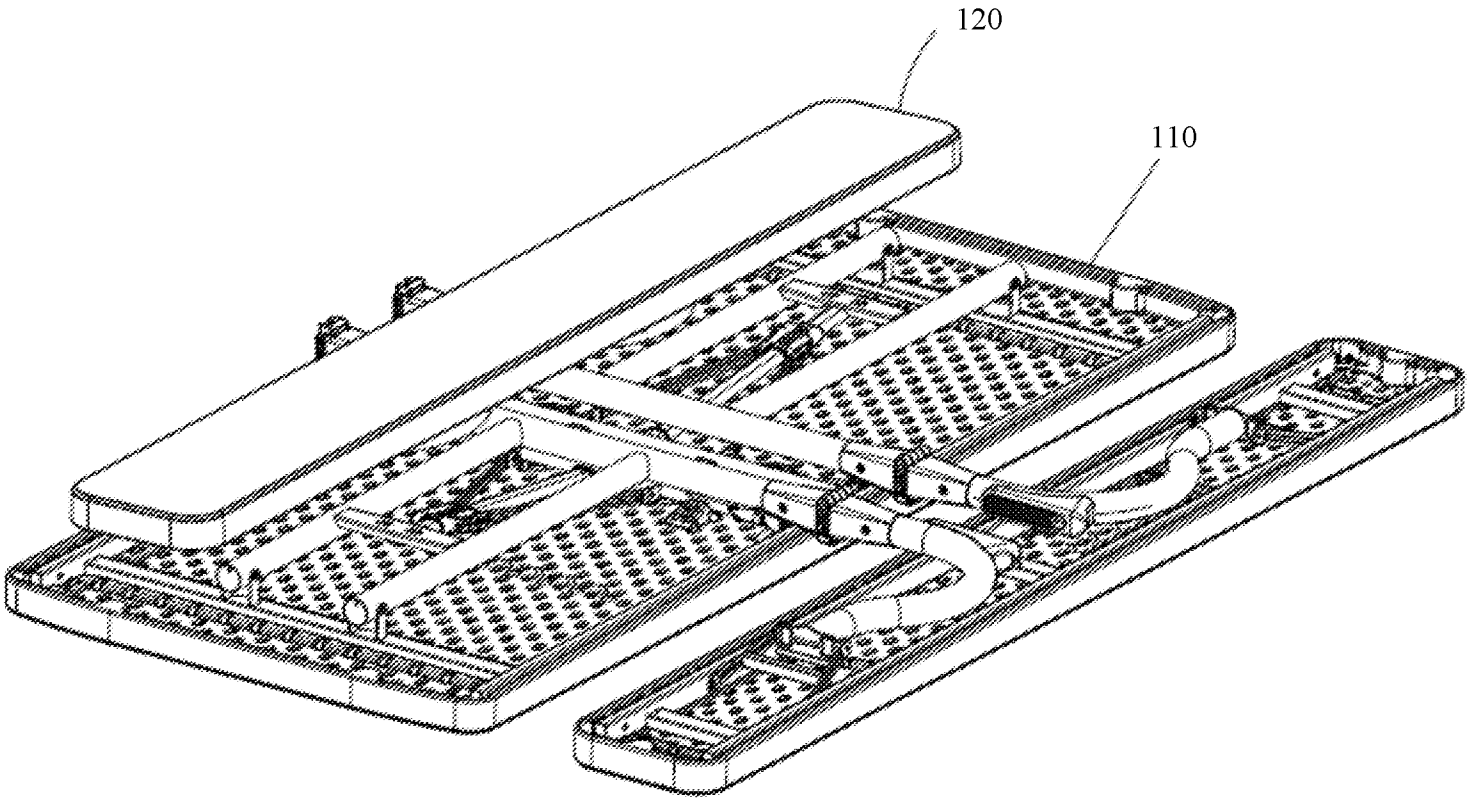
FIG. 9G is a bottom perspective view illustrating the exemplary picnic table of FIG. 9A in a fourth intermediate state in accordance with exemplary embodiments of the present disclosure.
Figure 9H:
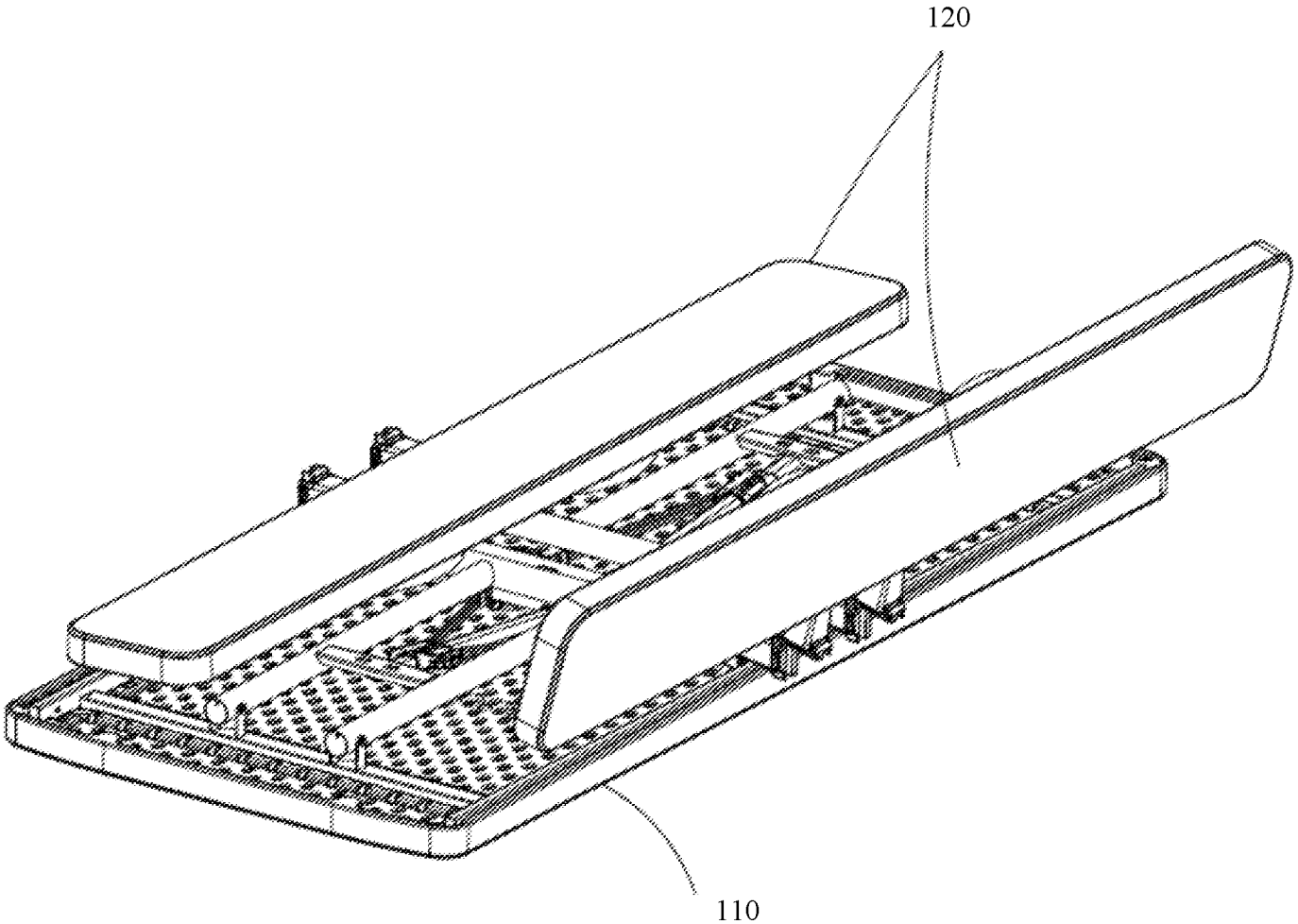
FIG. 9H is a bottom perspective view illustrating the exemplary picnic table of FIG. 9A in a fifth intermediate state in accordance with exemplary embodiments of the present disclosure.
Figure 9I:
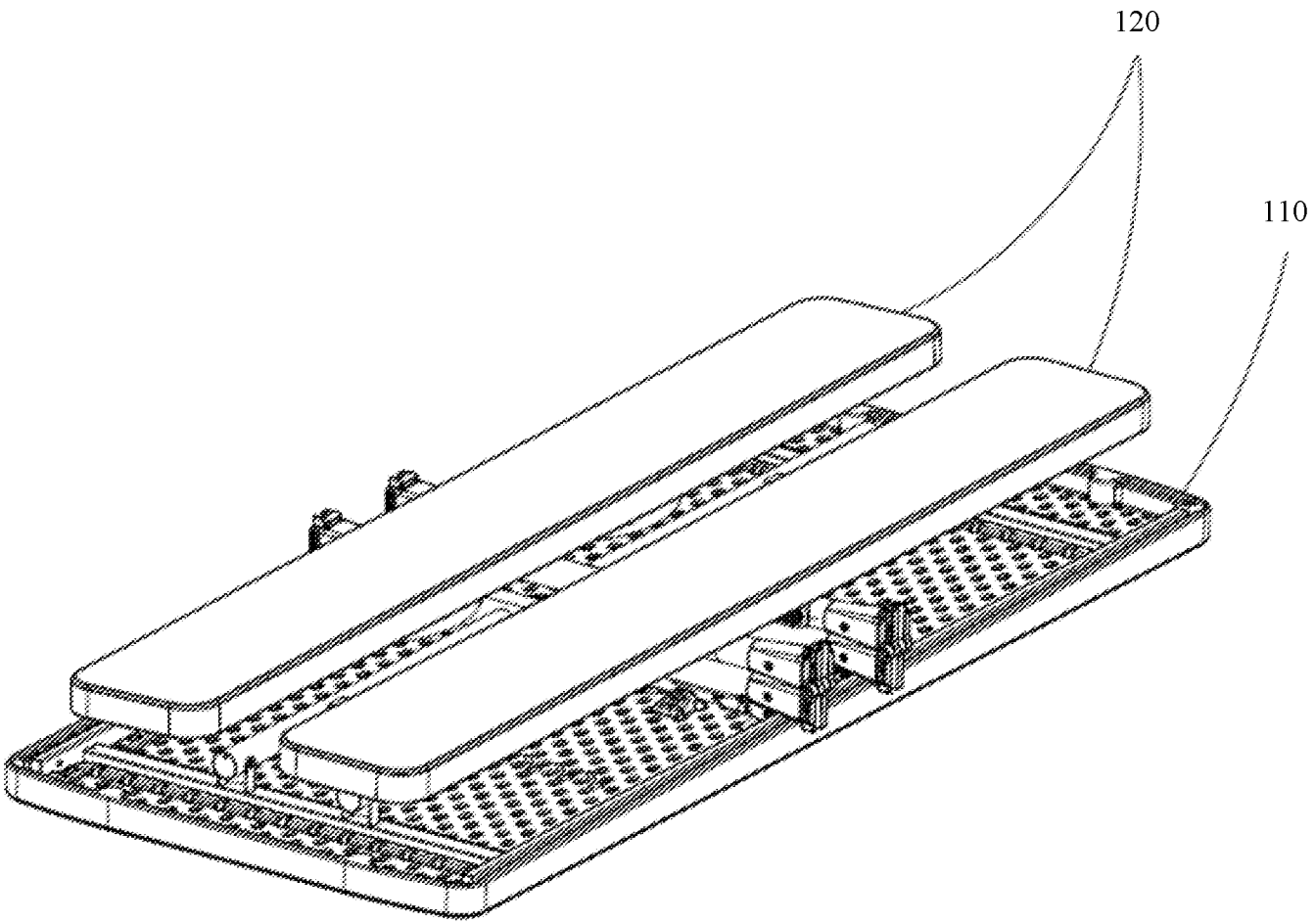
FIG. 9I is a bottom perspective view illustrating the exemplary picnic table of FIG. 9A in a folded state in accordance with exemplary embodiments of the present disclosure.

Referring to FIGS. 9C-9I, there is depicted an exemplary process for folding and unfolding picnic table 400. With the presence of bench link 472, there is no need to level the table and bench panels. Each supporting assembly can rotate along the first direction and fold onto the table and bench panels when they are at different lengths or height. This process is illustrated in FIGS. 9C and 9D. After each supporting assembly is folded to the table and bench panels, the remaining processes are substantially the same as those of picnic table 100, and thus the detailed description of which is omitted to avoid redundancy.

Similar to table support 140, in some exemplary embodiments, table support 440 includes a first supporting bar such as first supporting bar 441 and bench support 450 includes a second supporting bar such as second supporting bar 451. First supporting bar 441 and second supporting bar 451 are aligned with each other in the first direction when unfolded (e.g., when bench panel 120 is unfolded from table panel 110, or when the picnic table is unfolded). Connector 460 pivotally connects the second supporting support of the bench support with the first supporting bar of the table support such that the second supporting bar is rotatable with respect to the first supporting bar of the table support in the second direction.

Figure 10A:
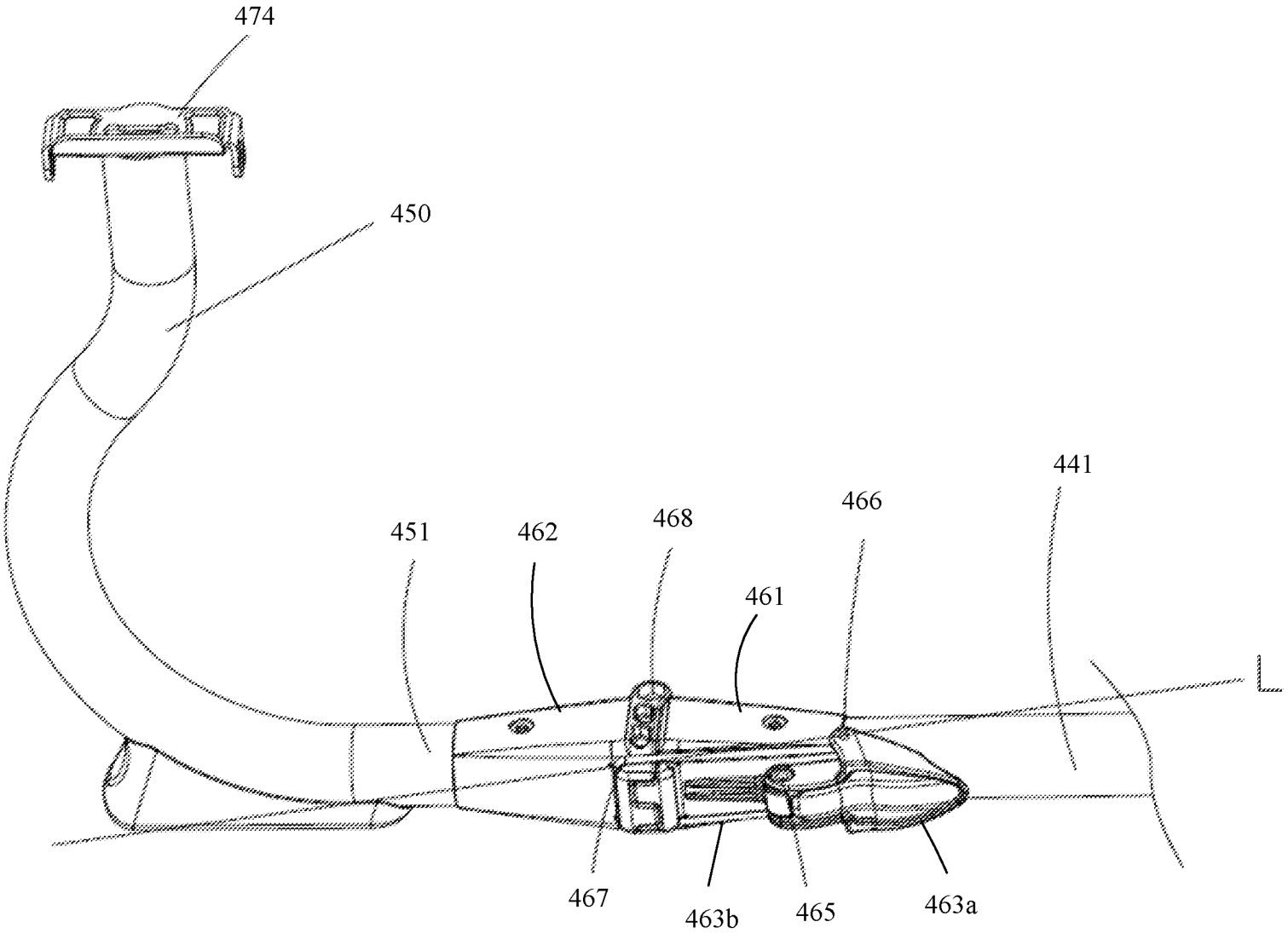
FIG. 10A is a perspective view illustrating a connection in an exemplary supporting assembly in a first state in accordance with exemplary embodiments of the present disclosure.
Figure 10B:
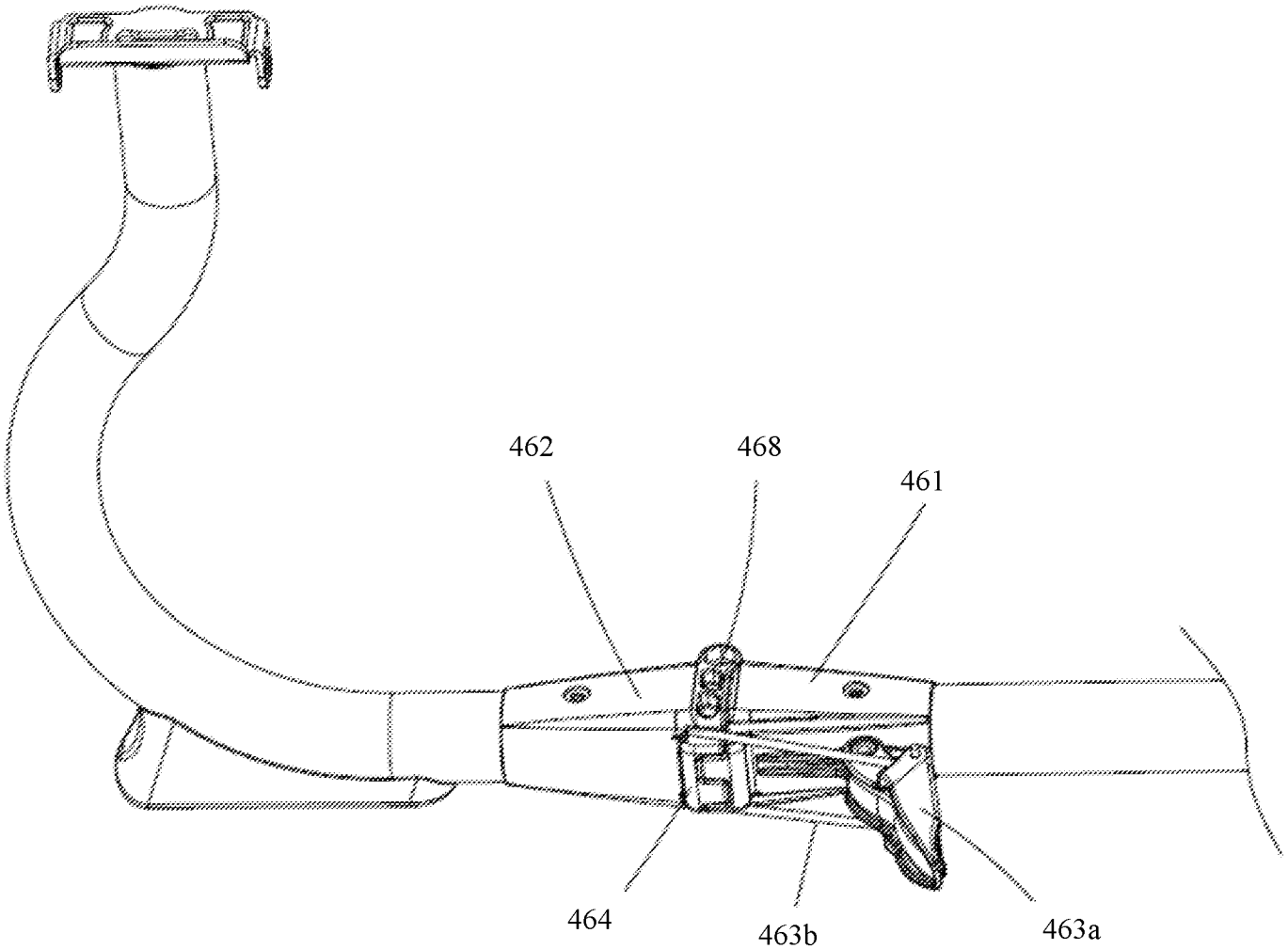
FIG. 10B is a perspective view illustrating a connection in an exemplary supporting assembly in a second state in accordance with exemplary embodiments of the present disclosure.
Figure 10C:
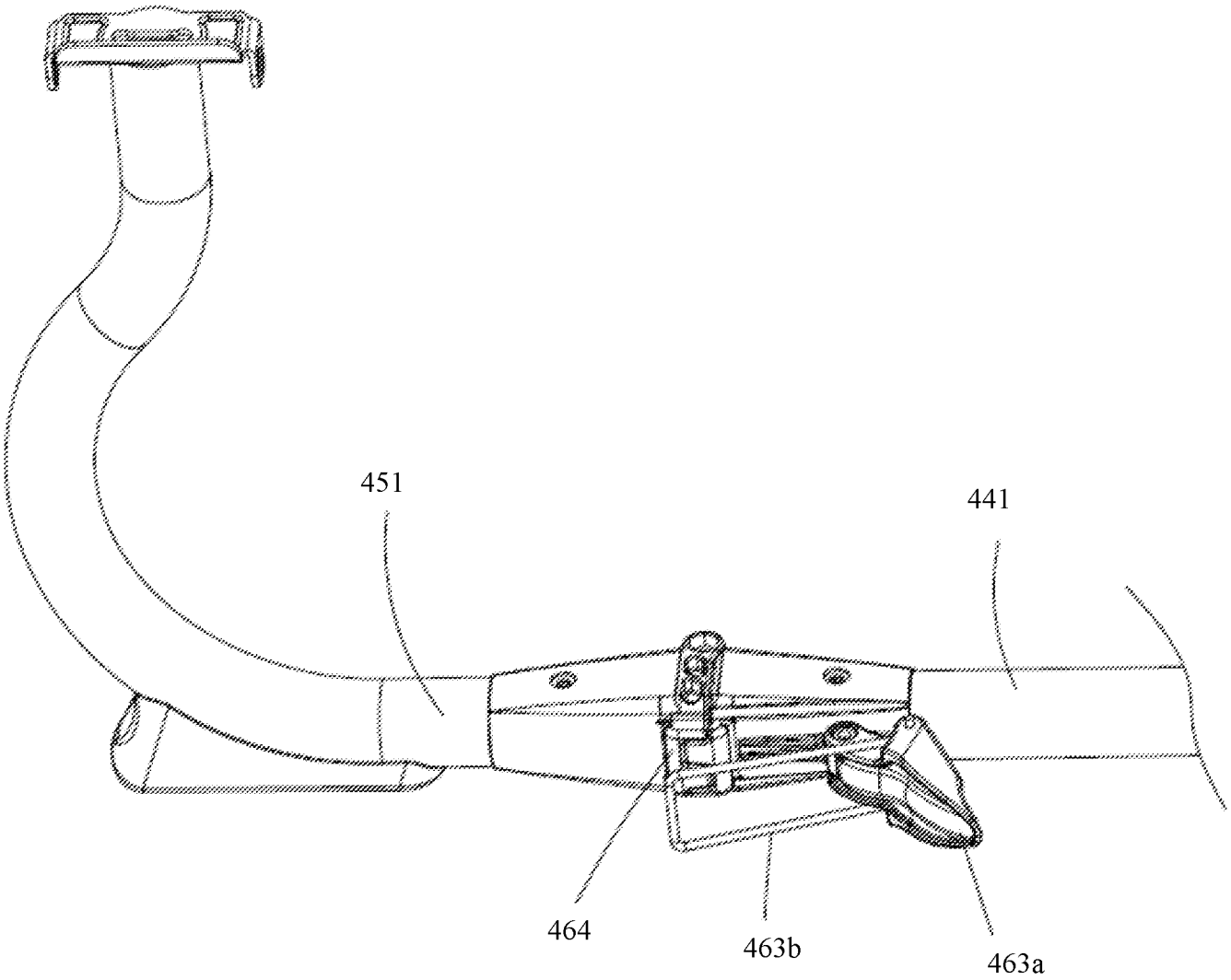
FIG. 10C is a perspective view illustrating a connection in an exemplary supporting assembly in a third state in accordance with exemplary embodiments of the present disclosure.
Figure 10D:
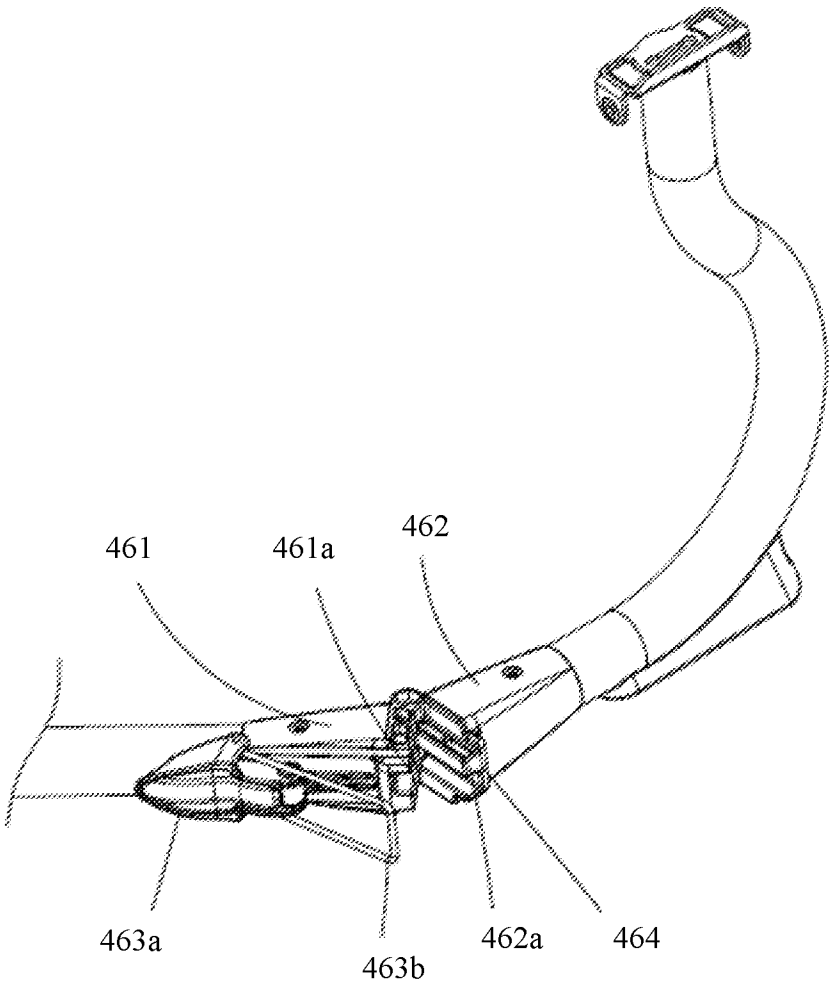
FIG. 10D is a perspective view illustrating a connection in an exemplary supporting assembly in a fourth state in accordance with exemplary embodiments of the present disclosure.
Figure 10E:
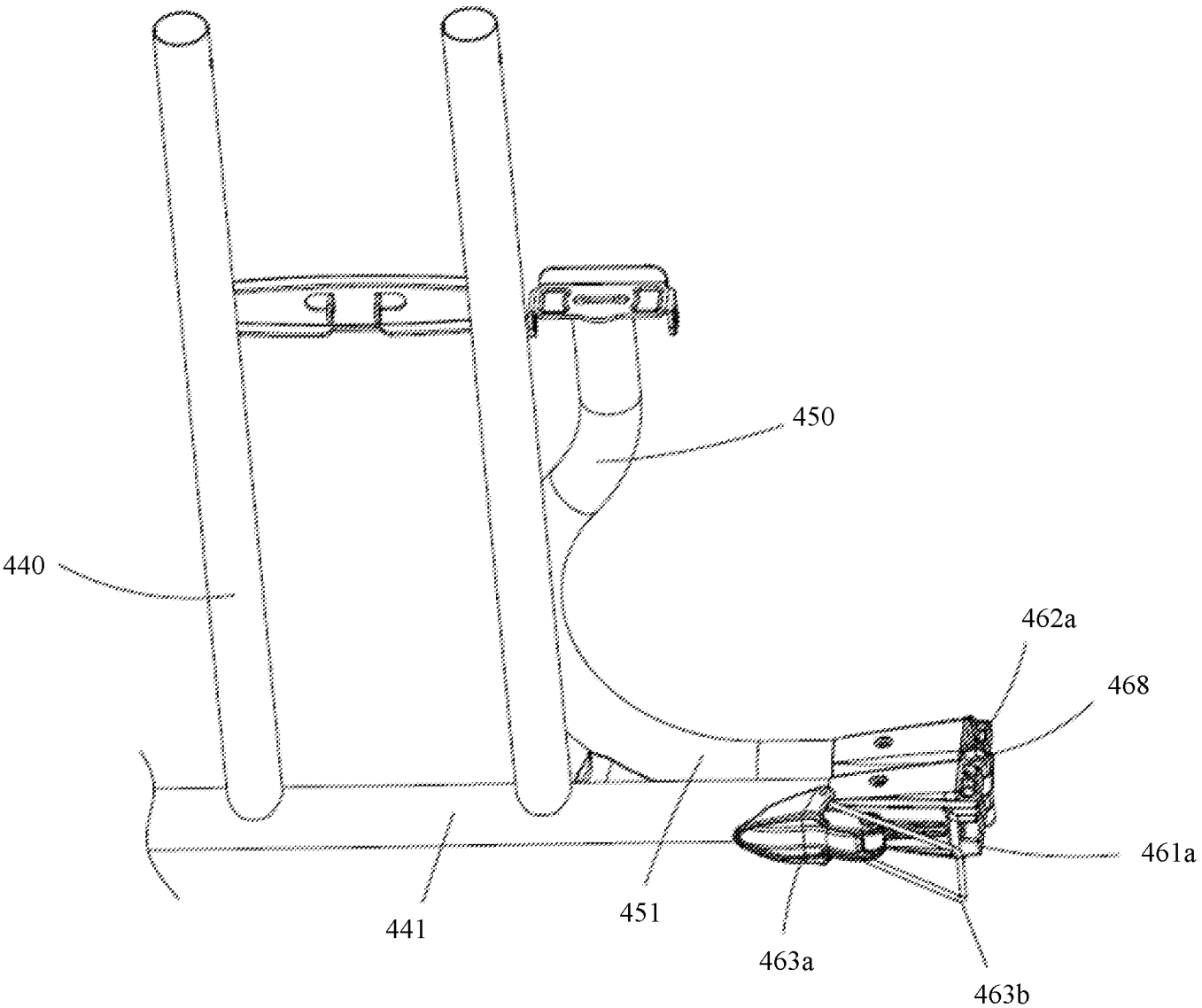
FIG. 10E is a perspective view illustrating a connection in an exemplary supporting assembly in a fifth state in accordance with exemplary embodiments of the present disclosure.

Referring to FIGS. 9B and 10A-10E, there are depicted connector 460 and the use of the connector to connect the second supporting support of the bench support with the first supporting bar of the table support in accordance with some exemplary embodiments of the present disclosure. Of these figures, FIG. 10A illustrates the connection at an unfolded (e.g., the first and second supporting bars are aligned with each other) and locked state, FIGS. 10B and 10C illustrate the connection at the unfolded but unlocked state, FIG. 10D illustrates the connection at an intermediate state, and FIG. 10E illustrates the connection at a folded state.

In some exemplary embodiments, connector 460 includes a plurality of couplers configured to connect the first supporting bar with the second supporting bar and lock the first and second supporting bars in position when unfolded. For instance, in some exemplary embodiments, connector 460 includes a first coupler such as first coupler 461, a second coupler such as second coupler 462 and a third coupler such as third coupler 463. The first coupler is connected with an end portion of one of the first and second supporting bars and the second coupler connected with an end portion of the other one of the first and second supporting bars. By way of example, FIGS. 10A-10E illustrate first coupler 461 connected with first supporting bar 441 and second coupler 462 connected with second supporting bar 451. The first and second couplers are pivotally connected with each other, e.g., pivotal axis 468, thereby allowing the first and second supporting bars to rotate with respect to each other along the second direction.

Connector 460 also includes a third coupler such as third coupler 463 pivotally connected with one of the first and second couplers and removably connected with the other of the first and second couplers. By way of example, FIGS. 10A-10E illustrate third coupler 463 pivotally connected with first coupler 461 and removably connected with second coupler 462. When connected with the second coupler, the third coupler locks the first and second couplers and restricts the first and second couplers from rotating with respect to each other. Accordingly, the first and second supporting bars are restricted from rotating with respect to each other at this state, resulting in a more stable picnic table.

In some exemplary embodiments, the second coupler includes a protrusion such as protrusion 464 at a side of the second coupler. The third coupler includes a first coupling piece such as first coupling piece 463*a* and a second coupling piece 463*b*. First coupling piece 463*a* is pivotally connected with the first coupler at a first position such as first position 465. Second coupling piece 463*b* is pivotally connected with first coupling piece 463*a* at a second position such as second position 466 and removably connected with protrusion 464 of the second coupler at a third position such as third position 467. In an exemplary embodiment, second coupling piece 463*b* includes a hook or buckle. In some exemplary embodiments, when unfolded and locked, the first position is located between the second and third positions along a length direction of the first supporting bar and is offset from a line defined by the second and third positions. Such an arrangement of the first, second and third positions ensures the first and second couplers remaining at the locked state once the second coupling piece is engaged with the protrusion of the second coupler.

To engage the second coupling piece with the protrusion of the second coupler, the first coupling piece is rotated toward the second coupler and then the first coupling piece is hooked with the protrusion of the second coupler. After that, the first coupling piece is rotated toward the first coupler. Because the first position is located between the second and third positions along a length direction of the first supporting bar and is offset from a line defined by the second and third positions, the first and second coupling pieces will remain in place and thus lock the first and second couplers unless an external force is applied to rotate the first coupling piece. This ensures the structural stability of the bench and table supports and the structural stability of the picnic table. To fold the picnic table, the first coupling piece is rotated toward the second coupler and the second coupling piece is unbuckled from the protrusion. The first and second couplers, and accordingly the first and second supporting bars, are then allowed to rotate with respect to each other.

In some exemplary embodiments, each of the first and second couplers includes one or more ribs at the ends that face each other when unfolded to help further stabilize the table and/or bench supports. For instance, in an exemplary embodiment, first coupler 461 includes one or more first ribs 461*a* and second coupler 462 includes one or more second ribs 462*a*. First ribs 461*a* and second ribs 462*a* are zigzagged with respect to each other and operably coupled with each other when unfolded. First ribs 461*a* and second ribs 462*a* can have any suitable configurations including but not limited to straight, curved or circular ribs.

Figure 11:
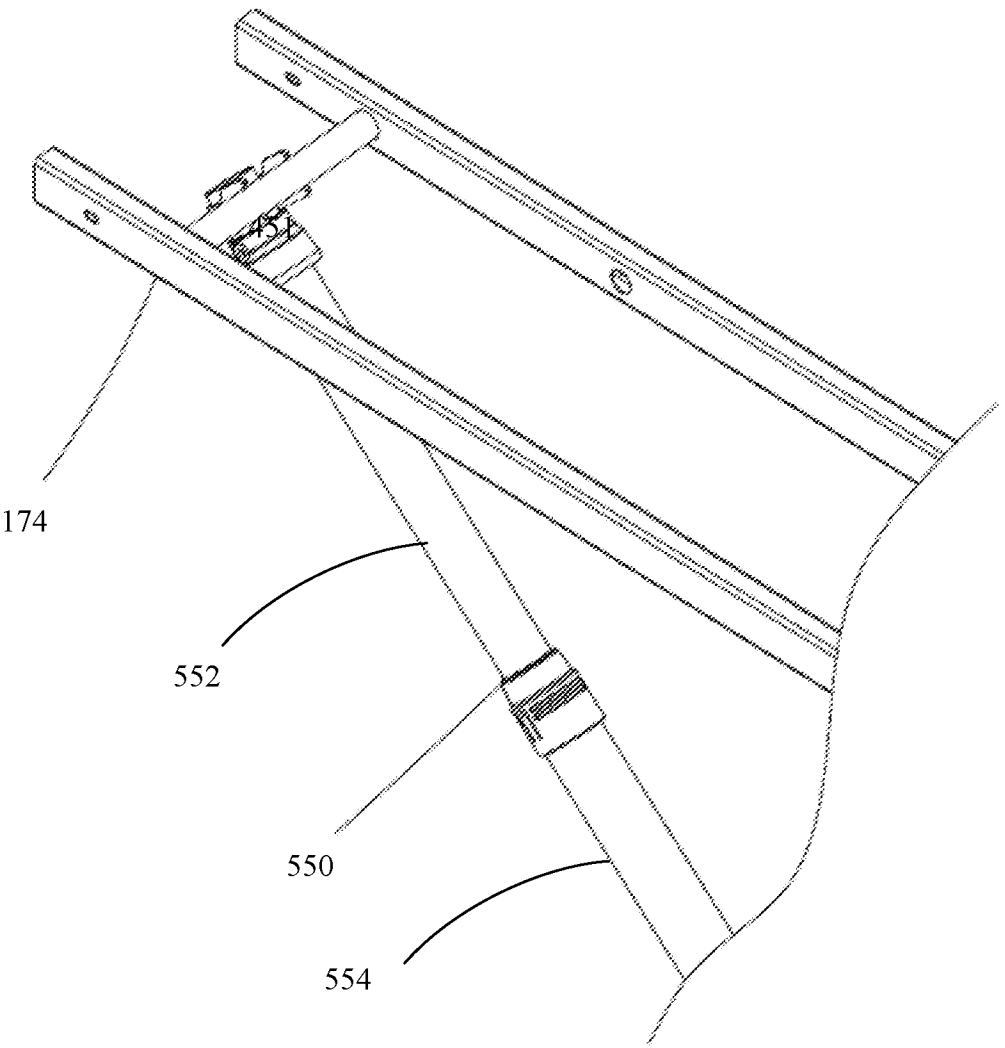
FIG. 11 is a perspective view illustrating an exemplary bench support in accordance with exemplary embodiments of the present disclosure.

In some exemplary embodiments, picnic tables of the present disclosure include additional, optional and/or alternative components. For instance, as an example, FIG. 11 illustrates a bench support such as bench support 550 configured to be adjustable in length. Bench support 550 can be used with any picnic table, whether or not its table support is adjustable, to allow one to adjust the height of a bench panel when unfolded. For instance, bench support 550 can be used in picnic table 100, 200, 300 or 400 disclosed herein to replace bench support 150, 250, 350 or 450. Bench support 550 can also be used in picnic table 100, 200, 300 or 400 disclosed herein along with bench support 150, 250, 350 or 450. For instance, bench support 550 can be used to support one bench panel with bench support 150, 250, 350 or 450 supporting another bench panel.

In an exemplary embodiment, bench support 550 includes an adjustable support similar to adjustable support 146 and having an inner bar such as inner bar 554 and an outer bar such as outer bar 554 telescopically coupled with each other. In an exemplary embodiment, the adjustable support has an end portion pivotally connected with bench frame 174 and another end portion connected with the second supporting bar of a supporting assembly. As such, when each of the first and second supporting assemblies is unfolded, adjusting collectively the lengths of the adjustable supports of the bench supports changes a height of the bench panel with respect to the table panel.

To fold a picnic table with an adjustable bench support such as bench support 550, one can adjust the bench support or the table support (if it is adjustable) or both to level the table and bench panels. Once the table and bench panels are leveled, the subsequent process is substantially the same as folding and unfolding of picnic table 100, and thus the detailed description of which is omitted to avoid redundancy.

The components illustrated in the figures and disclosed herein are combinable in any useful number and combination. For instance, first supporting bar 141, second supporting bar 142 and connector 160 can be used in picnic table 200, 300 or 400 to replace first supporting bar 241, 341 or 441, second supporting bar 242, 342 or 442, and connector

260, 360 or 460. Similarly, first supporting bar 241, second supporting bar 242 and connector 260 can be used in picnic table 100, 300 or 400 to replace first supporting bar 141, 341 or 441, second supporting bar 142, 342 or 442, and connector 160, 360 or 460. First supporting bar 341, second supporting bar 342 and connector 360 can be used in picnic table 100, 200 or 400 to replace first supporting bar 141, 241 or 441, second supporting bar 142, 242 or 442, and connector 160, 260 or 460. First supporting bar 441, second supporting bar 442 and connector 460 can be used in picnic table 100, 200 or 300 to replace first supporting bar 141, 241 or 341, second supporting bar 142, 242 or 342, and connector 160, 260 or 360.

The picnic tables of the present disclosures have several advantages. For instance, the picnic table can be folded multiple times into a generally layered block-like structure, with each bench panel is laid on the table panel either face-to-face or back-to-back with the table panel. As such, the picnic table when folded is compact, portable and easy to carry around. When in use, the height of the table panel and/or the height of a bench panel can be adjusted to meet the needs and preferences of various end users. The adjustment is simple and easy with the table and bench supports disclosed herein. Further, with the additional stabilizing features disclosed herein, the picnic table is more stable and reliable. In addition, with the supporting assemblies disclosed herein, folding and unfolding of the picnic tables are smooth and fast.

The terminology used herein is for the purpose of describing particular implementations only and is not intended to be limiting of the claims. As used in the description of the implementations and the appended claims, the singular forms "a", "an" and "the" are intended to include the plural forms as well, unless the context clearly indicates otherwise. It will be understood that the terms "top" or "bottom", "lower" or "upper", and etc. are used to describe features of the exemplary embodiments with reference to the positions of such features as displayed in the figures. It will be understood that, although the terms "first," "second," etc. may be used herein to describe various elements, these elements should not be limited by these terms. These terms are only used to distinguish one element from another. For example, a first bar could be termed a second bar, and, similarly, a second bar could be termed a first bar, without changing the meaning of the description, so long as all occurrences of the "first bar" are renamed consistently and all occurrences of the "second bar" are renamed consistently.

What is claimed is:

1. A picnic table comprising:

a table panel;

one or more bench panels; and first and second supporting assemblies, each comprising:

a table support connected to the table panel and rotatable with respect to the table panel in a first direction;

one or more bench supports, wherein each bench support in the one or more bench supports is connected to a corresponding bench panel in the one or more bench panels and rotatable with respect to the corresponding bench panel in the first direction; and one or more connectors, each pivotally connecting a corresponding bench support in the one or more bench supports with the table support such that the corresponding bench support is rotatable with respect to the table support in a second direction that is different than the first direction;

wherein each of the first and second supporting assemblies is foldable to the table and bench panels, and each of the one or more bench panels is foldable to the table panel; and wherein of each of the first and second supporting assemblies:

the table support comprises a first supporting bar;

each of the one or more bench supports comprises a second supporting bar aligned with the first supporting bar in the first direction when unfolded;

each of the one or more connectors pivotally connects the second supporting support of the corresponding bench support with the first supporting bar of the table support such that the second supporting bar of the corresponding bench support is rotatable with respect to the first supporting bar of the table support in the second direction;

the end portion of the first supporting bar comprises a first end surface;

the end portion of the second supporting bar comprises a second end surface; and each of the first and second end surfaces comprises a substantially flat portion and a curved portion, wherein the substantially flat portions of the first and second end surfaces abut each other when unfolded and the curved portions of the first and second end surfaces allow the first and second supporting bars to rotate with respect to the first and second connecting pieces.

2. A picnic table comprising:

a table panel;

a table frame disposed at a lower side of the table panel, wherein the table support is pivotally connected with the table frame;

one or more bench panels;

first and second supporting assemblies, each comprising:

a table support connected to the table panel and rotatable with respect to the table panel in a first direction; and one or more bench supports, wherein each bench support in the one or more bench supports is connected to a corresponding bench panel in the one or more bench panels and rotatable with respect to the corresponding bench panel in the first direction, and connected to the table support and rotatable with respect to the table support in a second direction that is different than the first direction;

a table frame disposed at a lower side of the table panel, wherein the table support is pivotally connected with the table frame; and one or more bench frames, each disposed at a lower side of a corresponding bench panel in the one or more bench panels, wherein each bench support is pivotally connected with a bench frame in the one or more bench frames;

wherein each of the first and second supporting assemblies is foldable to the table and bench panels, and each of the one or more bench panels is foldable to the table panel; and wherein corresponding to each bench support of the first or second supporting assembly, the picnic table further comprises:

a bench link having a first end portion pivotally connected with the bench frame and a second end portion pivotally connected with an upper end portion of the bench support, thereby allowing the bench and table supports of the first or second supporting assembly to rotate together along the first direction when the bench and table supports of the first or second supporting assembly are at different lengths.

3. The picnic table of claim 2, wherein the second end portion of the bench link is pivotally connected with the upper end portion of the bench support through a connecting piece.

4. The picnic table of claim 1, wherein when each of the one or more bench panels is folded onto the table panel, the lower side of each bench panel faces the lower side of the table panel, wherein at least a portion of the first and second supporting assemblies are sandwiched between the table panel and the one or more bench panels.

5. The picnic table of claim 1, wherein of each of the first and second supporting assemblies, the table support comprises one or more adjustable supports each having an adjustable length, wherein when unfolded, adjusting collectively the lengths of the one or more adjustable supports of the table supports of the first and second supporting assemblies changes a height of the table panel with respect to the one or more bench panels.

6. The picnic table of claim 1, wherein corresponding to at least one bench panel, each bench support comprises an adjustable support having an adjustable length for adjusting a height of the at least one bench panel when unfolded, or for assisting in folding or unfolding of the first or second supporting assembly, or for both.

7. The picnic table of claim 1, wherein of each of the first and second supporting assemblies, each of the one or more connectors comprises:

at least one connecting piece;

a first fastener pivotally connecting an end portion of the first supporting bar with the at least one connecting piece; and a second fastener pivotally connecting an end portion of the second supporting bar with the at least one connecting piece.

8. The picnic table of claim 7, wherein the at least one connecting piece comprises a first connecting piece and a second connecting piece opposing to each other, thereby forming a channel to receive the end portion of the first supporting bar and the end portion of the second supporting bar, and wherein of each of the first and second supporting assemblies, each of the one or more connectors further comprises at least one third connecting piece fixedly connected or integrally formed with the first and second connecting pieces.

9. A picnic table comprising:

a table panel;

one or more bench panels; and first and second supporting assemblies, each comprising:

a table support connected to the table panel and rotatable with respect to the table panel in a first direction; and one or more bench supports, each connected to a corresponding bench panel in the one or more bench panels and rotatable with respect to the corresponding bench panel in the first direction; and one or more connectors, each pivotally connecting a corresponding bench support in the one or more bench supports with the table support such that the corresponding bench support is rotatable with respect to the table support in a second direction that is different than the first direction;

wherein each of the first and second supporting assemblies is foldable to the table and bench panels, and each of the one or more bench panels is foldable to the table panel; and wherein of each of the first and second supporting assemblies:

the table support comprises a first supporting bar;

each of the one or more bench supports comprises a second supporting bar aligned with the first supporting bar in the first direction when unfolded;

each of the one or more connectors pivotally connects the second supporting support of the corresponding bench support with the first supporting bar of the table support such that the second supporting bar of the corresponding bench support is rotatable with respect to the first supporting bar of the table support in the second direction;

the end portion of one of the first and second supporting bars comprises a protrusion; and the end portion of the other of the first and second supporting bars comprises a groove to receive the protrusion when unfolded.

10. The picnic table of claim 9, wherein:

the protrusion comprises a knob at a side thereof; and the groove comprises a recess to receive the knob and a curved or sloped surface adjacent to the recess to guide the knob into the recess.

11. The picnic table of claim 9, further comprising:

a table frame disposed at a lower side of the table panel, wherein the table support is pivotally connected with the table frame;

one or more bench frames, each disposed at a lower side of a corresponding bench panel in the one or more bench panels, wherein each bench support is pivotally connected with a bench frame in the one or more bench frames; and corresponding to each bench support of the first or second supporting assembly, a bench link having a first end portion pivotally connected with the bench frame and a second end portion pivotally connected with an upper end portion of the bench support, thereby allowing the bench and table supports of the first or second supporting assembly to rotate together along the first direction when the bench and table supports of the first or second supporting assembly are at different lengths.

12. The picnic table of claim 9, wherein of each of the first and second supporting assemblies, the table or bench support comprises an adjustable support.

13. A picnic table comprising:

a table panel;

one or more bench panels; and first and second supporting assemblies, each comprising:

a table support connected to the table panel and rotatable with respect to the table panel in a first direction; and one or more bench supports, each connected to a corresponding bench panel in the one or more bench panels and rotatable with respect to the corresponding bench panel in the first direction; and one or more connectors, each pivotally connecting a corresponding bench support in the one or more bench supports with the table support such that the corresponding bench support is rotatable with respect to the table support in a second direction that is different than the first direction;

wherein each of the first and second supporting assemblies is foldable to the table and bench panels, and each of the one or more bench panels is foldable to the table panel; and wherein of each of the first and second supporting assemblies:

the table support comprises a first supporting bar;

each of the one or more bench supports comprises a second supporting bar aligned with the first supporting bar in the first direction when unfolded;

each of the one or more connectors pivotally connects the second supporting support of the corresponding bench support with the first supporting bar of the table support such that the second supporting bar of the corresponding bench support is rotatable with respect to the first supporting bar of the table support in the second direction;

the end portion of the first supporting bar comprises a first curved side surface;

the end portion of the second supporting bar comprises a second curved side surface; and each of the one or more connectors comprises:

a first pin disposed at the at least one connecting piece and operably coupled with the first curved side surface to help guide rotation of the first supporting bar with respect to the at least one connecting piece; and a second pin disposed at the at least one connecting piece and operably coupled with the second curved side surface to help guide rotation of the second supporting bar with respect to the at least one connecting piece.

14. The picnic table of claim 13, wherein each of the first and second curved side surfaces comprises:

a first indentation to accommodate crosswise at least a portion of the first or second pin when the picnic table is unfolded to help stabilize the table and bench supports;

a second indentation to accommodate crosswise at least a portion of the first or second pin when the picnic table is folded; and a convex segment between the first and second indentations.

15. The picnic table of claim 13, further comprising:

a table frame disposed at a lower side of the table panel, wherein the table support is pivotally connected with the table frame;

one or more bench frames, each disposed at a lower side of a corresponding bench panel in the one or more bench panels, wherein each bench support is pivotally connected with a bench frame in the one or more bench frames; and corresponding to each bench support of the first or second supporting assembly, a bench link having a first end portion pivotally connected with the bench frame and a second end portion pivotally connected with an upper end portion of the bench support, thereby allowing the bench and table supports of the first or second supporting assembly to rotate together along the first direction when the bench and table supports of the first or second supporting assembly are at different lengths.

16. The picnic table of claim 13, wherein of each of the first and second supporting assemblies, the table or bench support comprises an adjustable support.

17. A picnic table comprising:

a table panel;

one or more bench panels; and first and second supporting assemblies, each comprising:

a table support connected to the table panel and rotatable with respect to the table panel in a first direction; and one or more bench supports, each connected to a corresponding bench panel in the one or more bench panels and rotatable with respect to the corresponding bench panel in the first direction; and one or more connectors, each pivotally connecting a corresponding bench support in the one or more bench supports with the table support such that the corresponding bench support is rotatable with respect to the table support in a second direction that is different than the first direction;

wherein each of the first and second supporting assemblies is foldable to the table and bench panels, and each of the one or more bench panels is foldable to the table panel; and wherein of each of the first and second supporting assemblies:

the table support comprises a first supporting bar;

each of the one or more bench supports comprises a second supporting bar aligned with the first supporting bar in the first direction when unfolded;

each of the one or more connectors pivotally connects the second supporting support of the corresponding bench support with the first supporting bar of the table support such that the second supporting bar of the corresponding bench support is rotatable with respect to the first supporting bar of the table support in the second direction; and each of the one or more connectors comprises:

a first coupler connected with an end portion of one of the first and second supporting bars;

a second coupler connected with an end portion of the other one of the first and second supporting bars, wherein the first and second couplers are pivotally connected with each other to allow the first and second supporting bars to rotate with respect to each other along the second direction; and a third coupler pivotally connected with the first coupler and removably connected with the second coupler.

18. The picnic table of claim 17, wherein:

the second coupler comprises a protrusion at a side thereof; and the third coupler comprises a first coupling piece pivotally connected with the first coupler at a first position, and a second coupling piece pivotally connected with the first coupling piece at a second position and removably connected with the protrusion of the second coupler at a third position, wherein when unfolded, the first position is located between the second and third positions along a length direction of the first supporting bar and is offset from a line defined by the second and third positions.

19. The picnic table of claim 17, wherein:

the first coupler comprises one or more first ribs facing the second coupler when unfolded; and the second coupler comprises one or more second ribs facing the first coupler when unfolded, wherein the first and second ribs are zigzagged with respect to each other and operably coupled with each other when unfolded to help stabilize the table and bench supports.

20. The picnic table of claim 17, further comprising:

a table frame disposed at a lower side of the table panel, wherein the table support is pivotally connected with the table frame;

one or more bench frames, each disposed at a lower side of a corresponding bench panel in the one or more bench panels, wherein each bench support is pivotally connected with a bench frame in the one or more bench frames; and corresponding to each bench support of the first or second supporting assembly, a bench link having a first end portion pivotally connected with the bench frame and a second end portion pivotally connected with an upper end portion of the bench support, thereby allowing the bench and table supports of the first or second supporting assembly to rotate together along the first direction when the bench and table supports of the first or second supporting assembly are at different lengths.

21. The picnic table of claim 17, wherein of each of the first and second supporting assemblies, the table or bench support comprises an adjustable support.

22. The picnic table of claim 1, further comprising:

a table frame disposed at a lower side of the table panel, wherein the table support is pivotally connected with the table frame;

one or more bench frames, each disposed at a lower side of a corresponding bench panel in the one or more bench panels, wherein each bench support is pivotally connected with a bench frame in the one or more bench frames; and corresponding to each bench support of the first or second supporting assembly, a bench link having a first end portion pivotally connected with the bench frame and a second end portion pivotally connected with an upper end portion of the bench support, thereby allowing the bench and table supports of the first or second supporting assembly to rotate together along the first direction when the bench and table supports of the first or second supporting assembly are at different lengths.

* * * * *